US009400439B2

(12) United States Patent
Nagata et al.

(10) Patent No.: US 9,400,439 B2
(45) Date of Patent: Jul. 26, 2016

(54) TONER, DEVELOPER, AND IMAGE FORMING APPARATUS

(71) Applicants: Kousuke Nagata, Shizuoka (JP); Masahide Yamada, Shizuoka (JP); Shinya Nakayama, Shizuoka (JP); Akiyoshi Sabu, Shizuoka (JP); Tatsuya Morita, Kanagawa (JP); Takamasa Hase, Shizuoka (JP); Suzuka Amemori, Shizuoka (JP); Rintaro Takahashi, Kanagawa (JP)

(72) Inventors: Kousuke Nagata, Shizuoka (JP); Masahide Yamada, Shizuoka (JP); Shinya Nakayama, Shizuoka (JP); Akiyoshi Sabu, Shizuoka (JP); Tatsuya Morita, Kanagawa (JP); Takamasa Hase, Shizuoka (JP); Suzuka Amemori, Shizuoka (JP); Rintaro Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/425,398

(22) PCT Filed: Sep. 10, 2013

(86) PCT No.: PCT/JP2013/074957

§ 371 (c)(1),
(2) Date: Mar. 3, 2015

(87) PCT Pub. No.: WO2014/046067

PCT Pub. Date: Mar. 27, 2014

(65) Prior Publication Data

US 2015/0234304 A1 Aug. 20, 2015

(30) Foreign Application Priority Data

Sep. 18, 2012 (JP) ..... 2012-204480
Mar. 7, 2013 (JP) ..... 2013-044886

(51) Int. Cl.
*G03G 9/08* (2006.01)
*G03G 9/087* (2006.01)
*G03G 15/08* (2006.01)
*G03G 15/20* (2006.01)

(52) U.S. Cl.
CPC ..... *G03G 9/08755* (2013.01); *G03G 9/0819* (2013.01); *G03G 9/08764* (2013.01); *G03G 15/08* (2013.01); *G03G 15/2003* (2013.01)

(58) Field of Classification Search
CPC ..... G03G 9/08755; G03G 9/08764
USPC ..... 430/109.4
See application file for complete search history.

(56) References Cited

U.S. PATENT DOCUMENTS 6,242,148 B1 6/2001 Nakajima
2006/0292477 A1 12/2006 Daimon et al.

(Continued)

FOREIGN PATENT DOCUMENTS

EP 2 381 313 A1 10/2011
JP 59-033787 2/1984

(Continued)

OTHER PUBLICATIONS

Extended European Search Report issued Sep. 14, 2015 in Patent Application No. 13839948.0.

(Continued)

*Primary Examiner* — Mark A Chapman
(74) *Attorney, Agent, or Firm* — Oblon, McClelland, Maier & Neustadt, L.L.P.

(57) ABSTRACT

A toner including a crystalline resin wherein the crystalline resin contains a crystalline resin having a urethane bond, a urea bond or both thereof, and wherein the crystalline resin has an average crystallite diameter of 20 nm to 70 nm.

14 Claims, 8 Drawing Sheets

(56) References Cited

U.S. PATENT DOCUMENTS

| | | | |
|---|---|---|---|
| 2008/0050669 | A1 | 2/2008 | Ohmura et al. |
| 2011/0177447 | A1 | 7/2011 | Suzuki et al. |
| 2011/0262856 | A1 | 10/2011 | Sugimoto et al. |
| 2012/0282000 | A1 | 11/2012 | Nakayama et al. |
| 2013/0078563 | A1 | 3/2013 | Nakayama et al. |
| 2013/0095422 | A1 | 4/2013 | Yamamoto et al. |
| 2013/0115550 | A1 | 5/2013 | Amemori et al. |
| 2013/0130169 | A1 | 5/2013 | Aoki et al. |
| 2014/0080051 | A1 | 3/2014 | Sawada et al. |
| 2015/0355563 | A1 | 12/2015 | Aoki et al. |

FOREIGN PATENT DOCUMENTS

| | | |
|---|---|---|
| JP | 05-009027 | 1/1993 |
| JP | 7-28275 | 3/1995 |
| JP | 2001-235893 | 8/2001 |
| JP | 2004-117551 | 4/2004 |
| JP | 2006-065194 | 3/2006 |
| JP | 2006-113473 A | 4/2006 |
| JP | 2007-004080 | 1/2007 |
| JP | 2008-052192 | 3/2008 |
| JP | 2008-299086 | 12/2008 |
| JP | 2009-014926 | 1/2009 |
| JP | 2009-288516 | 12/2009 |
| JP | 2010-070756 | 4/2010 |
| JP | 2010-077419 | 4/2010 |
| JP | 2010-150535 | 7/2010 |
| JP | 2010-151996 | 7/2010 |
| JP | 2011-150043 | 8/2011 |
| JP | 2011-221557 | 11/2011 |
| JP | 2011-232552 | 11/2011 |
| JP | 2011-237790 | 11/2011 |
| JP | 2012-027212 | 2/2012 |
| JP | 2012-42939 | 3/2012 |
| JP | 2012-88353 | 5/2012 |
| JP | 2012-133161 | 7/2012 |
| JP | 2012-141542 | 7/2012 |

OTHER PUBLICATIONS

International Search Report Issued Oct. 22, 2013 for counterpart International Patent Application No. PCT/JP2013/074957 filed Sep. 10, 2013.

Japanese Information Offer Forms dated Feb. 22, 2016, in Japanese Patent Application No. 2013-44886 (with English Translation).

TONER, DEVELOPER, AND IMAGE FORMING APPARATUS

TECHNICAL FIELD

The present invention relates to a toner, a developer, and an image forming apparatus.

BACKGROUND ART

In an electrophotographic image forming apparatus or electrostatic recording apparatus, an electric or magnetic latent image has been developed with a toner. For example, in an electrophotography, an electrostatic charge image (latent image) has formed on a photoconductor and then developed with a toner to thereby form a toner image. The toner image is usually transferred onto a recording medium such as paper and then fixed with, for example, heating.

In an image forming method using a heat-fixing system in which a toner is fixed with heating, a large amount of electric power is required in a process in which a toner is heat-melted to be fixed onto a recording medium such as paper. Therefore, one of important properties of a toner is low temperature fixability in terms of energy-saving.

In order to improve low temperature fixability of a toner, it is important to control thermal property of a binder resin which is major component of the toner.

Therefore, there has been suggested to, in a toner in which a crystalline resin is a major component of a binder resin, control a composition and thermal property of the crystalline resin so as to fall within a certain range (see, for example, PTL 1).

There also has been suggested to use a toner which contains, as a binder resin, two crystalline resins having different molecular weights under a certain fixing condition (see, for example, PTL 2).

There also has been suggested a toner which contains, as a binder resin, two crystalline polyester resins having different storage elastic moduli at 160° C. (see, for example, PTL 3).

In the case where a toner containing a crystalline resin is used, although it is excellent in low temperature fixability, the following problem will more likely occur compared to the case where a toner containing a non-crystalline resin as a major component of a binder resin is used. That is, when printing on paper having a wider width in a direction orthogonal to a conveyance direction of a sheet-shaped medium (e.g., A3 size paper) after continuously printing on sheets of paper having a narrower width (e.g., A4 size paper), there will occur problems such as toner offset on parts of a surface of a fixing member corresponding to ends of the paper having a wider width (hereinafter may be referred to as "end-offset") and gloss unevenness at ends of the paper having a wider width, resulting from a difference of their paper-feeding sizes.

Therefore, there has been a need for providing a toner being capable of preventing end-offset and gloss unevenness even in the case of containing a crystalline resin.

CITATION LIST

Patent Literature

PTL 1: Japanese Patent Application Laid-Open (JP-A) No. 2010-077419

PTL 2: JP-A No. 2009-014926

PTL 3: JP-A No. 2010-151996

SUMMARY OF INVENTION

Technical Problem

The present invention aims to solve the aforementioned various problems in the art, and to achieve the following object. An object of the present invention is to provide a toner being capable of preventing end-offset and gloss unevenness even in the case of containing a crystalline resin.

Solution to Problem

The means for solving the aforementioned problems is as follows:

a toner including:

a crystalline resin, wherein the crystalline resin contains a crystalline resin having a urethane bond, a urea bond or both thereof, and wherein the crystalline resin has an average crystallite diameter of 20 nm to 70 nm.

Advantageous Effects of Invention

The present invention can solve the aforementioned various problems in the art, and can provide a toner being capable of preventing end-offset and gloss unevenness even in the case of containing a crystalline resin.

DESCRIPTION OF EMBODIMENTS (Toner)

Figure 1A:
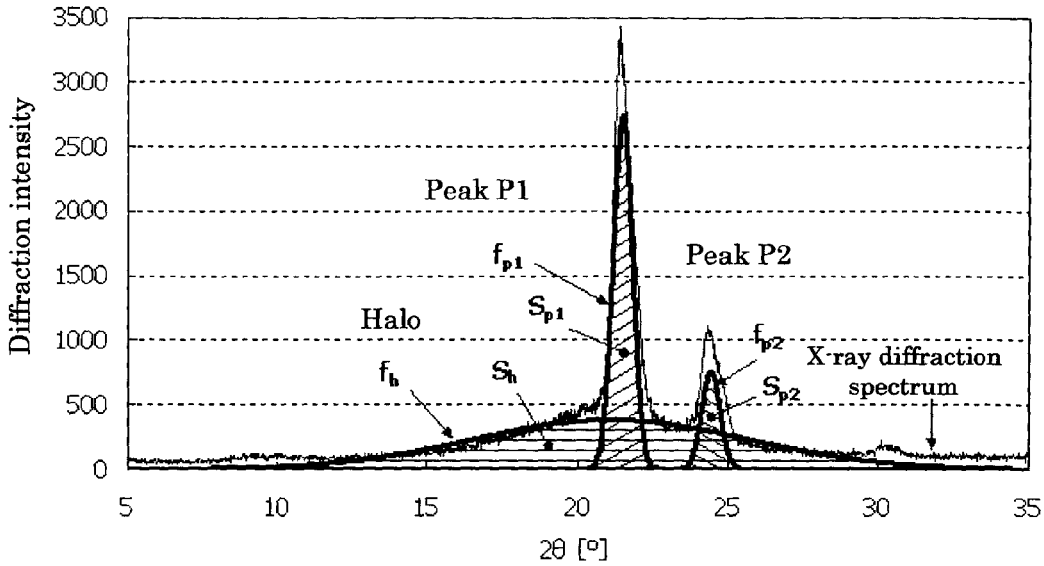
FIG. 1A is a diagram illustrating one example of diffraction spectra obtained by an X-ray diffraction measurement.

The toner contains at least a binder resin; and, if necessary, further contains other ingredients.

The crystalline resin contains a crystalline resin having a urethane bond, a urea bond or both thereof.

The crystalline resin has an average crystallite diameter of 20 nm to 70 nm.

In the case where a toner containing a crystalline resin is used in an image forming apparatus or image forming method, although it is excellent in low temperature fixability, the following problem will more likely occur compared to the case where a toner containing a non-crystalline resin as a major component of a binder resin is used. That is, when printing on paper having a wider width in a direction orthogonal to a conveyance direction of a sheet-shaped medium (e.g., A3 size paper) after continuously printing on sheets of paper having a narrower width (e.g., A4 size paper), there will occur problems such as toner offset on parts of a surface of a fixing member corresponding to ends of the paper having a wider width (end-offset) and gloss unevenness at ends of the paper having a wider width, resulting from a difference of their paper-feeding sizes.

The above problem is believed to occur resulting from the following reason.

Crystalline resins have a higher heat capacity than non-crystalline resins. Therefore, a difference in temperatures between a paper feeding portion and a non-paper feeding portion of a fixing member (e.g., fixing roller) tends to be large. The non-paper feeding portion has a higher temperature than the paper feeding portion. Because the paper feeding portion is deprived of heat by a toner upon contacting with a toner transfer image, while the non-paper feeding portion is not deprived of heat by a toner. The non-paper feeding portion, i.e., both ends of the fixing member tends to increase in temperature when printing on A3 size paper after continuously printing on sheets of A4 size paper, resulting from a difference of widths between the A4 size paper and the A3 size paper. When the A4 size paper is fed in a longitudinal direction, a short-side width of the A4 size paper (210 mm) is shorter than that of the A3 size paper (297 mm). Thus, there will be produced about 40 mm of non-paper feeding portions at both ends.

Here, when a temperature of the fixing member is controlled based on a temperature of the paper feeding portion, a temperature on the non-paper feeding portions is greatly higher than a temperature suitable for fixing, which causes the above problems.

In extreme cases, paper is wound around the fixing member on the non-paper feeding portion due to offset, leading to paper jam (jam).

The above problem is likely to occur especially in an induction heating type fixing. Because the induction heating type fixing has an advantage of being capable of increasing a temperature on a surface of a fixing member to a high temperature range in a shorter time than that of a heat-roller type fixing. However, when a heat generator having a lower heat capacity is used in the fixing member in order to take advantage of this, a temperature on a surface of the fixing member tends to be overshot (overheated).

Also, when a toner containing a crystalline resin is used in the above situation, the toner tends to be in a hot-offset state on the surface of the fixing member. This phenomenon is likely to occur when a large amount of the crystalline resin is contained in the toner.

The present inventors conducted extensive studies to solve the above problems.

In a toner containing a crystalline resin, other materials of the toner (e.g., a pigment or a releasing agent) are difficult to enter crystallite formed by the crystalline resin, necessarily leading to an uneven distribution of the materials in the toner. Additionally, a crystalline resin has a higher heat capacity and a melting point at which viscosity thereof changes more sharply than an amorphous resin. Therefore, when there are both of crystalline sites and amorphous sites in the toner, the crystalline sites and amorphous sites differentially respond to temperature upon heating. At a temperature equal to or lower than the melting point of the crystalline resin, polymers in the amorphous sites begin to loosen, but the crystalline sites remain in a solid state. Meanwhile, at a temperature equal to or higher than the melting point of the crystalline resin, the crystalline sites are more extremely decreased in viscosity than the amorphous sites. The above problems, i.e., end-offset and gloss unevenness is believed to likely to occur because of the difference in behaviors of the amorphous sites and the crystalline sites as well as the uneven distribution of materials in the toner. In addition, the problems are believed to be especially significant in the case where the induction heating type fixing is used which tends to cause a temperature difference on a surface of a fixing member.

Thus, the present inventors conceived that the above problems can be solved by creating a state in which the crystalline sites and the amorphous sites are relatively evenly distributed in the toner without extremely unevenly distributing. That is, the above problems can be solved by decreasing the size of crystallites formed by the crystalline resin and thus creating a state in which the amorphous sites are present between crystallites. However, in the case where the crystalline sites and the amorphous sites are present in distinct resins, they may be separated from each other upon heating even though they are evenly distributed during storing at room temperature. Therefore, a system is believed to be preferable in which the crystalline sites and the amorphous sites exist together in one molecular chain in a resin.

The present inventors have been found that the end-offset and gloss unevenness can be prevented with a toner containing a crystalline resin in which the crystalline resin contains a crystalline resin having a urethane bond, a urea bond or both thereof, and in which the crystalline resin has an average crystallite diameter of 20 nm to 70 nm. Thus, the present invention has been completed.

<Binder Resin>

The binder resin contains at least a crystalline resin; and, if necessary, further contains other ingredients such as a non-crystalline resin.

—Crystalline Resin—

The crystalline resin contains at least a crystalline resin having a urethane bond, a urea bond or both thereof, and, if necessary, further contains other ingredients.

The crystalline resin in the present invention refers to a resin having a crystalline structure site and has a diffraction peak derived from the crystalline structure in a diffraction spectrum obtained by means of an X-ray diffractometer. The crystalline resin has a ratio of a softening temperature of the resin as measured by an elevated flow tester to the maximum peak temperature of the heat of fusion of the resin as measured by a differential scanning calorimeter (DSC) (softening temperature/maximum peak temperature of the heat of fusion) of 0.8 to 1.6, and is sharply softened by heat.

The non-crystalline resin in the present invention refers to a resin having no crystalline structure and has no diffraction peak derived from the crystalline structure in a diffraction spectrum obtained by means of an X-ray diffractometer. The non-crystalline resin has the ratio of the softening temperature to the maximum peak temperature of the heat of fusion (softening point/maximum peak temperature of the heat of fusion) of greater than 1.6, and is gradually softened by heat.

The softening temperature of the resin can be measured by means of an elevated flow tester (e.g., CFT-500 D, product of Shimadzu Corporation). As a sample, 1 g of the resin is used.

While the sample is heated at the heating rate of 3° C./min, a load of 2.94 MPa is applied by a plunger to extrude the sample from a nozzle having a diameter of 0.5 mm and length of 1 mm, during which an amount of descent of the plunger of the flow tester is plotted versus the temperature. The temperature at which half of the sample was flown out is determined as a softening temperature of the sample.

The maximum peak temperature of the heat of fusion of the resin can be measured by means of a differential scanning calorimeter (DSC) (e.g., Q2000, product of TA Instruments Japan Inc.). A sample to be measured for the maximum peak temperature of the heat of fusion is subjected to the following pretreatment. Specifically, the sample is melted at 130° C., followed by cooling from 130° C. to 70° C. at the rate of 1.0° C./min. Next, the sample was cooled from 70° C. to 10° C. at the rate of 0.5° C./min. Then, the sample is measured for an endothermic-exothermic change by DSC during heating at the heating rate of 10° C./min. Based on this measurement, "endothermic or exothermic amount" is plotted versus "temperature" in a graph. In the graph, an endothermic peak temperature in a temperature range from 20° C. to 100° C. is determined as "Ta*". In the case where there are some endothermic peaks within the aforementioned temperature range, the temperature of the peak at which the endothermic amount is the largest is determined as Ta*. Thereafter, the sample is stored for 6 hours at the temperature that is (Ta*−10° C., followed by storing for 6 hours at the temperature that is (Ta*−15° C. Next, the sample is measured for the endothermic-exothermic change by means of DSC during cooling to 0° C. at the cooling rate of 10° C./min and then heating at the heating rate of 10° C./min to thereby draw a graph in the same manner as the above. In the graph, the temperature corresponding to the maximum peak of the endothermic amount is determined as the maximum peak temperature of the heat of fusion.

—Crystalline Resin Having Urethane Bond, Urea Bond or Both Thereof—

The crystalline resin having a urethane bond, a urea bond or both thereof is not particularly limited and may be appropriately selected depending on the intended purpose. Examples thereof include a crystalline resin having a urethane bond, a urea bond or both thereof and a crystalline polyester unit, a crystalline polyurethane resin, and a crystalline polyurea resin. Among them, preferred is a crystalline resin having a urethane bond, a urea bond or both thereof and a crystalline polyester unit.

A method for obtaining the crystalline resin having a urethane bond, a urea bond or both thereof and a crystalline polyester unit is not particularly limited and may be appropriately selected depending on the intended purpose. Examples thereof include a prepolymer method and a one-shot method. The prepolymer method is a method in which a previously prepared prepolymer consisting of polyurethane units or polyurea units is combined with a separately prepared crystalline polyester unit having a terminal hydroxyl group. The one-shot method is a method a crystalline polyester unit having a terminal hydroxyl group is mixed and reacted with a low-molecular weight isocyanate and a low-molecular weight polyol or polyamine. Among them, the prepolymer method is preferred. In the one-shot method, the polyurethane units or polyurea units are usually unevenly formed, so that a large unit cannot be formed, which is likely to cause a crystalline inhibition of the crystalline polyester unit. However, the urethane bond, the urea bond or both thereof can be satisfactory formed by appropriately selecting a reaction temperature and a type of monomer. For example, the crystalline resin having a urethane bond, a urea bond or both thereof and a crystalline polyester unit, which has a large polyurea unit at a certain level, can be obtained even with the one-shot method by using a polyamine which reacts with isocyanate more rapidly than the crystalline polyester unit having a terminal hydroxyl group. Because polyurethane units are preferentially formed in an early stage of the reaction process and then binding reactions between the crystalline polyester units and the polyurea units are allowed to proceed.

Also, in the prepolymer method, a polyurethane-urea unit in which a polyurethane unit coexists with a polyurea unit can be used as a prepolymer.

—Crystalline Polyester Unit—

The crystalline polyester unit is not particularly limited and may be appropriately selected depending on the intended purpose. Examples thereof include a polycondensate polyester unit synthesized from polyol and polycarboxylic acid, a lactone ring-opening polymerization product, and polyhydroxycarboxylic acid. Among them, a polycondensate polyester unit synthesized from dilyol and polycarboxylic acid is preferable in view of exhibition of crystallinity.

—Polyol—

Examples of the polyol include, for example, diol, trihydric to octahydric or higher polyol.

The diol is not particularly limited and may be appropriately selected depending on the intended purpose. Examples thereof include aliphatic diol such as linear-chain aliphatic diol and branched-chain aliphatic diol; C4-C36 alkylene ether glycol; C4-C36 alicyclic diol; alkylene oxide (hereinafter may be abbreviated as "AO") of the above-listed alicyclic diol; AO adducts of bisphenols; polylactonediol; polybutadienediol; and diol having a functional group, such as diol having a carboxyl group, diol having a sulfonic acid group or sulfamine group, salts thereof, and diols having other functional groups. Among them, C2-C36 aliphatic diol is preferable, and C2-C36 linear-chain aliphatic diol is more preferable. These may be used alone, or in combination.

An amount of the linear-chain aliphatic diol is not particularly limited and may be appropriately selected depending on the intended purpose, but is preferably 80 mol % or greater, more preferably 90 mol % or greater relative to the total amount of diols. Use of the linear-chain aliphatic diol in an amount of 80 mol % or greater is preferable because crystallinity of the resin is enhanced, both low temperature fixability and heat-resistant storageability are desirably provided to the resulting resin, and the hardness of the resin tends to be increased.

The linear-chain aliphatic diol is not particularly limited and may be appropriately selected depending on the intended purpose. Examples thereof include ethylene glycol, 1,3-propanediol, 1,4-butanediol, 1,5-pentanediol, 1,6-hexanediol, 1,7-heptanediol, 1,8-octanediol, 1,9-nanonediol, 1,10-decanediol, 1,11-undecanediol, 1,12-dodecanediol, 1,13-tridecanediol, 1,14-tetradecanediol, 1,18-octadecanediol, and 1,20-eicosanediol. Among them, ethylene glycol, 1,3-propanediol, 1,4-butanediol, 1,6-hexanediol, 1,9-nanonediol, and 1,10-decanediol are preferable, because they are readily available. Among them, C2-C36 linear-chain aliphatic diol is preferable.

The branched-chain aliphatic diol is not particularly limited and may be appropriately selected depending on the intended purpose, but is preferably C2-C36 branched-chain aliphatic diol. Examples thereof include 1,2-propylene glycol, neopentyl glycol, and 2,2-diethyl-1,3-propanediol.

The C4-C36 alkylene ether glycol is not particularly limited and may be appropriately selected depending on the intended purpose Examples thereof include diethylene glycol, triethylene glycol, dipropylene glycol, polyethylene glycol, polypropylene glycol, and polytetramethylene ether glycol.

The C4-C36 alicyclic diol is not particularly limited and may be appropriately selected depending on the intended purpose. Examples thereof include 1,4-cyclohexanedimethanol, and hydrogenated bisphenol A.

The alkylene oxide of the above-listed alicyclic diol is not particularly limited and may be appropriately selected depending on the intended purpose. Examples thereof include adducts of, for example, ethylene oxide (hereinafter may be abbreviated as "EO"), propylene oxide (hereinafter may be abbreviated as "PO"), and butylene oxide (hereinafter may be abbreviated as "BO"). The number of moles added may be 1 to 30.

The AO adducts of bisphenols are not particularly limited and may be appropriately selected depending on the intended purpose. Examples thereof include AO (e.g., EO, PO, and BO) adducts of bisphenol A, bisphenol F, and bisphenol S. The number of moles added may be 2 to 30.

The polylactone diol is not particularly limited and may be appropriately selected depending on the intended purpose. Example thereof includes poly-ϵ-caprolactone diol.

The diol having a carboxyl group is not particularly limited and may be appropriately selected depending on the intended purpose. Example thereof includes dialkylol alkanoic acid. The number of carbon atoms of the dialkylol alkanoic acid may be 6 to 24. Examples of the C6-C24 dialkylol alkanoic acid include 2,2-dimethylol propionic acid (DMPA), 2,2-dimethylol butanoic acid, 2,2-dimethylol heptanoic acid, and 2,2-dimethylol octanoic acid.

The diol having a sulfonic acid group or sulfamic acid group is not particularly limited and may be appropriately selected depending on the intended purpose. Examples thereof include sulfamic acid diol, AO adducts of N,N-bis(2-hydroxyalkyl)sulfamic acid (where the alkyl group is C1-C6 group) (where AO is, for example, EO or PO, and the number of moles of AO added is 1 to 6), and bis(2-hydroxyethyl) phosphate.

Examples of the sulfamic acid diol include N,N-bis(2-hydroxyethyl)sulfamic acid, and N,N-bis(2-hydroxyethyl) sulfamic acid PO 2 mol adduct The neutralized salt group contained in the diol having a neutralized salt group is not particularly limited and may be appropriately selected depending on the intended purpose. Examples thereof include C3-C30 tertiary amine (e.g., triethyl amine), and alkali metal (e.g., sodium salt).

Among them, C2-C12 aliphatic diol, diol having a carboxyl group, AO adduct of bisphenols, and any combination thereof are preferable.

Moreover, the trihydric to octahydric or higher polyol, which is optionally used, is not particularly limited and may be appropriately selected depending on the intended purpose. Examples thereof include C3-C36 trihydric to octahydric or higher polyhydric aliphatic alcohol, AO adduct (number of moles added: 2 to 30) of trisphenols, AO adduct (number of moles added: 2 to 30) of a novolak resin, and acryl polyol such as a copolymer of hydroxyethyl(meth)acrylate and other vinyl-based monomer.

Examples of the C3-C36 trihydric to octahydric or higher polyhydric aliphatic alcohol include glycerin, trimethylol ethane, trimethylol propane, pentaerythritol, sorbitol, sorbitan, and polyglycerin.

Among them, the trihydric to octahydric or higher aliphatic polyhydric alcohol, and AO adduct of the novolak resin are preferable, and AO adduct of the novolak resin is more preferable.

—Polycarboxylic Acid—

As for the polycarboxylic acid, for example, dicarboxylic acid, and trivalent to hexavalent, or higher polycarboxylic acid are included.

The dicarboxylic acid is not particularly limited and may be appropriately selected depending on the intended purpose. Examples thereof include aliphatic dicarboxylic acid and aromatic dicarboxylic acid. Examples of the aliphatic dicarboxylic acid include a linear-chain aliphatic dicarboxylic acid, and branched-chain dicarboxylic acid. Among them, the linear-chain aliphatic dicarboxylic acid is preferable.

The aliphatic dicarboxylic acid is not particularly limited and may be appropriately selected depending on the intended purpose. Examples thereof preferably include alkane dicarboxylic acid, alkenyl dicarboxylic acid, alkene dicarboxylic acid, and alicyclic dicarboxylic acid.

Example of the alkane dicarboxylic acid includes C4-C36 alkane dicarboxylic acid. Example of the C4-C36 alkane dicarboxylic acid include succinic acid, adipic acid, sebacic acid, azelaic acid, dodecane dicarboxylic acid, octadecane dicarboxylic acid, and decyl succinic acid.

Example of the alkenyl dicarboxylic acid includes dodecenyl succinic acid, pentadecenyl succinic acid, octadecenyl succinic acid.

Examples of the alkene dicarboxylic acid include C4-C36 alkene dicarboxylic acid. Examples of the C4-C36 alkene dicarboxylic acid include maleic acid, fumaric acid, and citraconic acid.

Examples of the alicyclic dicarboxylic acid include C6-C40 alicyclic dicarboxylic acid. Example of the C6-C40 alicyclic dicarboxylic acid includes dimer acid (e.g., dimeric lenoleic acid).

The aromatic dicarboxylic acid is not particularly limited and may be appropriately selected depending on the intended purpose. Examples thereof preferably include C8-C36 aromatic dicarboxylic acid. Examples of the C8-C36 aromatic dicarboxylic acid include phthalic acid, isophthalic acid, terephthalic acid, t-butyl isophthalic acid, 2,6-naphthalene dicarboxylic acid, and 4,4'-biphenyl dicarboxylic acid.

Examples of the trivalent to hexavalent or higher polycarboxylic acid, which is optionally used, include C9-C20 aromatic polycarboxylic acid. Examples of the C9-C20 aromatic polycarboxylic acid include trimellitic acid, and pyromellitic acid.

Note that, acid anhydrides or C1-C4 alkyl ester of the above-listed acids may be used as the dicarboxylic acid or trivalent to hexavalent or higher polycarboxylic acid. Examples of the C1-C4 alkyl ester include methyl ester, ethyl ester, and isopropyl ester.

Among the above-listed dicarboxylic acids, a use of the aliphatic dicarboxylic acid alone is preferable. A use of adipic acid, sebacic acid, dodecane dicarboxylic acid, terephthalic acid, or isophthalic acid alone is more preferable. A copolymer of the aliphatic dicarboxylic acid and the aromatic dicarboxylic acid is also preferably used. The aromatic dicarboxylic acid to be copolymerized is preferably terephthalic acid, isophthalic acid, t-butyl isophthalic acid or alkyl ester of these aromatic dicarboxylic acids. Examples of the alkyl ester include methyl ester, ethyl ester, or isopropyl ester. The amount of the aromatic dicarboxylic acid in a copolymer is preferably 20 mol % or less.

—Lactone Ring-Opening Polymerization Product—

The lactone ring-opening polymerization product is not particularly limited and may be appropriately selected depending on the intended purpose. Examples thereof include a lactone ring-opening polymerization product obtained by subjecting lactones (e.g., C3-C12 monolactone (having one ester group in a ring) such as β-propiolactone, γ-butyrolactone, δ-valerolactone, and ε-caprolactone) to ring-opening polymerization using a catalyst (e.g., metal oxide, and an organic metal compound); and a lactone ring-opening polymerization product containing a terminal hydroxy group obtained by subjecting the C3-C12 monolactones to ring-opening polymerization using glycol (e.g., ethylene glycol, and diethylene glycol) as an initiator.

The C3-C12 monolactone is not particularly limited and may be appropriately selected depending on the intended purpose, but it is preferably ε-caprolactone in view of crystallinity.

The lactone ring-opening polymerization product may be commercially available products. Examples thereof include highly crystalline polycaprolactone such as H1P, H4, H5, and H7 of PLACCEL series (product of Daicel Corporation).

—Polyhydroxycarboxylic Acid—

The preparation method of the polyhydroxycarboxylic acid is not particularly limited and may be appropriately selected depending on the intended purpose. Examples thereof include a method in which hydroxycarboxylic acid such as glycolic acid, and lactic acid (e.g., L-lactic acid, D-lactic acid, and racemic lactic acid) is directly subjected to a dehydration-condensation reaction; and a method in which C4-C12 cyclic ester (the number of ester groups in the ring is 2 to 3), which is equivalent to a dehydration-condensation product between 2 or 3 molecules of hydroxycarboxylic acid, such as glycolide or lactide (e.g., L-lactide, D-lactide, and racemic lactide) is subjected to a ring-opening polymerization using a catalyst such as metal oxide and an organic metal compound. The method using ring-opening polymerization is preferable because of easiness in adjusting a molecular weight of the resultant.

Among the cyclic esters listed above, L-lactide and D-lactide are preferable in view of crystallinity. Moreover, terminals of the polyhydroxycarboxylic acid may be modified to have a hydroxyl group or carboxyl group.

—Polyurethane Unit—

As for the polyurethane unit, a polyurethane unit synthesized from polyol (e.g., diol, trihydric to octahydric or higher polyol) and polyisocyanate (e.g., diisocyanate, and trivalent or higher polyisocyanate) is included. Among them, the polyurethane unit synthesized from the diol and the diisocyanate is preferable.

As for the polyol, those mentioned as the polyol listed in the description of the polyester unit can be used.

—Polyisocyanate—

As for the polyisocyanate, for example, diisocyanate, and trivalent or higher polyisocyanate are included.

The polyisocyanate is not particularly limited and may be appropriately selected depending on the intended purpose. Examples thereof include aromatic diisocyanates, aliphatic diisocyanates, alicyclic diisocyanates, and aromatic aliphatic diisocyanates. Among them, preferred are C6-C20 aromatic diisocyanate (the number of the carbon atoms excludes those contained in NCO groups, which is the same as follows), C2-C18 aliphatic diisocyanate, C4-C15 alicyclic diisocyanate, C8-C15 aromatic aliphatic diisocyanate, and modified products of the above diisocyanates, and a mixture of two or more of the above diisocyanates.

The aromatic diisocyanates are not particularly limited and may be appropriately selected depending on the intended purpose. Examples thereof include 1,3-phenylene diisocyanate, 1,4-phenylene diisocyanate, 2,4-tolylenediisocyanate (TDI), 2,6-tolylenediisocyanate (TDI), crude TDI, 2,4'-diphenyl methane diisocyanate (MDI), 4,4'-diphenyl methane diisocyanate (MDI), crude MDI, 1,5-naphthylene diisocyanate, 4,4',4"-triphenylmethane triisocyanate, and m-p-isocyanatophenylsulfonyl isocyanate, and p-isocyanatophenylsulfonyl isocyanate.

Examples of the crude MDI include a phosgenite product of crude diaminophenyl methane and polyallylpolyisocyanate (PAPI). Examples of the crude diaminophenyl methane include a condensate between formaldehyde and aromatic amine (aniline) or a mixture thereof, or a mixture of diaminodiphenyl methane and a small amount (e.g., 5% by mass to 20% by mass) of trivalent or higher polyamine.

Examples of the aliphatic diisocyanates include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, and 2-isocyanatoethyl-2,6-diisocyanatohexanoate.

Examples of the alicyclic diisocyanates include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-2,6-norbornanediisocyanate, and 2,6-norbornanediisocyanate.

Examples of the aromatic aliphatic diisocyanate include m-xylene diisocyanate (XDI), p-xylene diisocyanate (XDI), and α,α,α',α'-tetramethylxylene diisocyanate (TMXDI).

Moreover, examples of the modified product of the diisocyanate include modified products containing a urethane group, carbodiimide group, allophanate group, urea group, biuret group, uretdione group, uretimine group, isocyanurate group, or oxazolidone group. Specific examples thereof include modified products of diisocyanate such as modified MDI and urethane-modified TDI, and a mixture of two or more of these modified products. Examples of the modified MDI include urethane-modified MDI, carbodiimide-modified MDI, and trihydrocarbylphosphate-modified MDI. Example of the mixture includes a mixture of the modified MDI and the urethane-modified TDI (isocyanate-containing prepolymer).

Among them, preferred are C6-C15 aromatic diisocyanate (the number of the carbon atoms excludes those contained in NCO groups, which is the same as follows), C4-C12 aliphatic diisocyanate, C4-C15 alicyclic diisocyanate. More preferred are 2,4-tolylenediisocyanate, 2,6-tolylenediisocyanate, 2,4'-diphenylmethanediisocyanate, 4,4'-diphenylmethanediisocyanate, hexamethylenediisocyanate, dicyclohexylmethan-4,4'-diisocyanate, and isophorone diisocyanate.

—Polyurea Unit—

As for the polyurea unit, a polyurea unit synthesized from polyamine diamine, and trivalent or higher polyamine) and polyisocyanate diisocyanate, and trivalent or higher polyisocyanate) is included.

—Polyamine—

The polyamine is not particularly limited and may be appropriately selected depending on the intended purpose. Examples thereof include aliphatic diamines, and aromatic diamines. Among them, C2-C18 aliphatic diamines, and C6-C20 aromatic diamines are preferable. With this, trivalent or higher amines may be used, if necessary.

Examples of the C2-C18 aliphatic diamines include C2-C6 alkylene diamine, C1-C4 alkyl or C2-C4 hydroxyalkyl substitution products of the alkylene diamine, alicycle- or heterocycle-containing aliphatic diamine, and C8-C15 aromatic ring-containing aliphatic amines.

Examples of the C2-C6 alkylene diamine include ethylene diamine, propylene diamine, trimethylene diamine, tetramethylene diamine, and hexamethylene diamine Examples of the C1-C4 alkyl or C2-C4 hydroxyalkyl substitution products of the alkylene diamine include dialkylaminopropylamine, trimethylhexamethylene diamine, aminoethylethanolamine, 2,5-dimethyl-2,5-hexamethylene diamine, and methyl iminobispropyl amine.

Examples of the alicycle- or heterocycle-containing aliphatic diamine include C4-C15 alicyclic diamine or C4-C15 heterocyclic diamine. Example of the C4-C15 alicyclic diamine include 1,3-diaminocyclohexane, isophorone diamine, menthane diamine, and 4,4'-methylene dichlorohexane diamine (hydrogenated methylene dianiline). Examples of the C4-C15 heterocyclic diamine include piperazine, N-aminoethyl piperazine, 1,4-diaminoethyl piperazine, 1,4-bis(2-amino-2-methylpropyl)piperazine, 3,9-bis(3-aminopropyl)-2,4,8,10-tetraoxaspiro[5,5]undecane Examples of the C8-C15 aromatic ring-containing aliphatic amines include xylylene diamine, and tetrachlor-p-xylylene diamine.

Examples of the C6-C20 aromatic diamines include unsubstituted aromatic diamine, aromatic diamine containing a C1-C4 nuclear substituted alkyl group, mixtures of isomers of the unsubstituted aromatic diamine and/or aromatic diamine containing a C1-C4 nuclear substituted alkyl group at various mixing ratios, aromatic diamine containing a nuclear substituted electron-withdrawing group, and aromatic diamine containing a secondary amino group.

Examples of the unsubstituted aromatic diamine include 1,2-phenylenediamine, 1,3-phenylenediamine, 1,4-phenylenediamine, 2,4'-diphenyl methanediamine, 4,4'-diphenyl methanediamine, crude diphenyl methanediamine (e.g., polyphenyl polymethylene polyamine), diaminodiphenyl sulfone, benzidine, thiodianiline, bis(3,4-diaminophenyl)sulfone, 2,6-diaminopyridine, m-aminobenzylamine, triphenylmethane-4,4',4"-triamine, and naphthylene diamine.

Examples of the aromatic diamine containing a C1-C4 nuclear substituted alkyl group include 2,4-tolylenediamine, 2,6-tolylenediamine, crude tolylenediamine, diethyltolylenediamine, 4,4'-diamino-3,3'-dimethyldiphenyl methane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenyl methane, 3,5-diethyl-3'-methyl-2',4-diaminodiphenyl methane, 3,3'-diethyl-2,2'-diaminodiphenyl methane, 4,4'-diamino-3,3'-dimethyldiphenyl methane, 3,3',5,5'-tetraethyl-4,4'-diaminobenzophenone, 3,3',5,5'-tetraethyl-4,4'-diaminodiphenyl ether, and 3,3',5,5'-tetraisopropyl-4,4'-diaminodiphenylsulfone.

Examples of a nuclear substituted electron-withdrawing group in the aromatic diamine containing a nuclear substituted electron-withdrawing group include halogen, an alkoxy group, and a nitro group. Examples of the halogen include Cl, Br, I, and F. Examples of the alkoxy group include a methoxy group and ethoxy group. Examples of the aromatic diamine containing a nuclear substituted electron-withdrawing group include methylenebis-o-chloroaniline, 4-chloro-o-phenylenediamine, 2-chlor-1,4-phenylenediamine, 3-amino-4-chloroaniline, 4-bromo-1,3-phenylenediamine, 2,5-dichlor-1,4-phenylenediamine, 5-nitro-1,3-phenylenediamine, 3-dimethoxy-4-aminoaniline; 4,4'-diamino-3,3'-dimethyl-5,5'-dibromo-diphenyl methane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylene bis(2-iodoaniline), 4,4'-methylenebis(2-bromoaniline), 4,4'-methylenebis(2-fluoroaniline), and 4-aminophenyl-2-chloroaniline.

Examples of the aromatic diamine containing a secondary amino group include those in which some of all of primary amino groups of the unsubstituted aromatic diamine, aromatic diamine containing a C1-C4 nuclear substituted alkyl group, mixture of isomers thereof at various mixing ratios, and aromatic diamine containing a nuclear substituted electron-withdrawing group are substituted with secondary amino group using lower alkyl groups such as a methyl group or ethyl group.

Examples of the trihydric or higher amine include polyamide polyamine or polyether polyamine.

Examples of the polyamide polyamine include a low molecular weight polyamide polyamine obtained by condensation of dicarboxylic acid and excess (2 moles or more per mole of acid) of the polyamine. Example of the dicarboxylic acid includes dimer acid. Examples of the polyamine include alkylene diamine and poly alkylene polyamine.

Example of the polyether polyamine includes a hydride of cyanoethylated product of polyetherpolyol.

Example of the polyetherpolyol includes polyalkylene glycol.

According to Solubility Parameter Values (Polymer handbook 4th Ed), a urea bond has a cohesive energy of 50,230 [J/mol], which is about twice as large as a cohesive energy of a urethane bond (26,370 [J/mol]). Thus, an effect of improving toughness or resistance to offset of a toner upon fixing may be expected even in a small amount.

The crystalline resin having a urethane bond, a urea bond or both thereof and a crystalline polyester unit preferably contains a crystalline resin having a polyurethane unit, a polyurea unit or both thereof and a crystalline polyester unit, and more preferably contains a crystalline resin having a polyurethane unit and a crystalline polyester unit.

The weight average molecular weight of the crystalline resin having a urethane bond, a urea bond or both thereof is not particularly limited and may be appropriately selected depending on the intended purpose, but is preferably 5,000 to 50,000. When the weight average molecular weight is less than 5,000, the resultant toner easily flows at low temperature, which may deteriorate heat resistance. Also, the toner is decreased in viscosity upon melting, which may deteriorate hot-offset property.

The melting point of the crystalline resin having a urethane bond, a urea bond or both thereof is not particularly limited and may be appropriately selected depending on the intended purpose, but is preferably 50° C. to 70° C. When the melting point is less than 50° C., the resultant toner easily melts at low temperature, which may deteriorate heat resistant storageability. When the melting point is more than 70° C., the resultant toner may not sufficiently decrease in viscoelasticity by heating upon fixing, which may deteriorate low-temperature fixability.

The crystalline resin having a urethane bond, a urea bond or both thereof preferably contains a first crystalline resin and a second crystalline resin having a weight average molecular weight higher than that of the first crystalline resin. In this case, the crystalline resin having a urethane bond, a urea bond or both thereof is preferably a crystalline resin having a polyurethane unit, a polyurea unit or both thereof and a crystalline polyester unit.

The weight average molecular weight of the first crystalline resin is preferably 10,000 to 40,000, more preferably 15,000 to 35,000, particularly preferably 20,000 to 30,000 from the viewpoint of achieving both of low-temperature fixability and heat resistant storageability. When the weight average molecular weight is less than 10,000, the resultant toner may be deteriorated in heat resistant storageability. When the weight average molecular weight is more than 40,000, the resultant toner may be deteriorated in low-temperature fixability.

The weight average molecular weight of the second crystalline resin is preferably 40,000 to 300,000, more preferably 50,000 to 150,000 from the viewpoint of achieving both of low-temperature fixability and hot-offset resistance. When the weight average molecular weight is less than 40,000, the resultant toner may be deteriorated in hot-offset resistance. When the weight average molecular weight is more than 300,000, the resultant toner may not sufficiently melt especially upon fixing at low temperature and image may be easily exfoliated, which may deteriorate low-temperature fixability.

A difference between the weight average molecular weight of the first crystalline resin (Mw1) and the weight average molecular weight of the second crystalline resin (Mw2) (Mw2−Mw1) is not particularly limited and may be appropriately selected depending on the intended purpose, but is preferably 5,000 or more, more preferably 10,000 or more. When the difference is less than 5,000, the resultant toner may be decreased in fixing width.

A mass ratio of the first crystalline resin (1) and the second crystalline resin (2) is not particularly limited and may be appropriately selected depending on the intended purpose, but is preferably (1)/(2)=5/95 to 60/40, more preferably 8/92 to 50/50, further preferably 12/88 to 35/65, particularly preferably 15/85 to 25/75. When the ratio of (1) is more than the above range, the resultant toner may be deteriorated in hot-offset resistance. When the ratio of (2) is more than the above range, the resultant toner may be deteriorated in low-temperature fixability.

It is preferable that the toner is a toner obtained by elongating a crystalline polyester resin having an isocyanate group in an aqueous medium; and the crystalline resin having a urethane bond, a urea bond or both thereof and a crystalline polyester unit preferably contains a resin obtained by elongating the crystalline polyester resin having an isocyanate group. Example of a method for elongating includes a method in which a compound having a functional group reactive with an isocyanate group is reacted with an isocyanate group in a crystalline polyester resin having a terminal isocyanate group. Examples of the compound having a functional group reactive with an isocyanate group include water and the above-described polyamines. The elongation is performed in an aqueous medium used for producing a toner.

When the crystalline resin having a urethane bond, a urea bond or both thereof contains a first crystalline resin and a second crystalline resin having a weight average molecular weight higher than that of the first crystalline resin, the second crystalline resin is preferably a resin obtained by elongating the crystalline polyester resin having an isocyanate group.

An amount of the crystalline resin contained in the binder resin is not particularly limited and may be appropriately selected depending on the intended purpose, but is preferably 50% by mass or more, more preferably 65% by mass or more, further preferably 80% by mass or more, particularly preferably 95% by mass or more from the viewpoint of exerting excellent low-temperature fixability and heat resistant storageability to the maximum. When the amount is less than 50% by mass, the binder resin does not sharply change viscoelasticity of the toner by heat, potentially leading to difficulty of achieving both of low-temperature fixability and heat resistant storageability.

<Non-Crystalline Resin>

The non-crystalline resin is not particularly limited and may be appropriately selected depending on the intended purpose as long as it is non-crystalline. Examples thereof include homopolymer of styrene or substitution thereof (e.g., polystyrene and polyvinyl toluene), styrene copolymer (e.g., styrene-methyl acrylate copolymer, styrene-methacrylic acid copolymer, styrene-methyl methacrylate copolymer, styrene-butyl methacrylate copolymer, styrene-acrylonitrile copolymer, styrene-vinyl methyl ether copolymer, styrene-vinyl methyl ketone copolymer, styrene-butadiene copolymer, and styrene-maleic acid ester copolymer); a polymethyl methacrylate resin, a polybutyl methacrylate resin, a polyvinyl acetate resin, a polyethylene resin, a polyester resin, a polyurethane resin, an epoxy resin, a polyvinyl butyral resin, a polyacrylic acid resin, a rosin resin, a modified rosin resin, and the above resins modified so as to contain a functional group reactive with an active hydrogen group. These may be used alone, or in combination.

An amount of the non-crystalline resin contained in the binder resin is not particularly limited and may be appropriately selected depending on the intended purpose.

<Other Ingredients>

The other ingredients are not particularly limited and may be appropriately selected depending on the intended purpose. Examples thereof include colorants, layered inorganic minerals, releasing agents, charging control agents, external additives, and nucleating agents.

—Colorant—

The colorant is not particularly limited and may be appropriately selected depending on the intended purpose. Examples thereof include black pigments, yellow pigments, magenta pigment, and cyan pigments. Among them, preferred are those containing yellow pigments, magenta pigment, or cyan pigments.

The black pigments are used in, for example, a black toner. Examples thereof include carbon black, copper oxide, manganese dioxide, aniline black, active carbon, non-magnetic ferrite, magnetite, nigrosine dyes, and black iron oxide.

The yellow pigments are used in, for example, a yellow toner. Examples thereof include C.I. pigment Yellow 74, 93, 97, 109, 128, 151, 154, 155, 166, 168, 180, and 185, NAPHTHOL YELLOW S, HANSA YELLOW (10G, 5G, G), cadmium yellow, yellow iron oxide, loess, chrome yellow, titan yellow, and polyazo yellow.

The magenta pigments are used in, for example, a magenta toner. Examples thereof include quinacridone pigments, monoazo pigments such as C.I. Pigment Red 48:2, 57:1, 58:2, 5, 31, 146, 147, 150, 176, 184, and 269. Also, the monoazo pigments may be used in combination with the quinacridone pigments.

The cyan pigments are used in, for example, a cyan toner. Examples thereof include Cu-phthalocyanine pigments, Zn-phthalocyanine pigments, and Al-phthalocyanine pigments.

An amount of the colorant contained in the toner is not particularly limited and may be appropriately selected depending on the intended purpose, but it is preferably 1 part by mass to 15 parts by mass, more preferably 3 parts by mass to 10 parts by mass relative to 100 parts by mass of the toner. When the amount thereof is smaller than 1 part by mass, the resultant toner is deteriorated in colorability. When the amount thereof is greater than 15 parts by mass, the pigment is insufficiently dispersed in the toner, potentially leading to deterioration in colorability and electric property of the toner.

The colorant may be used as a masterbatch obtained by forming a composite with a resin. The resin used for producing the masterbatch or kneaded with the masterbatch is not particularly limited and may be appropriately selected depending on the intended purpose.

The masterbatch can be prepared by mixing and kneading with high shear the colorant with the resin for the masterbatch. In the mixing and kneading, an organic solvent may be used for improving interactions between the colorant and the resin. Moreover, the masterbatch can be prepared by a flashing method in which an aqueous paste containing water and a colorant is mixed and kneaded with a resin and an organic solvent to transfer the colorant to the resin, and then the water and the organic solvent are removed. This method is preferably used because a wet cake of the colorant is used as it is without drying. A high-shearing disperser (e.g., a three-roll mill) is preferably used for mixing and kneading.

—Layered Inorganic Mineral—

The layered inorganic mineral is not particularly limited and may be appropriately selected depending on the intended purpose. Examples thereof include a smectite clay mineral (e.g., montmorillonite, saponite, and hectorite), kaolin clay mineral (e.g., kaolinite), bentonite, attapulgite, magadiite, and kanemite. These may be used alone, or in combination.

The layered inorganic mineral may be an organic-modified layered inorganic mineral in which at least part of ions present between layers are modified with organic ions.

The term "modified" means that organic ions are introduced to ions present between layers of the layered inorganic mineral. That is, it means that at least part of ions present between layers of the layered inorganic mineral is substituted with organic ions, or organic ions are further introduced between layers of the layered inorganic mineral, or both thereof. In the broad sense, it means intercalation.

The organic-modified layered inorganic mineral is not particularly limited and may be appropriately selected depending on the intended purpose. The organic-modified layered inorganic mineral in which at least part of ions present between layers of a smectite clay mineral having a smectite basic crystal structure are modified with organic cations is preferable because it can be stably dispersed in proximity to surfaces of toner particles. More preferable are those in which at least part of ions present between layered of montmorillonite are modified with organic cations, and those in which at least part of ions present between layers of bentonite are modified with organic cations. Particularly preferable is organic-modified montmorillonite such as stearalkonium bentonite and quaternium 18/benzalkonium bentonite.

As for the organic-modified layered inorganic mineral, commercially available products may be used. Examples thereof include quaternium-18 bentonite such as BENTONE 3, BENTONE 38, BENTONE 38V (these products are of Elements Specialties); TIXOGEL VP (product of United Catalyst, LLC), CLAYTONE 34, CLAYTONE 40, and CLAYTONE XL (these products are of Southern Clay Products Inc.); stearalkonium bentonite such as BENTONE 27 (product of Elements Specialties), TIXOGEL LG (product of United Catalyst, LLC), and CLAYTONE AF (product of Southern Clay Products Inc.); quaternium-18/benzalkonium bentonite such as CLAYTONE HT, CLAYTONE PS, and CLAYTONE APA (these products are of Southern Clay Products Inc.); organic modified montmorillonite such as CLAYTONE HY (product of Southern Clay Products Inc.); and organic modified smectite such as LUCENTITE SPN (product of Co-op Chemical Co., Ltd.). Among them, CLAYTONE AF, CLAYTONE APA, and CLAYTONE HY are particularly preferable.

An amount of the organic-modified layered inorganic mineral in the toner is preferably 0.1 parts by mass to 3.0 parts by mass, more preferably 0.5 parts by mass to 2.0 parts by mass, particularly preferably 1.0 part by mass to 1.5 parts by mass relative to 100 parts by mass of the toner. When the amount is less than 0.1 parts by mass, effects of the layered inorganic mineral may not be effectively exhibited. When the amount is greater than 3.0 parts by mass, low temperature fixability may be inhibited.

—Releasing Agent—

The releasing agent is not particularly limited and may be appropriately selected depending on the intended purpose. Examples thereof include carbonyl group-containing wax, polyolefin wax, and a long chain hydrocarbon. These may be used alone, or in combination. Among them, the carbonyl group-containing wax is preferable.

Examples of the carbonyl group-containing wax include polyalkanoic acid ester, polyalkanol ester, polyalkanoic acid amide, polyalkyl amide, and dialkyl ketone.

Examples of the polyalkanoic acid ester include carnauba wax, montan wax, trimethylolpropane tribehenate, pentaerythritol tetrabehenate, pentaerythritol diacetate dibehenate, glycerin tribehenate, and 1,18-octadecanediol distearate.

Examples of the polyalkanol ester include tristearyl trimellitate, and distearyl maleate.

Examples of the polyalkanoic acid amide include dibehenyl amide.

Examples of the polyalkyl amide include trimellitic acid tristearyl amide.

Examples of the dialkyl ketone include distearyl ketone.

Among the carbonyl group-containing wax mentioned above, polyalkanoic acid ester is particularly preferable.

Examples of the polyolefin wax include polyethylene wax, and polypropylene wax.

Examples of the long chain hydrocarbon include paraffin wax, and Sasol wax.

A melting point of the releasing agent is not particularly restricted and may be appropriately selected according to purpose. It is preferably 50° C. to 100° C., and more preferably 60° C. to 90° C. When the melting point is less than 50° C., heat resistant storageability may be adversely affected. When the melting point is more than 100° C., cold-offset may be likely to occur upon fixing at low-temperature.

The melting point of the releasing agent may be measured using a differential scanning calorimeter (TA-60WS and DSC-60, product of Shimadzu Corporation). At first, 5.0 mg of the releasing agent is placed in a sample container made of aluminum, and the sample container is placed on a holder unit and set in an electric furnace. Next, it is heated from 0° C. to 150° C. at a heating rate of 10° C./min in a nitrogen atmosphere, cooled from 150° C. to 0° C. at a cooling rate of 10° C./min and then heated to 150° C. at a heating rate of 10° C./min, during which a DSC curve is measured. From the obtained DSC curve, the maximum peak temperature of the heat of fusion in the second heating may be determined as the melting point using an analysis program in the DSC-60 system.

A melt viscosity of the releasing agent is preferably 5 mPa·sec to 100 mPa·sec, more preferably 5 mPa·sec to 50 mPa·sec, and particularly preferably 5 mPa·sec to 20 mPa·sec at 100° C. When the melt viscosity is less than 5 mPa·sec, releasing property may be deteriorated. When the melt viscosity is more than 100 mPa·sec, hot-offset resistance and releasing property at a low temperature may be deteriorated.

An amount of the releasing agent contained in the toner is not particularly limited and may be appropriately selected depending on the intended purpose. It is preferably 1 part by mass to 20 parts by mass, and more preferably 3 parts by mass to 10 parts by mass relative to 100 parts by mass of the toner. When the amount is less than 1 part by mass, hot-offset resistance may be deteriorated. When the amount is more than 20 parts by mass, heat resistant storageability, charging property, transferability and stress resistance may be deteriorated.

—Charge Controlling Agent—

The charge controlling agent is not particularly limited and may be appropriately selected depending on the intended purpose. Examples thereof include a nigrosine dye, a triphenyl methane dye, a chromium-containing metal complex dye, a molybdic acid chelate pigment, a rhodamine dye, alkoxy amine, a quaternary ammonium salt (including a fluorine-modified quaternary ammonium salt), alkylamide, phosphor and a compound including phosphor, tungsten and a compound including tungsten, a fluorine-containing activator, a metal salt of salicylic acid, and a metal salt of salicylic acid derivative. Specific examples thereof include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD), quaternary ammonium salt molybdenum complex TP-302 and TP-415 (these products are of Hodogaya Chemical K.K), LRA-901 and boron complex LR-147 (these products are of Japan Carlit K.K.) These may be used alone or in combination.

An amount of the charge controlling agent contained in the toner is not particularly limited and may be appropriately selected depending on the intended purpose, but is preferably 0.01 parts by mass to 5 parts by mass, more preferably 0.02 parts by mass to 2 parts by mass, relative to 100 parts by mass of the toner. When the amount is smaller than 0.01 parts by mass, satisfactory charge rising property and charge amount cannot be attained, and toner image may be deteriorated. When the amount is greater than 5 parts by mass, chargeability of the resulting toner is so high that electrostatic suction force toward the developing roller may increase, which may cause poor flowing ability of the developer, and low image density.

—External Additive—

The external additive is not particularly limited and may be appropriately selected depending on the intended purpose. Examples thereof include silica, a metal salt of fatty acid, metal oxide, hydrophobized titanium oxide, and fluoropolymer.

Examples of the metal salt of fatty acid include zinc stearate, and aluminum stearate.

Examples of the metal oxide include titanium oxide, aluminium oxide, tin oxide, and antimony oxide.

Examples of commercially available products of the silica include R972, R974, RX200, RY200, R202, R805, and R812 (these products are of Nippon Aerosil Co., Ltd.).

Examples commercially available products of the titanium oxide include P-25 (product of Nippon Aerosil Co., Ltd.); STT-30 and STT-65C-S (both products are of Titan Kogyo, Ltd.); TAF-140 (product of Fuji Titanium Industry Co., Ltd.); and MT-150W, MT-500B, MT-600B, and MT-150A (these products are of TAYCA CORPORATION).

Examples of the hydrophobized titanium oxide include T-805 (product of Nippon Aerosil Co., Ltd.); STT-30A and STT-65S-S (both products are of Titan Kogyo, Ltd.); TAF-500T and TAF-1500 T (both products are of Fuji Titanium Industry Co., Ltd.); MT-100S and MT-100T (both products are of TAYCA CORPORATION); and IT-S (product of ISHIHARA SANGYO KAISHA, LTD.).

Example of a method for hydrophobizing includes a method in which hydrophilic particles are treated with a silane coupling agent such as methyltrimethoxy silane, methyltriethoxy silane, and octyltrimethoxy silane.

An amount of the external additive contained in the toner is not particularly limited and may be appropriately selected depending on the intended purpose, but is preferably 0.1 parts by mass to 5 parts by mass, more preferably 0.3 parts by mass to 3 parts by mass, relative to 100 parts by mass of the toner.

The average particle diameter of primary particles of the external additive is not particularly limited and may be appropriately selected depending on the intended purpose, but is preferably 1 nm to 100 nm, more preferably 3 nm to 70 nm. When the average particle diameter is smaller than 1 nm, the external additive is embedded into the toner particles, and therefore the external additive may not effectively function. When the average particle diameter is greater than 100 nm, the external additive may unevenly damage a surface of a photoconductor.

—Nucleating Agent—

The nucleating agent preferably has a melting point higher than that of the crystalline resin and is incompatible with the crystalline resin, which promotes crystallization of the crystalline resin because the nucleating agent crystallizes at higher temperature than that of the crystalline resin in a toner. Thus, use of the nucleating agent has an effect of improving a degree of crystallinity of the crystalline resin during a toner producing step, which allows to improve heat resistant storageability of the toner. Additionally, the nucleating agent has an effect of promoting crystallization of post-fixed image, which can improve blocking resistance of a toner image (printed matter) and uniformly decrease a crystal core in size. Therefore, a surface of the toner image becomes flat and is improved in glossiness. When the melting point of the nucleating agent is lower than that of the crystalline resin, the nucleating agent unsatisfactory promotes crystallization of the crystalline resin, which may deteriorate heat resistant storageability of a toner and blocking resistance of a post-fixed toner image.

The nucleating agent is not particularly limited and may be appropriately selected depending on the intended purpose, as long as it promotes re-crystallization of the crystalline resin. Examples thereof include inorganic crystal nucleating agents and organic crystal nucleating agents.

Examples of the inorganic crystal nucleating agents include silica, talc, kaolin, alumina, alm, and titanium oxide.

Examples of the organic crystal nucleating agents include lower alkyl dibenzylidene sorbitol, aluminum benzoate compounds, phosphoric acid ester metal salt compounds, linear fatty acid metal salts, rosin acid partial metal salts, fatty acid amides, and fatty acid esters.

Examples of the lower alkyl dibenzylidene sorbitol include dibenzylidene sorbitol, bis(p-methylbenzylidene) sorbitol, and bis(p-ethylbenzylidene) sorbitol. Example of the linear fatty acid metal salts includes sodium montanate.

Examples of the nucleating agents include phosphoric acid ester metal salt compounds, complexes of phosphoric acid ester metal salt compounds, and nitrogen-containing compounds. Because these compounds can accelerate crystallization of the crystalline resin, especially crystalline polyester and greatly improve mechanical strength. Also, there is no need to pay attention to an easiness of decomposition at high temperature, and odor and performance deterioration due to the decomposition.

An amount of the nucleating agent is not particularly limited and may be appropriately selected depending on the intended purpose. It is preferably 0.10 parts by mass to 5.0 parts by mass, more preferably 0.30 parts by mass to 2.0 parts by mass relative to 100 parts by mass of the binder resin. When the amount is less than 0.10 parts by mass, crystallization is not sufficiently promoted, so that blocking resistance of toner image may not be improved. When the amount is more than 5.0 parts by mass, the nucleating agent increases viscoelasticity of toner because the nucleating agent usually has a melting point higher than that of the crystalline resin and the toner, and thus satisfactory low temperature fixability may not be attained.

<Average Crystallite Diameter>

An average crystallite diameter of the crystalline resin in the toner is 20 nm to 70 nm, preferably 30 nm to 60 nm. When the average crystallite diameter is less than 20 nm, sharp melting property, which is characteristic of the crystalline resin, is not sufficiently exerted, which deteriorates low temperature fixability. Also, in the case where a crystal does not grow to a sufficient size, heat from a fixing device is not used for melting the crystal and excessive heat is used for softening a whole of toner, leading to end-offset and gloss unevenness. When the average crystallite diameter is more than 70 nm, toner materials tend to be unevenly distributed in a toner, leading to end-offset and gloss unevenness.

Examples of a method for controlling the average crystallite diameter include a control of heating and cooling time at a production step, a use of a crystal nucleating agent, and a combination of materials.

The average crystallite diameter refers to an average size of crystallites in the toner. The crystallite refers to the minimum single crystal particle constituting a crystal substance.

The average crystallite diameter can be determined by measuring the toner with an X-ray diffractometer and calculating according to the following equation:

$$D=K\times\lambda/(\beta\times\cos\theta)$$

where D denotes an average crystallite diameter (Å), K denotes Scherrer constant, $\lambda$ denotes a wavelength of X-ray, $\beta$ denotes the full width at half maximum of the diffraction peaks derived from crystal structure (°), $\theta$ denotes Bragg angle ($2\theta/\theta$), and K=0.94.

Example of the X-ray diffractometer includes D8 DISCOVER with GADDS (product of Bruker AXS K.K.).

<Weight Average Molecular Weight>

The weight-average molecular weight of tetrahydrofuran (THF) soluble content of the toner is not particularly limited and may be appropriately selected depending on the intended purpose, but is preferably 20,000 to 60,000, more preferably 25,000 to 550,000, more preferably 30,000 to 50,000. When the weight-average molecular weight is less than 20,000, internal cohesive strength during toner melting decreases too much even though high-molecular weight components are present in a large amount, resulting in hot-offset and paper winding around a fixing member. When the weight-average molecular weight is more than 60,000, the binder resin as a whole has a too high molecular weight, which may deteriorate friability and glossiness, and easily cause missing of post-fixed image due to external stress.

The tetrahydrofuran (THF) soluble content of the toner can be obtained as follows. The toner (30 mg) is charged into 20 mL of tetrahydrofuran (THF) (including a stabilizer, product of Wako Pure Chemical Industries, Ltd.), followed by stirring for 1 hour and filtering through a 0.2 μm filter.

<Amount of High-Molecular Weight Component>

The tetrahydrofuran soluble content of the toner preferably contains components having a molecular weight of 100,000 or greater in a percentage of 5.0% or more, more preferably 7.0% or more, particularly preferably 10% or more based on a peak area in a molecular weight distribution measured by gel permeation chromatography. An upper limit thereof is not particularly restricted and may be appropriately selected according to purpose, but is preferably 25% or less. Moreover, the tetrahydrofuran soluble content of the toner preferably contains components having a molecular weight of 250,000 or greater in a percentage of 1.0% or more based on a peak area in a molecular weight distribution measured by gel permeation chromatography from the viewpoint of durability of the toner.

A percentage of the components having a molecular weight of 100,000 or greater may be calculated from an intersection of the molecular weight of 100,000 with an integral molecular weight distribution curve.

A percentage of the components having a molecular weight of 250,000 or greater may be calculated from an intersection of the molecular weight of 250,000 with an integral molecular weight distribution curve.

The weight average molecular weight and the molecular weight distribution can be measured using, for example, a gel permeation chromatography (GPC) measuring apparatus (e.g., HLC-8220GPC, product of Tosoh Corporation). As a column, TSK-GEL SUPER HZM-H 15 cm in triplicate (product of Tosoh Corporation) is used. A measurement sample is dissolved in tetrahydrofuran (THF) (including a stabilizer, product of Wako Pure Chemical Industries, Ltd.) to prepare a 0.15% by mass solution, followed by filtering through a 0.2 μm filter. The resultant filtrate is used for a sample. The sample solution in THF (100 μL) is injected to the measuring apparatus, and measured at a flow rate of 0.35 mL/min under an environment of 40° C.

The molecular weight of the sample is calculated using a calibration curve drawn from monodispersed polystyrene standard samples. As the monodispersed polystyrene standard samples, SHOWDEX STANDARD series (product of Showa Denko K.K.) and toluene are used. Solutions of the following 3 types of monodispersed polystyrene standard samples in THF are prepared and measured under the above conditions, and a calibration curve is drawn with a retention time of peak top as a light scattering molecular weight of the monodispersed polystyrene standard samples. A RI (refractive index) detector is used as a detector.

Solution A: S-7450 2.5 mg, S-678 2.5 mg, S-46.5 2.5 mg, S-2.90 2.5 mg, THF 50 mL Solution B: S-3730 2.5 mg, S-257 2.5 mg, S-19.8 2.5 mg, S-0.580 2.5 mg, THF 50 mL Solution C: S-1470 2.5 mg, S-112 2.5 mg, S-6.93 2.5 mg, toluene 2.5 mg, THF 50 mL <Content of N Element>

A content of N element in a CHN analysis of the THF soluble content of the toner is not particularly restricted and may be appropriately selected according to purpose. It is preferably 0.3% by mass to 2.0% by mass, more preferably 0.9% by mass to 2.0% by mass. When the content is less than 0.3% by mass, aggregation and pollution of members in an image forming apparatus due to decreased toughness of the toner or high-temperature offset due to decreased viscoelasticity of the toner in a molten state may occur. When the content of N element exceeds 2.0% by mass, the toner in a molten state has an excessively high viscoelasticity, potentially leading to deteriorations of fixability, glossiness and charging property.

The content of N element is an amount of N element derived from a urethane bond and a urea bond in a resin.

The content of N element can be determined as an average value of 2 measurement values of CHN simultaneous measurements under conditions of a combustion furnace of 950° C., a reduction furnace of 550° C., a helium flow rate of 200 mL/min and an oxygen flow rate of 25 mL/min to 30 mL/min using VARIO MICRO CUBE (product of Elementar Analytical). Notably, when the content of N element obtained by this measurement method is less than 0.5% by mass, a further measurement is conducted using a trace nitrogen analyzer ND-100 (product of Mitsubishi Chemical Corporation). An electric furnace (horizontal reactor) has temperatures in a thermal decomposition part of 800° C. and in a catalytic part of 900° C. The measurement is performed under the following conditions: main $O_2$ flow rate: 300 mL/min, $O_2$ flow rate: 300 mL/min, Ar flow rate: 400 mL/min, and sensitivity: Low. The content of N element is determined using a calibration curve drawn with pyridine standard solutions.

<Amount of Crystalline Structure [C/(A+C)]>

In a diffraction spectrum of the toner obtained by an X-ray diffraction measurement, a ratio of (C) integrated intensity of the spectrum derived from a crystalline structure in a binder resin to a sum of the (C) and (A) integrated intensity of the spectrum derived from a non-crystalline structure ([C/(A+C)]) is not particularly limited and may be appropriately selected depending on the intended purpose It is preferably 0.15 or greater, more preferably 0.15 to 0.50, particularly preferably 0.20 to 0.50. When the ratio [C/(A+C)] is less than 0.15, a crystal does not grow to a sufficient size, which may deteriorate sharp melting property which is characteristic of the crystalline resin. The ratio [C/(A+C)] of within the particularly preferable range is advantageous in obtaining both low-temperature fixability and heat resistant storageability.

The ratio [C/(A+C)] is an index indicating an amount of a crystallization site in the binder resin, that is, an area ratio of a main diffraction peak derived from the crystalline structure of the binder resin to a halo derived from the non-crystalline structure in a diffraction spectrum obtained by an X-ray diffraction measurement.

The X-ray diffraction measurement can be performed using an X-ray diffractometer equipped with a 2-dimensional detector (D8 DISCOVER with GADDS, product of Bruker Corporation).

As a capillary for the measurement, a mark tube (Lindemann glass) having a diameter of 0.70 mm is used. This capillary tube for the measurement is filled up with a sample with being tapped. The number of tapping is 100. Measurement conditions are described in detail below.

Tube current: 40 mA
Tube voltage: 40 kV
Goniometer 2θ axis: 20.0000°
Goniometer Ω axis: 0.0000°:
Goniometer ϕ axis: 0.0000°:
Detector distance: 15 cm (wide angle measurement)
Measuring range: 3.2≤2θ(°)≤37.2
Measurement time: 600 sec A collimator having a pinhole with a diameter of 1 mm is used for an incident optical system. Obtained 2-dimensional data is integrated with a supplied software (at 3.2° to 37.2° in the x-axis) and converted to a 1-dimensional data of a diffraction intensity and 2θ.

Figure 1B:
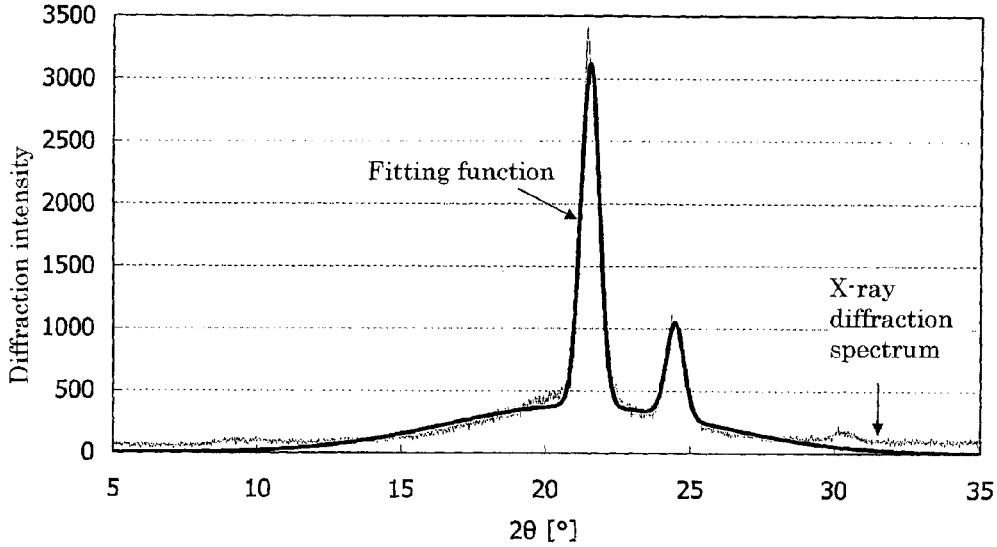
FIG. 1B is a diagram illustrating one example of diffraction spectra obtained by an X-ray diffraction measurement.

A method for calculating the ratio [C/(A+C)] based on the obtained X-ray diffraction measurement results will be explained below. An example of a diffraction spectrum obtained by an X-ray diffraction measurement is illustrated in FIG. 1A and FIG. 1B. The horizontal axis represents 2θ, the vertical axis represents the X-ray diffraction intensity, and both of them are linear axes. In the X-ray diffraction spectrum illustrated in FIG. 1A, there are main peaks at 2θ=21.3° (P1) and 24.2° (P2), halos (h) are observed in a wide range including these two peaks. Here, the main peaks are derived from a crystalline structure of a binder resin, and the halos are derived from a non-crystalline structure.

These two main peaks and halos are expressed by a Gaussian functions:

$$f_{p1}(2\theta)=a_{p1}\exp\{-(2\theta-b_{p1})^2/(2c_{p1}^2)\} \quad \text{Equation A (1)}$$

$$f_{p2}(2\theta)=a_{p2}\exp\{-(2\theta-b_{p2})^2/(2c_{p2}^2)\} \quad \text{Equation A (2)}$$

$$f_h(2\theta)=a_h\exp\{-(2\theta-b_h)^2/(2c_h^2)\} \quad \text{Equation A (3)}$$

where $f_{p1}$ (2θ), $f_{p2}$ (2θ), and $f_h$ (2θ) denote functions corresponding to the main peak P1, the main peak P2 and halos, respectively.

A sum of these functions:

$$f(2\theta)=f_{p1}(2\theta)+f_{p2}(2\theta)+f_h(2\theta) \quad \text{Equation A (4)}$$

is regarded as a fitting function of the overall X-ray diffraction spectrum (illustrated in FIG. 1B), which is fitted with a least square method.

There are 9 fitting variables: $a_{p1}$, $b_{p1}$, $c_{p1}$, $a_{p2}$, $b_{p2}$, $c_{p2}$, $a_h$, $b_h$ and $c_h$. As initial values of these fitting variable, peak positions of the X-ray diffraction were set for $b_{p1}$, $b_{p2}$ and $b_h$ (in the example of FIG. 1A, $b_{p1}$=21.3, $b_{p2}$=24.2, and $b_h$=22.5), and appropriate values are input for the other variables so that the two main peaks and halos coincide as much as possible with the X-ray diffraction spectrum. The fitting is carried out using SOLVER of Excel 2003 (product of Microsoft Corporation).

From the integrated areas ($S_{p1}$, $S_{p2}$, $S_h$) of the Gaussian functions $f_{p1}$ (2θ), $f_{p2}$ (2θ) corresponding to the two main peaks (P1, P2) and Gaussian function $f_h$ (2θ) corresponding to the halos after fitting, the ratio [C/(A+C)] as an index indicating the amount of the crystallization site can be calculated, assuming ($S_{p1}$+$S_{p2}$) was (C) and ($S_h$) was (A).

<Ratio of Endothermic Amount [ΔH(H)/ΔH(T)]>

A ratio [ΔH(H)/ΔH(T)] of an endothermic amount [ΔH(T), (J/g)] in the differential scanning calorimetry of the toner and an endothermic amount [ΔH(H), (J/g)] in the differential scanning calorimetry of the insoluble content of the toner to the mixed solvent of tetrahydrofuran and ethyl acetate[tetrahydrofuran/ethyl acetate=50/50 (mass ratio)] is not particularly limited and may be appropriately selected depending on the intended purpose, but is preferably 0.15 or more, more preferably 0.20 to 1.25.

The ΔH(H) and the ΔH(T) can be measured with a DSC system (differential scanning calorimeter) (DSC-60, product of Shimadzu Corporation).

Specifically, using the analysis program "endothermic peak temperature" in the DSC-60 system, a DSC curve in the second heating is selected from DSC curves obtained by measuring under the following measurement conditions, an endothermic peak temperature and an endothermic amount of a measurement sample in the second heating can be determined.

[Measurement Conditions]

Sample vessel: aluminum sample pan (with lid)
Sample amount: 5 mg
Reference: aluminum sample pan (10 mg of alumina)
Atmosphere: nitrogen (flow rate: 50 mL/min)

Temperature conditions:
Starting temperature: 20° C.
Heating rate: 10° C./min
End temperature: 150° C.
Retention time: none
Cooling rate: 10° C./min
End temperature: −20° C.
Retention time: none
Heating rate: 10° C./min
End temperature: 150° C.

The insoluble content can be obtained as follows. A toner (0.4 g) is added to a mixed solution of tetrahydrofuran (THF) and ethyl acetate (mixing ratio: 50:50 on a mass basis) (40 g), and shaken and mixed for 20 min, followed by allowing an insoluble content to be precipitated by a centrifuge, removing a supernatant, and vacuum drying the residue.

Here, the mixed solution of tetrahydrofuran and ethyl acetate [tetrahydrofuran/ethyl acetate=50/50 (mass ratio)] hardly dissolves high-molecular weight components in the toner (having a molecular weight of about 20,000 or greater) and easily dissolves low-molecular weight components having a molecular weight of less than 20,000. Thus, a sample with increased concentration of high-molecular weight resin components can be prepared by treating the toner with the above mixed solution.

The ratio [ΔH(H)/ΔH(T)] indicate a ratio of the crystalline structure in the high-molecular weight components and the crystalline structure of the entire binder resin.

The high-molecular weight components preferably have a resin structure similar to the entire binder resin. That is, when the binder resin has crystallinity, the high-molecular weight components preferably have also crystallinity. On the other hand, when the high-molecular weight components have a structure largely different from the other resin components, the high-molecular weight components easily undergo a layer separation to be in a sea-island state, so that they may not be expected to contribute to improvements in viscoelasticity and cohesive force of the entire toner.

<Maximum Peak Temperature of Heat of Fusion, and Amount of Heat of Fusion>

A maximum peak temperature and an amount of heat of fusion in the second heating of the toner in a differential scanning calorimetry are not particularly limited and may be appropriately selected depending on the intended purpose. The maximum peak temperature of heat of fusion in the second heating and the amount of heat of fusion in the second heating are preferably 50° C. to 70° C. and 30 J/g to 75 J/g, respectively, from the viewpoints of achieving both of low temperature fixability and heat resistant storageability at high level and being excellent in hot-offset resistance.

When the maximum peak temperature of heat of fusion is less than 50° C., toner blocking may be likely to occur in a high temperature environment. When the maximum peak temperature of heat of fusion is more than 70° C., it may become difficult to develop low temperature fixability.

The maximum peak temperature of heat of fusion is preferably 55° C. to 68° C., particularly preferably 58° C. to 65° C.

When the amount of heat of fusion is less than 30 J/g, the toner has decreased portions with a crystalline structure and is decreased in sharp melting property, making it difficult to balance heat resistant storageability and low-temperature fixability. When the amount of heat of fusion exceeds 75 J/g, energy required for melting and fixing the toner increases, and fixability may be degraded depending on a fixing apparatus.

The amount of heat of fusion is more preferably 45 J/g to 70 J/g, particularly preferably 50 J/g to 60 J/g.

The maximum peak temperature of heat of fusion and amount of heat of fusion can be measured using a differential scanning calorimeter (DSC) (e.g., TA-60WS and DSC-60, product of Shimadzu Corporation). Firstly, a sample to be measured for the maximum peak temperature of the heat of fusion is heated from 20° C. to 150° C. at a heating rate of 10° C./min, then cooled to 0° C. at a cooling rate of 10° C./min and then heated again at a heating rate of 10° C./min to measure a change in an endothermic or exothermic amount. The "endothermic or exothermic amount" is plotted against the "temperature", and a temperature corresponding to the maximum peak of the endothermic amount is determined as the maximum peak temperature of the heat of fusion in the second heating. Also, an endothermic amount of the endothermic peak having the above maximum peak temperature is determined as an amount of heat of fusion in the second heating.

<Maximum Endothermic Peak Temperature (T1) and Maximum Exothermic Peak Temperature (T2)>

The maximum endothermic peak temperature in the second heating (T1) and the maximum exothermic peak temperature in the first cooling (T2) of the toner in a range of 0° C. to 150° C. in the differential scanning calorimetry is not particularly limited and may be appropriately selected depending on the intended purpose, but preferably meets the following expressions:

$$T1-T2\leq 30^\circ\ \text{C.} \qquad \text{Expression (1)}$$

$$T2\geq 30^\circ\ \text{C.} \qquad \text{Expression (2)}$$

When the (T1−T2) is more than 30° C., an image is outputted in a state in which a crystalline resin on the image is not solidified by crystallization upon heat-fixing, potentially leading to exfoliation of a fixed image due to fusion of the image to paper upon stacking printed paper.

When the T2 is less than 30° C., an image is present in a melted state around room temperature, so that satisfactory blocking resistance and stress stability of an image may not be attained.

The T1 and the T2 can be measured using a differential scanning calorimeter (DSC) (e.g., TA-60WS and DSC-60, product of Shimadzu Corporation). Firstly, a sample to be measured is heated from 20° C. to 150° C. at a heating rate of 10° C./min, then cooled to −20° C. at a cooling rate of 10° C./min and then heated again to 150° C. at a heating rate of 10° C./min to measure a change in an endothermic or exothermic amount in the second heating and in the first cooling. The "endothermic or exothermic amount" is plotted against the "temperature", and a temperature corresponding to the maximum peak of the endothermic amount in the second heating is determined as the maximum endothermic peak temperature in the second heating (T1). Also, a temperature corresponding to the maximum peak of the exothermic amount in the first cooling is determined as the maximum exothermic peak temperature in the first cooling (T2).

<Urea Bond>

The THF soluble content in the toner preferably has a urea bond because the urea bond is expected to improve toughness of the toner and offset resistance upon fixing even in a small amount.

The presence of the urea bond in the THF soluble content of the toner may be analyzed using $^{13}$C-NMR. Specifically, the analysis is conducted as follows. After 2 g of a sample to be analyzed is soaked in 200 mL of a methanol solution of potassium hydroxide having a concentration of 0.1 mol/L and left at 50° C. for 24 hours, the solution is removed, the residue is further washed with ion-exchanged water until a pH becomes neutral, and then the remaining solid is dried. The post-dried sample is added to a mixed solvent of dimethylacetamide (DMAc) and deuterated dimethyl sulfoxide (DMSO-$d_6$) (volume ratio 9:1) so as to have a concentration of 100 mg/0.5 mL. This is dissolved at 70° C. for 12 hours to 24 hours and then cooled to 50° C., followed by being subjected to $^{13}$C-NMR measurement. Here, for example, a measurement frequency is 125.77 MHz, 1H 60° pulse is 5.5 μs, and tetramethylsilane (TMS), which is a reference substance, is determined as 0.0 ppm.

Figure 2:
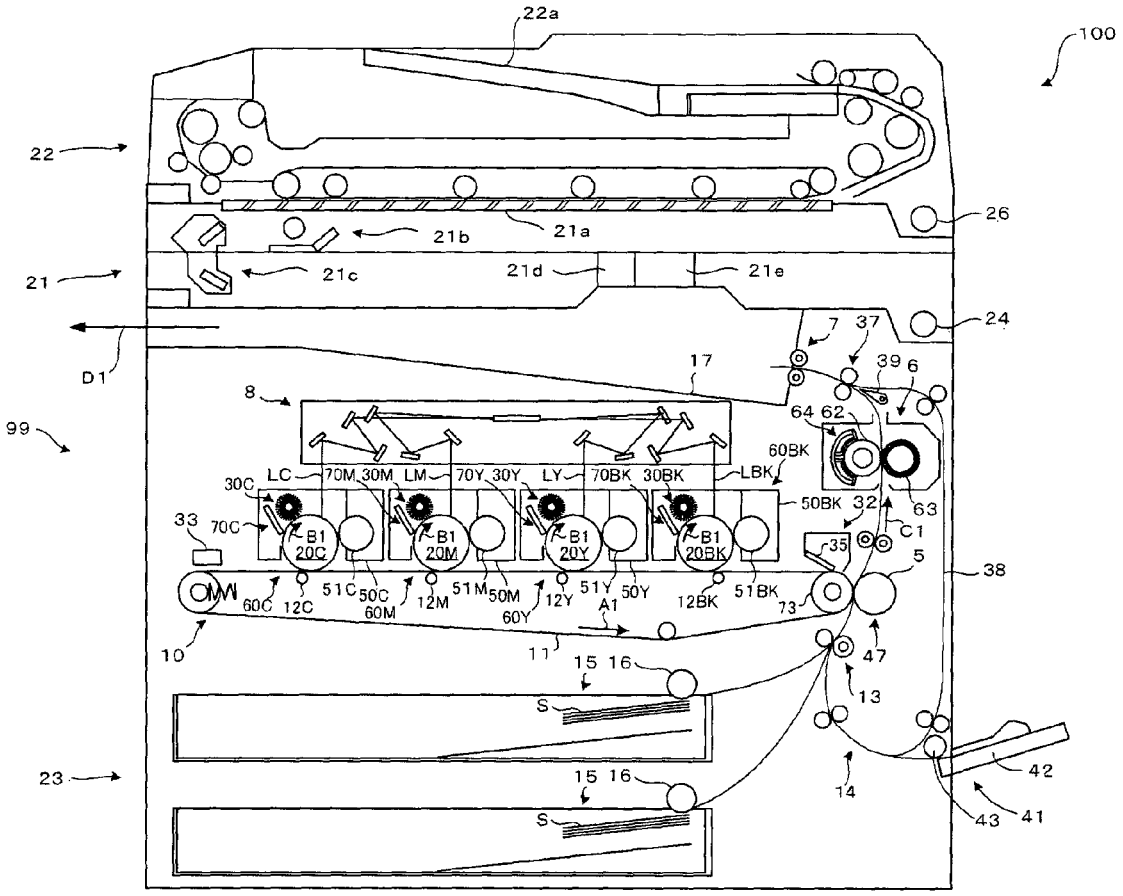
FIG. 2 is a schematic cross-sectional diagram illustrating one example of an image forming apparatus of the present invention.

The presence of the urea bond in the sample is confirmed by whether or not a signal is observed in a chemical shift of a signal derived from the carbonyl carbon of the urea bond site in a polyurea as a preparation. The chemical shift of the carbonyl carbon is generally observed at 150 ppm to 160 ppm. As one example of polyurea, a $^{13}$C-NMR spectrum in proximity to a carbonyl carbon of a polyurea as a reaction product of 4,4'-diphenylmethane diisocyanate (MDI) and water is illustrated in FIG. 2. A signal derived from the carbonyl carbon is observed at 153.27 ppm.

<Urethane Bond>

The THF soluble content of the toner preferably includes a urethane bond. The urethane bond may be confirmed by using $^{13}$C-NMR similarly to the confirmation method for the urea bond.

<Production Method of Toner>

A production method of the toner is not particularly limited and may be appropriately selected depending on the intended purpose. Examples thereof include a kneading pulverization method and a method in which toner particles are granulated in an aqueous medium, which is so-called a chemical method. Among them, the chemical method which does not include kneading of the binder resin is preferred because molecules are not cleaved with kneading, and kneading of a high molecular resin and a low molecular resin, which are difficult to be uniformly kneaded together, can be avoided.

The toner can also be produced by a particle-producing method as described in Japanese patent (JP-B) No. 4531076 in which toner materials are dissolved into carbon dioxide in a liquid or supercritical state, followed by removing the carbon dioxide in a liquid or supercritical state to thereby obtain toner particles.

Examples of the chemical method include a suspension polymerization method, an emulsification polymerization method, a seed polymerization method, and a dispersion polymerization method, all of which use a monomer as a starting material; a dissolution suspension method in which a resin or resin precursor is dissolved in an organic solvent, and the resulting solution is dispersed and/or emulsified in an aqueous medium; a method in which an oil phase composition containing a resin precursor having a functional group reactive with an active hydrogen group (a reactive group-containing prepolymer) is dispersed and/or emulsified in an aqueous medium to thereby react an active hydrogen group-containing compound with the reactive group-containing prepolymer in the aqueous medium (production method (I)); a phase-transfer emulsification method in which water is added to a solution containing a resin or resin precursor, and an appropriate emulsifying agent to thereby proceed phase transfer; and an aggregation method in which resin particles formed in any of the aforementioned methods is dispersed in an aqueous medium, and aggregated by, for example, heating and fusing to thereby granulate into particles of the predetermined size. Among them, the toner obtained by the dissolution suspension method, the production method (I), or the aggregation method is preferable from the viewpoint of granulation ability of the crystalline resin (e.g., easiness in control of particle size distribution, and control of particle shape), and the toner obtained by the production method (I) is more preferable.

These production methods will be specifically explained hereinafter.

—Kneading-Pulverization Method—

The kneading-pulverization method is a method for producing toner base particles, for example, by melt-kneading toner materials containing at least a binder resin, pulverizing and classifying.

The toner materials are mixed, and the resulting mixture is placed in a melt-kneader to perform melt-kneading. As the melt-kneader, for example, a single-screw or twin-screw continuous kneader, or a batch-type kneader with a roll mill can be used. Specific examples thereof include a KTT type twin screw extruder (product of KOBE STEEL, LTD.), a TEM type extruder (product of TOSHIBA MACHINE CO., LTD.), a twin screw extruder (product of KCK Engineering Co. Ltd), a PCM type twin screw extruder (product of Ikegai Corp.), and a cokneader (product of Buss corporation). The melt-kneading is preferably performed under the appropriate conditions so as not to cause scission of molecular chains of the binder resin. Specifically, the temperature of the melt-kneading is adjusted under taking the softening point of the binder resin as consideration. When the temperature of the melt-kneading is greatly higher than the softening point, the scission occurs significantly. When the temperature is greatly lower than the softening point, the dispersing may not be progressed.

The pulverizing is a step of pulverizing the kneaded product obtained by the melt-kneading. In the pulverizing, it is preferred that the kneaded product be coarsely pulverized, followed by finely pulverized. For the pulverizing, a method in which the kneaded product is pulverized by making the kneaded product to crush into an impact plate in the jet stream, a method in which the kneaded product is pulverized by making particles of the kneaded product to crush with each other in the jet stream, or a method in which the kneaded product is pulverized in a narrow gap between a mechanically rotating rotor and a stator is preferably used.

The classifying is a step of classifying the pulverized product obtained by the pulverizing into particles having the predetermined particle diameters. The classifying can be performed by removing the fine particles by means of, for example, a cyclone, a decanter, or a centrifugal separator.

—Chemical Method—

The chemical method is not particularly limited and may be appropriately selected depending on the intended purpose. It is preferably a method in which toner material liquid containing at least the binder resin is dispersed and/or emulsified into an aqueous medium to thereby granulate base particles of the toner.

As the chemical method, preferred is a method in which an oil phase (toner material liquid), which is obtained by dissolving or dispersing toner materials containing at least the binder resin, the binder resin precursor, or both thereof into an organic solvent, is dispersed or emulsified into an aqueous medium to thereby granulate base particles of the toner. In this case, in the aqueous medium, the binder resin precursor (resin precursor having a functional group reactive with an active hydrogen group) is reacted with an active hydrogen group-containing compound.

Examples of the active hydrogen group-containing compound include water and polyamine. The polyamine includes an amine compound blocked with ketone (ketimine compound). Example of the polyamine includes those exemplified in a description of the polyurea unit.

Example of the binder resin precursor includes a crystalline polyester resin having a terminal isocyanate group.

The dissolution suspension method and the ester-elongating method allow the crystalline resin to be easily granulated.

—Organic Solvent—

As for the organic solvent used for dissolving or dispersing the binder resin or the binder resin precursor, a volatile organic solvent having a boiling point of lower than 100° C. is preferable because it can be easily removed in the subsequent step.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone, and methyl isobutyl ketone. These may be used alone, or in combination. Among them, preferred are ester-based solvents such as methyl acetate and ethyl acetate; aromatic solvents such as toluene and xylene; and the halogenated hydrocarbons such as methylene chloride, 1,2-dichloroethane, chloroform, and carbon tetrachloride.

The solid content concentration of the toner material liquid containing the binder resin or the binder resin precursor is preferably 40% by mass to 80% by mass. When the solid content concentration is less than 40% by mass, the amount of the resultant toner may be decreased. When the solid content concentration is more than 80% by mass, the binder resin or the binder resin precursor is difficult to be dissolved or dispersed and is increased in viscosity to thereby be difficult to handle.

Toner materials other than resin such as the colorant and the releasing agent, and masterbatch thereof may be separately dissolved or dispersed into organic solvent, followed by mixing with the toner material liquid.

—Aqueous Medium—

As for the aqueous medium, water may be used solely, or water may be used in combination with a water-miscible solvent. Examples of the water-miscible solvent include alcohols (e.g., methanol, isopropanol, and ethylene glycol), dimethyl formamide, tetrahydrofuran, cellosolves (e.g., methyl cellosolve), and lower ketones (e.g., acetone, and methyl ethyl ketone).

An amount of the aqueous medium relative to 100 parts by mass of the toner material liquid is not particularly limited and may be appropriately selected depending on the intended purpose, but it is typically 50 parts by mass to 2,000 parts by mass, preferably 100 parts by mass to 1,000 parts by mass. When the amount is smaller than 50 parts by mass, the toner material liquid cannot be desirably dispersed, which enables to provide toner particles having the predetermined particle diameters. When the amount is greater than 2,000 parts by mass, it may not be economical.

An inorganic dispersant and/or organic resin particles may be dispersed in the aqueous medium in advance, which is preferable for the viewpoints of a sharp particle distribution of the resulting toner, and dispersion stability.

Examples of the inorganic dispersant include tricalcium phosphate, calcium carbonate, titanium oxide, colloidal silica and hydroxyapatite.

As for the resin for forming the organic resin particles, any resin can be used as long as it is a resin capable of forming an aqueous dispersant, and may be a thermoplastic resin or a thermosetting resin. Examples thereof include a vinyl resin, a polyurethane resin, an epoxy resin, a polyester resin, a polyamide resin, a polyimide resin, a silicon resin, a phenol resin, a melamine resin, a urea resin, an aniline resin, an iomer resin, and a polycarbonate resin. These may be used alone, or in combination. Among them, a vinyl resin, a polyurethane resin, an epoxy resin, a polyester resin, and a combination thereof are preferable because an aqueous dispersion liquid of spherical resin particles can be easily obtained.

The method for emulsifying and/or dispersing the toner material liquid into the aqueous medium is not particularly limited, and conventional equipment, such as a low-speed shearing disperser, a high-speed shearing disperser, a friction disperser, a high-pressure jetting disperser and ultrasonic disperser, can be employed. Among them, the high-speed shearing disperser is preferable from the viewpoint of miniaturizing size of particles. In the case of using the high-speed shearing disperser, the rotating speed is not particularly limited, but it is typically 1,000 rpm to 30,000 rpm, preferably 5,000 rpm to 20,000 rpm. The temperature during dispersing is typically 0° C. to 150° C. (under a pressure), preferably 20° C. to 80° C.

In the case where the toner material liquid contains the binder resin precursor, the active hydrogen group-containing compound, which is necessary for an elongation and/or crosslink reaction of the binder resin precursor, may be previously mixed in the toner material liquid before dispersing the toner material liquid in an aqueous medium, or may be mixed with the toner material liquid in the aqueous medium.

In order to remove the organic solvent from the obtained emulsified dispersion liquid, a conventional method known in the art can be used. For example, a method can be employed in which the temperature of the entire system is gradually increased under normal pressure or reduced pressure, to completely evaporate and remove the organic solvent in the droplets. Thus, the base particles of the toner can be obtained.

In washing and drying of the base particles of the toner dispersed in the aqueous medium, conventional techniques are used. Specifically, after the solid-liquid separation is performed by a centrifugal separator or a filter press, the resulting toner cake is re-dispersed in ion-exchanged water having the normal temperature to about 40° C., optionally adjusting the pH thereof with acid or alkali, followed by again subjected to solid-liquid separation. This series of operations are repeated a few times to remove impurities or a surfactant, followed by drying by means of a flash dryer, circulation dryer, vacuum dryer, or vibration flash dryer, to thereby obtain toner powder. Fine particle components may be removed from the toner by centrifugal separation during the aforementioned operations, or they may be optionally classified to have the desirable particle size distribution by means of a conventional classifying device after the drying.

(Developer)

The developer of the present invention contains the toner of the present invention. The developer may be a one-component developer, or two-component developer which is obtained by mixed with a carrier, but is preferably a two-component developer from the viewpoint of a long service life in the case of being used in recent high-speed printers corresponded to the improved information processing speed.

In the case of the one-component developer using the toner, the diameters of the toner particles do not vary largely even when the toner is supplied and consumed in a developer; the toner does not cause filming to a developing roller, nor fuse to a layer thickness regulating member such as a blade for thinning a thickness of a layer of the toner; and excellent and stable developability can be achieved even when it is used (stirred) in the developing unit over a long period of time.

In the case of the two-component developer using the toner, the diameters of the toner particles do not vary largely even when the toner is supplied and consumed in a developer; and excellent and stable developability can be achieved even when it is stirred in the developing unit over a long period of time.

<Carrier>

The carrier is not particularly limited and may be appropriately selected depending on the intended purpose. It preferably includes a core material and a resin layer which coats the core material.

—Core Material—

The core material is not particularly limited and may be appropriately selected depending on the intended purpose as long as it is magnetic particles. Preferred examples thereof include ferrite, magnetite, iron and nickel. Also, in the case where environmental adaptability which is promoted significantly in recent years is taken into consideration, the ferrite preferably is not conventional copper-zinc ferrite, but manganese ferrite, manganese-magnesium ferrite, manganese-strontium ferrite, manganese-magnesium-strontium ferrite and lithium ferrite.

—Resin Layer—

A material of the resin layer is not particularly limited and may be appropriately selected depending on the intended purpose. Examples thereof include an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, a copolymer of vinylidene fluoride and acryl monomer, a copolymer of vinylidene fluoride and vinyl fluoride, a fluoroterpolymer (e.g., a terpolymer of tetrafluoroethylene, vinylidene fluoride, and non-fluoromonomer), and a silicone resin. These may be used alone, or in combination.

The silicone resin is not particularly limited and may be appropriately selected depending on the intended purpose. Examples thereof include a straight silicone resin constituted of organosiloxane bonds; and a modified silicone resin modified with an alkyd resin, a polyester resin, an epoxy resin, an acryl resin, or a urethane resin.

The silicone resin may be commercially available products. Examples of commercially available products of the straight silicone resin include KR271, KR255, and KR152 (these products are of Shin-Etsu Chemical Co., Ltd.); and SR2400, SR2406, and SR2410 (these products are of Dow Corning Toray Co., Ltd.).

Examples of commercially available products of the modified silicone resin include KR206 (alkyd-modified silicone resin), KR5208 (acryl-modified silicone resin), ES1001N (epoxy-modified silicone resin), and KR305 (urethane-modified silicone resin) (these products are of Shin-Etsu Chemical Co., Ltd.); and SR2115 (epoxy-modified silicone resin), SR2110 (alkyd-modified silicone resin) (these products are of Dow Corning Toray Co., Ltd.).

Note that, the silicone resin can be used alone, but the silicone resin can also be used in combination with, for example, a component capable of undergoing a crosslinking reaction, a component for adjusting charging amount.

An amount of an ingredient for forming the resin layer contained in the carrier is preferably 0.01% by mass to 5.0% by mass. When the amount is smaller than 0.01% by mass, the resin layer may not be uniformly formed on a surface of the core material. When the amount is greater than 5.0% by mass, the resin layer becomes so thick that particles of the carrier may be granulated with each other, and thus uniform carrier particles cannot be obtained.

In the case where the developer is a two-component developer, an amount of the toner is not particularly limited and may be appropriately selected depending on the intended purpose, but is preferably 2.0 parts by mass to 12.0 parts by mass, more preferably 2.5 parts by mass to 10.0 parts by mass relative to 100 parts by mass of the carrier.

(Image Forming Apparatus and Image Forming Method)

An image forming apparatus of the present invention includes at least an electrostatic latent image bearing member, an electrostatic latent image forming unit, a developing unit, a transfer unit and a fixing unit; and, if necessary, further includes other units.

An image forming method of the present invention includes at least an electrostatic latent image forming step, a developing step, a transfer step and a fixing step; and, if necessary, further includes other steps.

A toner used in the image forming apparatus and the image forming method is the toner of the present invention.

The image forming method can be suitably performed by the image forming apparatus of the present invention. Specifically, the electrostatic latent image forming step can be suitably performed by the electrostatic latent image forming unit. The developing step can be suitably performed by the developing unit. The transfer step can be suitably performed by the transfer unit. The fixing step can be suitably performed by the fixing unit. The other steps can be suitably performed by the other units.

<Electrostatic Latent Image Bearing Member>

The material, structure, size of the electrostatic latent image bearing member are not particularly limited and may be appropriately selected from those known in the art. Examples of the material of the latent image bearing member include an inorganic photoconductor made of amorphous silicon or selenium and an organic photoconductor made of polysilane or phthalopolymethine. Among them, an amorphous silicon photoconductor is preferred from the viewpoint of a long service life.

The amorphous silicon photoconductor may be a photoconductor having a support and a photoconductive layer of a-Si, which is formed on the heated support of 50° C. to 400° C. using a film forming method such as a vacuum vapor deposition method, a sputtering method, an ion plating method, a thermal CVD (Chemical Vapor Deposition) method, a photo-CVD method or a plasma CVD method. Among them, a plasma. CVD method is suitably employed, in which gaseous raw materials are decomposed through application of direct current or high-frequency or microwave glow discharge to thereby form an a-Si deposition film on the support.

The shape of the electrostatic latent image bearing member is not particularly limited and may be appropriately selected depending on the intended purpose, but is preferably cylindrical. The outer diameter of the electrostatic latent image bearing member is not particularly limited and may be appropriately selected depending on the intended purpose, but is preferably 3 mm to 100 mm, more preferably 5 mm to 50 mm, particularly preferably 10 mm to 30 mm.

<Electrostatic Latent Image Forming Unit and Electrostatic Latent Image Forming Step>

The electrostatic latent image forming unit is not particularly limited and may be appropriately selected depending on the intended purpose, as long as it is a unit configured to form an electrostatic latent image on the electrostatic latent image bearing member. Example thereof includes a unit including at least a charging member configured to charge a surface of the electrostatic latent image bearing member and an exposing member configured to imagewise-expose the surface of the electrostatic latent image bearing member.

The electrostatic latent image forming step is not particularly limited and may be appropriately selected depending on the intended purpose, as long as it is a step of forming an electrostatic latent image on the electrostatic latent image bearing member. For example, the electrostatic latent image forming step is performed with the electrostatic latent image forming unit by charging a surface of the electrostatic latent image bearing member, followed by imagewise-exposing the surface of the electrostatic latent image bearing member.

—Charging Member and Charging—

The charging member is not particularly limited and may be appropriately selected depending on the intended purpose. Examples thereof include contact-type chargers known per se having, for example, a conductive or semiconductive roller, brush, film and rubber blade; and non-contact-type chargers utilizing colona discharge such as corotron and scorotron.

The charging can be performed by, for example, applying voltage to a surface of the electrostatic latent image bearing member using the charging member.

The charging member may have any shape such as a magnetic brush or a fur brush, as well as a roller. The shape thereof may be suitably selected according to the specification or configuration of the image forming apparatus.

When the magnetic brush is used as the charging member, the magnetic brush is composed of a charging member made of various ferrite particles such as Zn—Cu ferrite, a non-magnetic electroconductive sleeve configured to support the charging member, and a magnetic roller included in the non-magnetic electroconductive sleeve.

Also, when the fur brush is used as the charging member, the fur brush may be made of a fur which is treated to be electroconductive with, for example, carbon, copper sulfide, a metal or a metal oxide, and which is formed into the charging member by coiling around or mounting to a metal or a metal core treated to be electroconductive.

The charging member is not limited to the aforementioned contact-type charging members. However, the contact-type charging members are preferably used from the viewpoint of producing an image forming apparatus in which the amount of ozone generated from the charging member is reduced.

—Exposing Member and Exposing—

The exposing member is not particularly limited and may be appropriately selected depending on the purpose, as long as it can desirably imagewise-expose the surface of the electrostatic latent image bearing member which have been charged with the charging member. Examples of the exposing member include various exposing members such as a copy optical exposing member, a rod lens array exposing member, a laser optical exposing member and a liquid crystal shutter exposing member.

The exposing can be performing by, for example, imagewise-exposing the surface of the electrostatic latent image bearing member using the exposing member.

A light source used for the exposing member is not particularly limited and may be appropriately selected depending on the intended purpose. Examples thereof include conventional light-emitting devices such as a fluorescent lamp, a tungsten lamp, a halogen lamp, a mercury lamp, a sodium lamp, a light-emitting diode (LED), a laser diode (LD) and an electroluminescence (EL) device.

Also, various filters may be used for emitting only light having a desired wavelength range. Examples of the filters include a sharp-cut filter, a band-pass filter, an infrared cut filter, a dichroic filter, an interference filter and a color temperature conversion filter.

Notably, in the present invention, the back side of the electrostatic latent image bearing member may be imagewise exposed.

<Developing Unit and Developing Step>

The developing unit is not particularly limited and may be appropriately selected depending on the intended purpose, as long as it is a developing unit configured to develop with a toner the electrostatic latent image which has been formed on the electrostatic latent image bearing member to thereby form a visible image.

The developing step is not particularly limited and may be appropriately selected depending on the intended purpose, as long as it is a developing step of developing with the toner the electrostatic latent image which has been formed on the electrostatic latent image bearing member to thereby form a visible image. For example, the developing step is performed with the developing unit.

The developing unit may employ a dry developing system, or a wet developing system. The developing unit may be a developing unit for a single color, or a developing unit for multicolor.

The developing unit is preferably a developing device including a stirrer for rubbing and stirring the toner to charge the toner, a magnetic field generating unit fixed inside the device, and a rotatable developer bearing member bearing a developer containing the toner on the surface thereof.

In the developing device, the toner and the carrier are stirred and mixed so that the toner is charged by friction generated therebetween. The charged toner is retained in the chain-like form on the surface of the rotating magnetic roller to form a magnetic brush. The magnetic roller is disposed proximately to the electrostatic latent image bearing member and thus, some of the toner forming the magnetic brush on the magnet roller are electrically transferred onto the surface of the electrostatic latent image bearing member. As a result, the electrostatic latent image is developed with the toner to form a visible toner image on the surface of the electrostatic latent image bearing member.

<Transfer Step and Transfer Unit>

The transfer unit is not particularly limited and may be appropriately selected depending on the intended purpose, as long as it transfers a visible image onto a recording medium. The transfer unit preferably has a primary transfer unit configured to transfer visible images onto an intermediate transfer medium to form a composite transfer image, and a secondary transfer unit configured to transfer the composite transfer image onto a recording medium.

The transfer step is not particularly limited and may be appropriately selected depending on the intended purpose, as long as it transfers a visible image onto a recording medium. In a preferred embodiment of the transfer step, a visible image is primarily transferred onto an intermediate transfer medium, from which the visible image is secondarily transferred onto the recording medium.

The transfer can be performed by, for example, charging the electrostatic latent image bearing member using a transfer charger, and can be performed with the transfer unit.

Here, when the image to be secondarily transferred onto the recording medium is a color image of several color toners, a configuration can be employed in which the transfer unit sequentially superposes the color toners on top of another on the intermediate transfer medium to form an image on the intermediate transfer medium, and the image on the intermediate transfer medium is secondarily transferred at one time onto the recording medium by an intermediate transfer unit.

Notably, the intermediate transfer medium is not particularly limited and may be appropriately selected from known transfer media depending on the intended purpose. Preferred examples thereof include a transfer belt.

The transfer unit (the primary transfer unit and the secondary transfer unit) preferably has at least a transfer device which transfers the visible images which has been formed on the electrostatic latent image bearing member onto the recording medium through charging.

Examples of the transfer device include a corona transfer device using corona discharge, a transfer belt, a transfer roller, a press transfer roller and an adhesion transfer device.

Notably, the recording medium is typically plane paper, but it is not particularly limited and may be appropriately selected depending on the intended purpose, so long as it can transfer an unfixed image after developing. PET bases for OHP can also be used as the recording medium.

<Fixing Step and Fixing Unit>

The fixing unit is not particularly limited and may be appropriately selected depending on the intended purpose as long as it is a unit configured to fix a transferred image which has been transferred on the recording medium. Examples thereof include a combination of a heat roller (a heated fixing member) and a pressure roller, and a combination of a heat roller, a pressure roller and an endless belt (a heated fixing member).

The fixing step is not particularly restricted and may be appropriately selected according to purpose, as long as it is a step of fixing a transferred image which has been transferred on the recording medium.

The fixing step may be performed every time when an image of each color toner is transferred onto the recording medium, or at one time (at the same time) on a laminated image of color toners.

The fixing unit is preferably a unit configured to fix the transferred image by contacting the transferred image with the heated fixing member.

The fixing step is preferably a step of fixing the transferred image by contacting the transferred image with the heated fixing member.

The fixing unit preferably has an induction heating member which heats the fixing member through induction heating.

The fixing step preferably heats the fixing member through induction heating.

Example of the fixing member generating heat through induction heating includes a rotary heat generator having a heat generating layer which generates heat through induction heating. The shape of the rotary heat generator is not particularly restricted and may be appropriately selected according to purpose. Examples thereof include a roller-like shape or a belt-like shape.

The induction heating member includes at least an exciting coil which heats the heat generating layer through induction heating, preferably includes a degaussing coil which can generate magnetic flux that counteracts magnetic flux generated by the exciting coil; and, if necessary, includes other members.

When the induction heating member having the degaussing coil is used, end-offset is usually suppressed by an action of the degaussing coil.

However, the present inventors have been found that when a conventional toner containing a crystalline resin is used as a toner, the end-offset occur even when the induction heating member having the degaussing coil is used.

The present inventors conducted extensive studies and found that a use of the toner as a toner containing a crystalline resin allows to prevent the end-offset which is caused even when using the induction heating member having the degaussing coil.

A heating temperature in the fixing step is not particularly limited and may be appropriately selected depending on the intended purpose, but is preferably 80° C. to 200° C.

A surface pressure at the fixing step is not particularly limited and may be appropriately selected depending on the intended purpose, but is preferably 10 $N/cm^2$ to 80 $N/cm^2$.

<Other Units and Other Steps>

Examples of the other units include a cleaning unit, a charge-eliminating unit, a recycling unit, and a control unit.

Examples of the other steps include a cleaning step, a charge-eliminating step, a recycling step, and a control step.

—Cleaning Unit and Cleaning Step—

The cleaning unit is not particularly limited and may be appropriately selected depending on the intended purpose, as long as it can remove the toner remaining on the electrostatic latent image bearing member. Examples thereof include a magnetic brush cleaner, an electrostatic brush cleaner, a magnetic roller cleaner, a blade cleaner, a brush cleaner and a web cleaner.

The cleaning step is not particularly limited and may be appropriately selected depending on the intended purpose, as long as it is a step of removing the toner remaining on the electrostatic latent image bearing member. It may be carried out by the cleaning unit.

—Charge-Eliminating Unit and Charge-Eliminating Step—

The charge-eliminating is not particularly limited and may be appropriately selected depending on the intended purpose, as long as it is a unit configured to apply a charge-eliminating bias to the electrostatic latent image bearing member to thereby charge-eliminate. Example thereof includes a charge-eliminating lamp.

The charge-eliminating step is not particularly limited and may be appropriately selected depending on the intended purpose, as long as it is a step of applying a charge-eliminating bias to the electrostatic latent image bearing member to thereby charge-eliminate. It may be carried out by the charge-eliminating unit.

—Recycling Unit and Recycling Step—

The recycling unit is not particularly limited and may be appropriately selected depending on the intended purpose, as long as it is a unit configured to recycle the toner removed at the cleaning step to developing unit. The recycling unit may be a known conveying unit.

The recycling step is not particularly limited and may be appropriately selected depending on the intended purpose, as long as it is a step of recycling the toner removed in the cleaning step to the developing unit. The recycling step can be performed with the recycling unit.

—Control Unit and Control Step—

The control unit is not particularly limited and may be appropriately selected depending on the intended purpose, as long as it can control the operation of each of the above units. Examples thereof include devices such as sequencer and computer.

The control step is not particularly limited and may be appropriately selected depending on the intended purpose, as long as it is a step of controlling the operation of each of the above units. The control step can be performed with the control unit.

An image forming method and an image forming apparatus according to one embodiment of the present invention will be schematically explained with reference to the appended figures. FIG. 2 is a schematic cross-sectional diagram illustrating one example of an image forming apparatus of the present invention. The image forming apparatus 100 is a multifunction device which has copier, printer, and facsimile function, and can form full-color images. When the image forming apparatus 100 is used as a printer or a facsimile, an image forming process is performed based on image signals corresponding to image information received from the exterior.

The image forming apparatus 100 is an image forming apparatus employing a tandem structure (may be referred to as a tandem type image forming apparatus) in which cylindrical photoconductor drums 20BK, 20Y, 20M, and 20C are arranged in parallel. The photoconductor drums are latent image bearing members as a plurality of image bearing members capable of forming images as images corresponding to colors separated into yellow, magenta, cyan, and black.

All of the photoconductor drums 20BK, 20Y, 20M, and 20C have the same diameter of 24 mm, and are equally spaced apart from one another on an outer peripheral surface (i.e., a surface on which images are formed) of a transfer belt 11 (intermediate transfer medium) serving as an automatic document feeding device which is an endless belt arranged around the center of the interior of a main body 99 of the image forming apparatus 100. The transfer belt 11 is configured to be movable in a direction indicated by arrow A1 while facing the photoconductor drums 20BK, 20Y, 20M, and 20C.

The photoconductor drums 20BK, 20Y, 20M, and 20C are arranged in parallel in this order from the upstream side in the direction indicated by arrow A1. The photoconductor drums 20BK, 20Y, 20M, and 20C are provided in image stations 60BK, 60Y, 60M, and 60C that are imaging units serving as image forming portions (imaging portions) for forming black, yellow, magenta, and cyan images, respectively.

Visible images, i.e., toner images formed on the photoconductor drums 20BK, 20Y, 20M, and 20C are superimposed and transferred onto the transfer belt 11 being moving in the direction indicated by arrow A1, and then transferred onto the transfer paper S at one time.

The visible images superimposed and transferred onto the transfer belt 11 by applying voltage by primary transfer rollers 12BK, 12Y, 12M, and 12C serving as transfer chargers arranged at positions opposite to the respective photoconductor drums 20BK, 20Y, 20M, and 20C with the transfer belt 11 interposed therebetween, at a transfer position at which the photoconductor drums 20BK, 20Y, 20M, and 20C face the transfer belt 11 with shifting the transfer time from the upstream side to the downstream side in the A1 direction so that the toner images formed on the photoconductor drums 20BK, 20Y, 20M, and 20C are superimposed and transferred at the same position on the transfer belt 11 during traveling of the transfer belt 11 in the A1 direction.

The image forming apparatus 100 includes a main body 99 which is located at a center in a vertical direction; a reading device 21 serving as a scanner that is a document reading unit located above the main body 99 and configured to read a document; an automatic document feeding device 22 (may be referred to as ADF) that is located above the reading device 21 and is configured to feed into the reading device 21 an document which has been loaded thereon; a sheet feeding device 23 serving as a feeding table that is located below the main body 99 and on which the transfer paper S to be conveyed to between the photoconductor drums 20BK, 20Y, 20M, and 20C and the transfer belt 11 is loaded; and a manual paper feeding device 41 which is arranged on a right side of the main body 99 in FIG. 2.

The image forming apparatus 100 also includes four image stations 60BK, 60Y, 60M, and 60C; a transfer belt unit 10 serving as an intermediate transfer unit which is arranged below the photoconductor drums 20BK, 20Y, 20M, and 20C so as to face them and is an intermediate transfer device including the transfer belt 11; and a secondary transfer device 47 which is a secondary transfer unit configured to transfer a toner image formed on the transfer belt 11 onto the transfer paper S.

The image forming apparatus 100 also includes a cleaning device 32 serving as an automatic document feeding device cleaning unit (an automatic document feeding device cleaning device) which is arranged between the secondary transfer device 47 and the image station 60BK in the A1 direction so as to face the transfer belt 11 and configured to clean a surface of the transfer belt 11; and a toner mark sensor 33 which is arranged downstream of the image station 60C in the A1 direction and at a position facing a top surface of the transfer belt 11.

The image forming apparatus 100 also includes a an optical scanning device 8 which is a latent image forming unit serving as a optical writing device (writing unit) arranged so as to face the top surface of the image stations 60BK, 60Y, 60M, and 60C; a waste toner accommodating portion for an intermediate transfer medium (not shown) which is arranged below the transfer belt unit 10 so as to face the transfer belt unit 10; and a toner conveying path (not shown) through which the cleaning device 32 is connected with the waste toner accommodating portion for an intermediate transfer medium.

The image forming apparatus 100 also includes a pair of registration rollers 13 that feeds the transfer paper S which has been conveyed from the sheet feeding device 23 into a secondary transfer portion between the transfer belt 11 and the secondary transfer device 47 at predetermined timing corresponding to a timing at which a toner image is formed by the image stations 60BK, 60Y, 60M, and 60C; and a sensor (not shown) configured to detect an arrival of the leading end of the transfer paper S to the pair of registration rollers 13.

The image forming apparatus 100 also includes a fixing device 6 serving as a fixing unit employing an electromagnetic induction heating system and configured to fix a toner image (transferred image) on the transfer paper S on which the toner image has been transferred and which has been fed in a direction indicated by arrow C1; paper discharging rollers 7 configured to discharge to the exterior of the main body 99 the transfer paper S which has passed through the fixing device 6; and a reverse feeding device 14 configured to reversely feed to the pair of registration rollers 13 again the transfer paper S which has been passed through the fixing device 6 and on which one side an image has been formed.

The image forming apparatus 100 also includes a paper discharging tray 17 serving as a paper discharging portion which is arranged above the main body 99 and on which the transfer paper S having being discharged to the exterior of the main body 99 by the paper discharging rollers 7 is loaded; and toner bottles (not shown) filled with yellow, magenta, cyan, and black toner.

The image forming apparatus 100 is an in-body paper discharging type image forming apparatus in which the paper discharging tray 17 is positioned above the main body 99 and below the reading device 21. The transfer paper S loaded on the paper discharging tray 17 is discharged to downstream in a direction indicated by arrow D1 corresponding to a leftward direction in FIG. 2.

As illustrated in FIG. 2, the cleaning device 32 includes an intermediate transfer cleaning blade 35 serving as a cleaning blade which contacts with the transfer belt 11 at a position facing the transfer entrance roller 73, and is configured to clean the transfer belt 11 by scraping with the intermediate transfer cleaning blade 35 unwanted substances such as paper powder or an untransferred residual toner remaining on the transfer belt 11.

The optical scanning device 8 is a laser beam scanner which uses laser diodes as light sources and which is configured to emit laser light (beams LBK, LY, LM, and LC) based on image information for scanning and exposing surfaces to be scanned, i.e., surfaces of the photoconductor drums 20BK, 20Y, 20M, and 20C to thereby form electrostatic latent images. The optical scanning device 8 may use LED as a light source.

The reading device 21 is located above the main body 99, and is provided as a opening/closing body which is openable and closable to the main body 99 and which is rotatably integrated with the main body 99 using a shaft 24 arranged at the upstream side end portion of the image forming apparatus 100 in the D1 direction, that is, the back side of the image forming apparatus 100.

The reading device 21 includes a contact glass 21*a* on which a document is placed; a first traveling body 21*b* which travels in a horizontal direction in FIG. 2 and which includes a light source (not shown) configured to radiate light to a document placed on the contact glass 21*a* and a first reflector (not shown) configured to reflect light radiated from the light source to the document and then reflected from the document; a second traveling body 21*c* which includes a second reflector (not shown) configured to reflect light reflected by the reflector of the first traveling body 21*b*; an imaging lens 21*d* configured to form an image based on light reflected from the second traveling body 21*c*; and a reading sensor 21*e* configured to receive light which has been passed through the imaging lens 21*d* and to read the content of the document.

The automatic document feeding device 22 is located above the reading device 21, and is provided as a opening/closing body which is openable and closable to the reading device 21 and which is rotatably integrated with the reading device 21 using a shaft 26 arranged at the upstream side end portion of the image forming apparatus 100 in the D1 direction.

The automatic document feeding device 22 includes a document table 22*a* on which a document is placed; and a driving portion which is configured to feed the document loaded on the document table 22*a* and includes a motor (not shown). When making a copy using the image forming apparatus 100, a document is set on the document table 22*a* of the automatic document feeding device 22. Alternatively, a document is manually placed on the contact glass 21*a* after upwardly rotating the automatic document feeding device 22, and then the automatic document feeding device 22 is closed to thereby press the document onto the contact glass 21*a*. The opening angle of the automatic document feeding device 22 relative to the reading device 21 is about 90°, which makes easy to place a document on the contact glass 21*a*, and to perform maintenance of the contact glass 21*a*.

Figure 3:
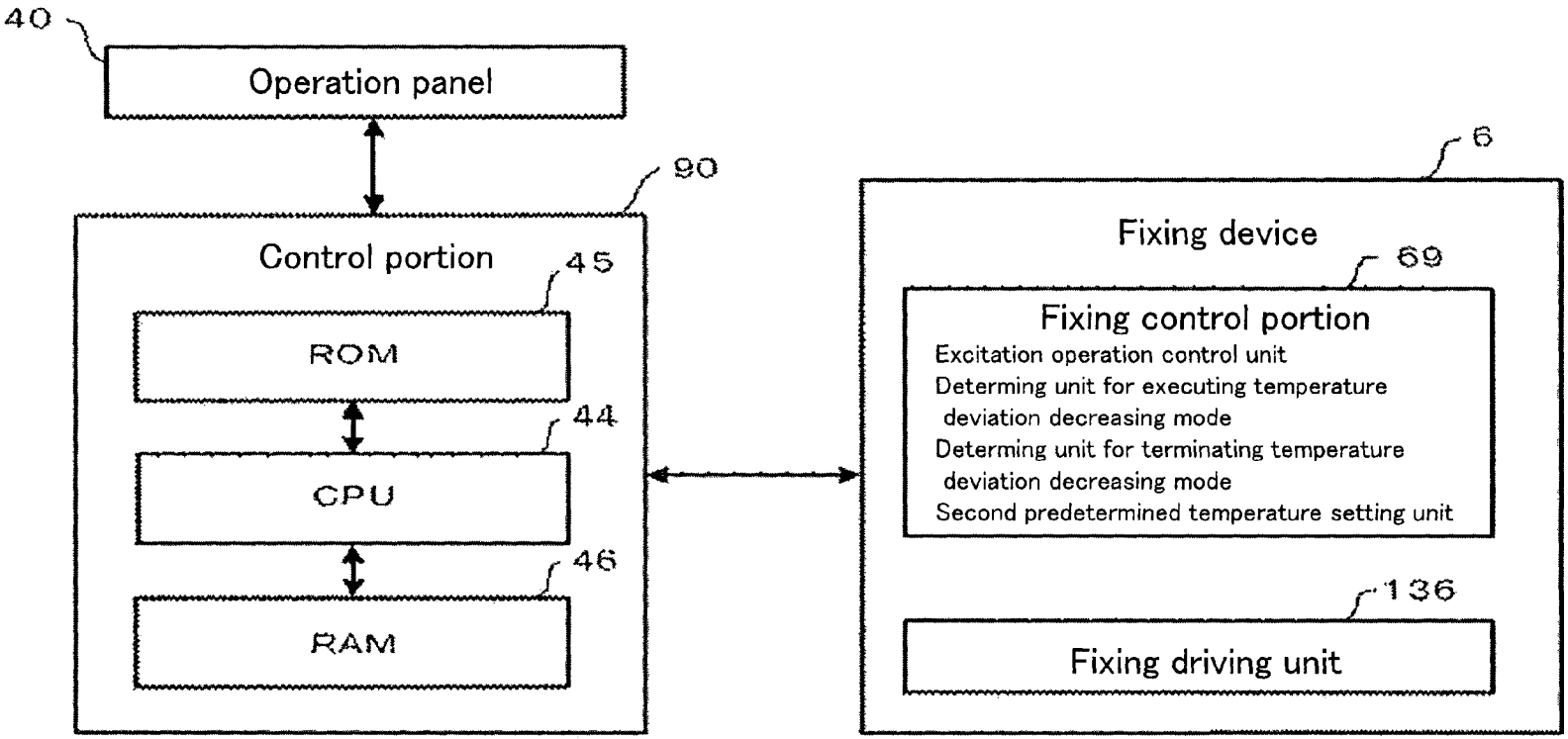
FIG. 3 is a schematic control block diagram of the image forming apparatus illustrated in FIG. 2.

The paper discharging rollers 7 are configured to rotate in forward and reverse directions by controlling with the control portion 90 illustrated in FIG. 3.

The reverse feeding device 14 includes the paper discharging rollers 7; conveying rollers 37 which are arranged between the paper discharging rollers 7 and the fixing device 6, and which are configured to rotate in forward and reverse directions in synchronism with the paper discharging rollers 7 by controlling with the control portion 90; a reverse conveying path 38 through which the transfer paper S is reversely conveyed from the conveying rollers 37 to the pair of registration rollers 13 while bypassing the fixing device 6; and a switching claw 39 which is configured to guide the transfer paper S to the reverse conveying path 38 when the paper discharging rollers 7 and the conveying rollers 37 are reversely rotated.

The sheet feeding device 23 includes two vertically-aligned paper feeding trays 15 in which the transfer paper S is loaded; a paper feeding roller 16 serving as a paper feeding and conveying roller which is configured to convey the transfer paper S from the paper feeding tray 15; and a paper size detecting sensor (not shown) serving as a paper size detecting unit which is configured to detect the size of the transfer paper S loaded in the paper feeding tray 15. The paper feeding trays 15 can load various sizes of the transfer paper S lengthwise or sideways (see, for example, FIG. 5C. In the present embodiment, it is assumed that the paper feeding trays 15 load transfer papers S of different sizes from each other.

Specifically, the upper paper feeding tray 15 loads small-sized (e.g., B5 size) transfer paper S lengthwise, while the lower paper feeding tray 15 loads large-sized (e.g., A3 size) transfer paper S lengthwise. The term "lengthwise" as used herein means a loading manner in which the shorter side of the transfer paper S corresponds to a paper feeding direction which is perpendicular to a main scanning direction. The term "sideways" as used herein means a loading manner in which the longer side of the transfer paper S corresponds to a paper feeding direction. Herein, when the transfer paper S is loaded and fed lengthwise, reference characters which denote a paper size (e.g., B5 or A3) are followed by a capital "L" (e.g., "B5-L" means that the B5 size transfer paper S is loaded and fed lengthwise or "A3-L" means that the A3 size transfer paper S is loaded and fed lengthwise). Similarly, when the transfer paper S is loaded and fed sideways, reference characters which denote a paper size are followed by a capital "S".

The maximum size and the minimum size of the transfer paper S which each paper feeding tray 15 can load are a size equal to or slightly larger than A3-L size, and postcard-L size, respectively. These sizes are determined based on the maximum sized image which can be formed by the image forming apparatus 100 and generally required image forming sizes. A direction which is perpendicular to a paper feeding direction is a width direction of the transfer paper S, that is, a paper-width direction X (see FIG. 5C), which corresponds to the main scanning direction.

The transfer paper S is loaded in paper feeding trays 15 in a center alignment because the toner image is borne on the photoconductor drums 20BK, 20Y, 20M, 20C and the transfer belt 11 in a center alignment. Therefore, the transfer paper S is constantly conveyed in a center alignment from the sheet feeding device 23 to the paper discharging tray 17. For example, the transfer paper S enters the fixing device 6 in a center alignment. The term "a center alignment" as used herein means that a center of the transfer paper S in the paper width direction X corresponds to a center of the toner image bearing area (image forming area) of the photoconductor drums 20BK, 20Y, 20M, 20C and the transfer belt 11 in the paper width direction X. There is another type of alignment, an edge alignment, which means that one side edge of the transfer paper S in the paper width direction X corresponds to a side edge of the image forming area. However, in the present embodiment, the edge alignment is not employed.

A paper size detecting sensor has any known configuration, and is configured to detect a size and orientation (i.e., lengthwise or sideways) of the transfer paper S. Notably, instead of or in addition to the paper size detecting sensor provided in the paper feeding trays 15, the following may be used: a paper size selection key provided in a operation panel 40; or a paper size selection function for selecting the size of paper on which an image is to be formed installed in an external input device such as a personal computer connected to the image forming apparatus 100.

The manual paper feeding device 41 includes a manual paper feeding tray 42 in which the transfer paper S is loaded; a feeding roller 43 (paper feeding roller) which contacts with a top surface of the uppermost sheet of the transfer paper S loaded on the manual paper feeding tray 42; and a paper sensor which is configured to detect the presence and size of the transfer paper S on the manual paper feeding tray 42 and which has a configuration similar to that of the paper size detecting sensors provided in the paper feeding trays 15. Similarly to the paper feeding trays 15, the maximum size and the minimum size of the transfer paper S which each the manual paper feeding tray 42 can load are a size equal to or slightly larger than A3-L size, and postcard-L size, respectively.

The manual paper feeding device 41 has a configuration in which the feeding roller 43 is driven to be rotated in a clockwise direction in the figure to thereby guide the uppermost sheet of the transfer paper S into the reverse transport path 38 located on the main body 99 side and feed the sheet toward the registration roller 13. Then, the transfer paper S abuts the registration rollers 13 to thereby stop. The manual paper feeding device 41 is mainly used for feeding paper having the size which is different from that of the transfer papers S loaded in the paper feeding trays 15 (e.g., B5-L transfer paper S).

Figure 4:
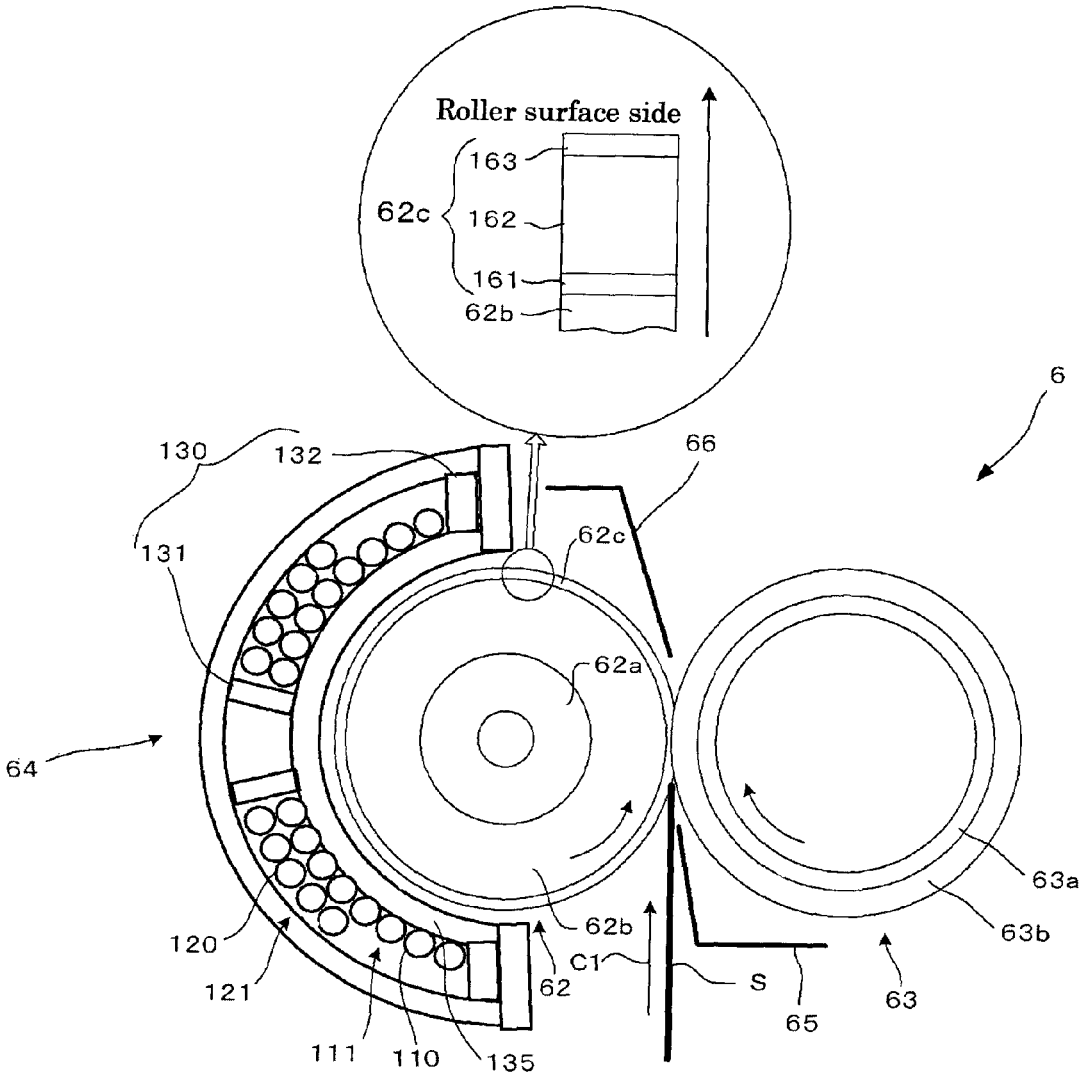
FIG. 4 is a schematic cross-sectional diagram illustrating a fixing device included in the image forming apparatus illustrated in FIG. 2.

As illustrated in FIG. 4, a fixing device 6 includes a fixing roller 62 serving as a rotary heat generator that heats the transfer paper S (recording medium) and the image formed thereon; a pressure roller 63 which is a rotary pressurizer serving as a pressurizing member configured to be pressed against the fixing roller 62, and convey the transfer paper S while sandwiching the transfer paper S with the fixing roller 62; and a heating device 64 serving as an electromagnetic induction heating unit (induction heating portion) which is arranged so as to face the fixing roller 62 and which can function as a heating unit for heating the fixing roller 62 through an electromagnetic induction heating system.

The fixing unit 6 also includes a guide plate 65 configured to guide the transfer paper S on which a toner image is borne to a fixing portion (nip portion) serving as a fixing nip at which the fixing roller 62 is pressed against the pressure roller 63; and a separation plate 66 configured to separate from both of the fixing roller 62 and the pressure roller 63 the transfer paper S on which toner image has been fixed by the action of heat and pressure, and then guide the transfer paper S to outside of the fixing unit 6.

The fixing device 6 also includes, as illustrated in FIG. 5B, a thermopile serving as a first temperature detecting sensor 67 which is arranged so as to correspond to the central portion of the fixing roller 62 and which is configured to detect a surface temperature of the central portion of the fixing rollers 62 in a non-contact manner; and a thermistor serving as a second temperature detecting sensor 68 which is configured to detect a surface temperature of an end portion of the fixing rollers 62 in a contact manner; and as illustrated in FIG. 3, a fixing control portion 69 serving as a fixing control unit which is configured to control the whole fixing device 6; and a fixing driving unit 136 which include a driving source such as a motor for driving the pressure roller 63 to be rotated and which is controlled by the fixing control portion 69.

In the present embodiment, a configuration illustrated in FIG. 3 is employed in which signals are delivered between the fixing control portion 69 of the fixing device 6 and the control portion 90 of the image forming apparatus 100. However, a configuration may be employed in which the control portion 90 of the image forming apparatus 100 also serves as the fixing control portion 69.

The first temperature detecting sensor 67 may be a contact type thermistor. The second temperature detecting sensor 68 may be a non-contact type thermistor or thermopile. The second temperature detecting sensor 68 is located outside of a paper feeding area corresponding to the paper which has the maximum width capable of being fed to the fixing device 6. However, it may be located at an end position of the fixing roller corresponding to a position at which a degaussing coil is placed.

As illustrated in FIG. 4, the fixing roller 62 includes an innermost cylindrical metal core 62*a* which is made of metal, in particular SUS (stainless steel); an elastic member 62*b* (elastic layer) serving as a heat insulation layer which is formed by coating the metal core 62*a* with heat-resistant solid or foamed (spongy) silicone rubber; and a fixing sleeve 62*c* serving as a rotary heat generator which is located outside of the elastic member 62*b*.

The fixing roller 62 has an external diameter of about 40 mm. The metal core 62*a* may be made of other metal materials such as iron. The elastic member 62*b* has a thickness of about 9 mm and Asker hardness of 30 degrees to 50 degrees. The metal core 62*a* and the elastic member 62*b* contact with an inner peripheral surface of the fixing sleeve 62*c* to thereby serve as a holder for holding the thin fixing sleeve 62*c* in a roll shape. The fixing sleeve 62 is relatively rotatable to the elastic member 62*b*. Notably, both of the metal core 62*a* and the elastic member 62*b* are rotatable, so that they can be rotated accompanied with the fixing sleeve 62*c* when the fixing sleeve 62*c* rotates.

Alternatively, the fixing sleeve 62*c* and the elastic member 62*b* may be bonded together so that the fixing sleeve 62*c* and the elastic member 62*b* integrally rotate.

The fixing sleeve 62*c* includes a base layer 161 which is made of a metal material, an elastic layer 162, and a release layer 163 which is a surface layer in this order from inside; and has an external diameter of 40 mm.

The base layer 161 is made of a magnetic metal material such as iron, cobalt, nickel, and an alloy thereof, and has a thickness of 30 μm to 50 μm. The base layer 161 serves as a heat generating layer which generates heat by magnetic flux generated by the heating device 64.

The elastic layer 162 is made of an elastic material such as silicone rubber, and has a thickness of 150 μm. This configuration has a low heat capacity, and thus a good fixed image can be attained without fixing unevenness.

The release layer 163 is provided to improve releasability of a toner from a surface of the fixing sleeve 62*c* which directly contacts with the toner on the transfer paper S; is formed by coating the elastic layer 162 with a fluorine compound such as PFA so as to be a tube shape; and has a thickness of 50 μm.

The pressure roller 63 has an external diameter of 40 mm, and includes a metal core 63*a* which is a cylindrical member made of a high thermoconductive metal material, in particular copper; an elastic member 63*b* which constitutes a heat-resistant elastic layer and is provided on a surface of the metal core 63*a*; and a release layer (not shown) which is provided on the elastic layer 63*b* and has a high toner releasability. The metal core 63*a* may be made of, for example, aluminium.

The elastic layer 63*b* has a thickness of 2 mm. The release layer is formed by coating the elastic member 63*b* with PFA in a tube shape and has a thickness of 50 μm.

An axial direction of the fixing roller 62 and the pressure roller 63, which is a horizontal direction in FIG. 4, in other words, an extension direction of the fixing roller 62 and the pressure roller 63 corresponds to the paper width direction X.

The heating device 64 includes an exciting coil 110 configured to generate a magnetic flux which inductively heats the base layer 161 (heat generating layer), a degaussing coil 120 which can generate a magnetic flux in the direction which cancels the magnetic flux generated by the exciting coils 110 and which partially cancels the magnetic flux generated by the exciting coils 110 when the magnetic flux in such direction is generated; a core portion 130 disposed to correspond to the exciting coil 110 and the degaussing coil 120; and a coil guide 135 serving as a coil housing which is disposed to partially cover an outer peripheral surface of the fixing sleeve 62*c* and which contains the exciting coil 110, the degaussing coil 120, and the core portion 130.

The exciting coil 110 is formed by winding Litz wire, which is made by twisting thin wires together, around the coil guide 135 and extends in the paper width direction X which is a direction perpendicular to a surface of paper on which FIG. 4 is drawn.

The heating device 64 generates a magnetic flux in the proximity to the fixing roller 62 by applying from a power supply to the exciting coil 110 a high-frequency alternating current of 10 kHz to 1 MHz, preferably 20 kHz to 800 kHz.

When the control circuit of the fixing control portion 69 serving as an excitation operation control unit supplies electricity (applies current) from a commercial power source to the exciting coil 110, lines of magnetic forces are bidirectionally outputted in an alternative manner to a space facing the exciting coil 110 to thereby form an alternate magnetic field. The alternate magnetic field generates eddy current in the base layer 161, and then electrical resistance in the base layer 161 generates Joule heat, which heats the fixing sleeve 62*c*. Thus, the fixing sleeve 62*c* is heated by induction heating of its own base layer 161.

The degaussing coil 120 are provided so as to suppress the fixing roller 62 in the non-paper feeding portion from increasing in temperature by canceling the magnetic flux which acts on an area where the transfer paper S is not fed (non-paper feeding portion) among magnetic fluxes generated by the exciting coil 110. Therefore, the degaussing coils 120 are symmetrically arranged about a center line in the paper width direction X indicated by O1 in FIG. 5 so as to overlap the exciting coil 110. Notably, in FIGS. 5, A and C are drawings of the exciting coil 110 and the degaussing coil 120 viewed in a direction indicated by arrow A in FIG. 4, and B is a drawing of the fixing roller 62 and the pressure roller 63 viewed in a direction indicated by arrow B in FIG. 4.

As illustrated in FIG. 5A, the degaussing coil 120 includes three degaussing coils 120*a*, 120*b*, and 120*c* to correspond to various widths of the transfer paper S in paper width direction X. The degaussing coils 120*a*, 120*b*, and 120*c* are symmetrically arranged about a center line O1 in the paper width direction X, and form a circuit in which each of one end of Litz wires is connected via a lead (not shown), each of the other end of the Litz wires can be connected via switches 122*a*, 122*b*, or 122*c*, and opened and closed by the switches (relay switches) 122*a*, 122*b*, or 122*c*.

Although three degaussing coils 120 are arranged on each side of the fixing roller (i.e., six degaussing coils in total are arranged) in this figure, the number of the degaussing coils is not particularly limited to three. For example, one (two in total) or two (four in total) degaussing coil(s) may be arranged on each side of the fixing roller.

The switches 122*a*, 122*b*, and 122*c* is opened and closed (driven) by a control circuit of the fixing control portion 69. The switches 122*a*, 122*b*, and 122*c* can be independently opened and closed. The control circuit of the fixing control portion 69 serves as a degaussing operation control unit configured to control on/off of the switches of the degaussing coils 120*a*, 120*b*, and 120*c*. As illustrated in this figure, the degaussing unit 121 includes the degaussing coils 120*a*, 120*b*, and 120*c*, as well as the fixing control portion 69 serving as a degaussing operation control unit and the switches 122*a*, 122*b*, and 122*c*.

The demagnetization unit 121 does not include a power source for generating a magnetic flux in a direction which cancels a magnetic flux generated by the exciting coil 110. However, when current is applied to the exciting coil 110 in a state in which the switches 122*a*, 122*b*, and 122*c* are closed (shorted), each of the degaussing coils 120*a*, 120*b*, 120*c* generates the magnetic flux in a direction which cancels the magnetic flux generated by the exciting coil 110 by secondary induction.

Thus, although the power source does not directly apply current to the degaussing coil 120, turning on the degaussing coil 120, as used herein, means "applying current to the degaussing coil 120".

As illustrated in FIG. 4, the core portion 130 is formed of a ferromagnetic material such as ferrite having a relative permeability of about 2500, and includes a center core 131 and side cores 132 for efficiently forming a magnetic flux toward the fixing sleeve 62*c*. The coil guide 135 is made of a resin material having a high heat-resistance, and holds the exciting coil 110 and the degaussing coil 120.

The fixing driving unit 136 drives the pressure roller 63 to be rotated in a clockwise direction in FIG. 4, which allows the fixing sleeve 62*c* being in contact with the pressure roller 63 to be rotated together counter-clockwise. When current is applied to the exciting coil of the exciting unit 111 in a state in which the fixing sleeve 62*c* is being rotated, the fixing sleeve 62*c* is mainly electromagnetic inductively heated at an area facing the exciting coil 110 and its surrounding area. Thus, the fixing sleeve 62*c* is uniformly heated in its peripheral direction accompanied with the rotation thereof.

The fixing roller 62 may be connected with the pressure roller 63 via a gear so as to transmit driving force of the pressure roller 63 to the fixing roller 62 to thereby rotate the fixing roller 62 together with the pressure roller 63.

The temperature detecting sensor 67 is mainly used for controlling application of current to the exciting coil 110. The temperature detecting sensor 68 is mainly used for controlling on/off of the switches of the degaussing coil 120. The temperature detecting sensor 67 is disposed at a position through which all sizes of the transfer paper S are passed (herein a central portion of the fixing roller 62 in a longitudinal direction).

The temperature detecting sensor 68 is disposed at a position through which the transfer paper S is not passed even when the transfer paper S having a size equal to or larger than that of A3-L paper is fed, that is, outside of the paper feeding portion of the maximum size of paper or a position whish is always in non-paper feeding portion (herein a side-end portion at one end of the fixing roller 62 in a longitudinal direction). The temperature detected by the temperature detecting sensor 67 and the temperature detecting sensor 68 is inputted to the fixing control portion 69 to thereby control the temperature of the fixing roller 62 through feedback control based on a predetermined reference temperature such as a first predetermined temperature (target temperature during controlling) and a target fixing temperature.

In the fixing device 6, when the transfer paper S on which a toner image (transferred image) is borne is conveyed in the C1 direction and enter the fixing device 6, the guide plate 65 guides the transfer paper S to the fixing portion. The toner on the transfer paper S is heat-melted by the fixing roller 62 which has been heated by the exciting unit 111 to a temperature suitable for fixing, and the toner image is transferred onto the transfer paper S by the action of pressure between the fixing roller 62 and the pressure roller 63. The transfer paper S having the fixed toner image thereon is conveyed from the nip portion while being separated by the separation plate 66 from the fixing roller 62 accompanied with the rotation of the fixing roller 62 and the pressure roller 63.

The fixing sleeve 62*c* which has been passed through the fixing portion by rotation decreases in temperature by endothermic action of the transfer paper S and the toner during the fixing step. However, when the temperature detecting sensor 67 detects a decrease in temperature, current is applied to the exciting coil 110 and the fixing sleeve is heated again to the temperature suitable for fixing while passing through an area facing the exciting coil 110 to which current is being applied.

Such a decrease in temperature of the fixing roller 62 is caused mainly in the paper feeding portion. Therefore, in the case where the width of the transfer paper S is smaller than that of A3-L or A4-S size paper, the end portions of the fixing roller 62 may be overheated when current is applied to the exciting coil 110 based on the temperature detected by the temperature detecting sensor 67.

Therefore, when the temperature detecting sensor 68 detects the temperature higher than the predetermined temperature, the switches of the degaussing coil 120 are selectively turned on to thereby suppress heat from being generated in the end portions of the fixing roller 62. Thus, overheating can be prevented.

The fixing device 6 will be more fully explained below.

The image station 60BK provided with the photoconductor drum 20BK includes, around the photoconductor drum 20BK and along the rotation direction thereof B1 which is a clockwise direction in the figure, the primary transfer roller 12BK; the cleaning device 70BK serving as the cleaning unit which is configured to clean the photoconductor drum 20BK; the charging device (charger) 30BK serving as the charging unit which is configured to charge the photoconductor drum 20BK to high pressure; a developing device 50BK serving as the developing unit which is configured to develop the photoconductor drum 20Y. The developing device 50BK includes the developing roller 51BK. The photoconductor drums 20Y, 20M, and 20C have a similar configuration to the photoconductor drum 20BK.

Although not shown in figures, the operation panel 40 includes a simplex printing key which is used to instruct forming an image on only one side of the transfer paper S by the image forming apparatus 100, a duplex printing key which is used to instruct forming an image on both sides of the transfer paper S by the image forming apparatus 100, ten-key which is used to designate the number of image formation, a print start key which is used to instruct starting image formation, a paper size selecting key which is used to select the size of the transfer paper S on which an image is to be formed.

The controller 90 includes a CPU 44; a ROM 45 serving as a first storage unit which is configured to store operation programs of the image forming apparatus 100 and various data required for those operation programs; and a RAM 46 serving as a second storage unit which is configured to store data required for operations of the image forming apparatus 100. The size of the transfer paper S detected by the paper size detecting sensors in the paper feeding trays 15 is inputted to the control portion 90 and further inputted to the fixing control portion 69 via the control portion 90, followed by being recognized by the fixing control portion 69 to thereby be used for controlling.

Figure 6:
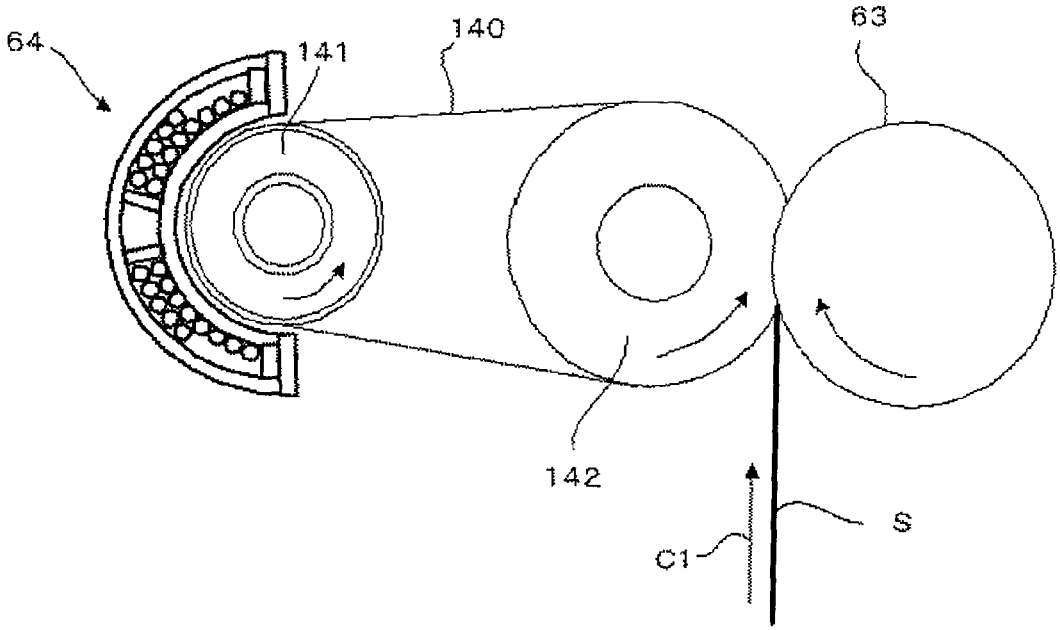
FIG. 6 is a schematic cross-sectional diagram illustrating another fixing device included in the image forming apparatus illustrated in FIG. 2.

The rotary heat generator may be the above-described fixing roller or fixing sleeve, a fixing belt which generates heat, or a heating roller around which the fixing belt is wound and which heats the fixing belt. For example, as illustrated in FIG. 6, the following configuration may be employed in which the fixing heating belt 140 which is a heat generating fixing belt is used as the rotary heat generator, and the fixing heating belt 140 is stretched between the support roller 141 and the fixing rotator 142 to thereby rotary drive them.

Figure 7:
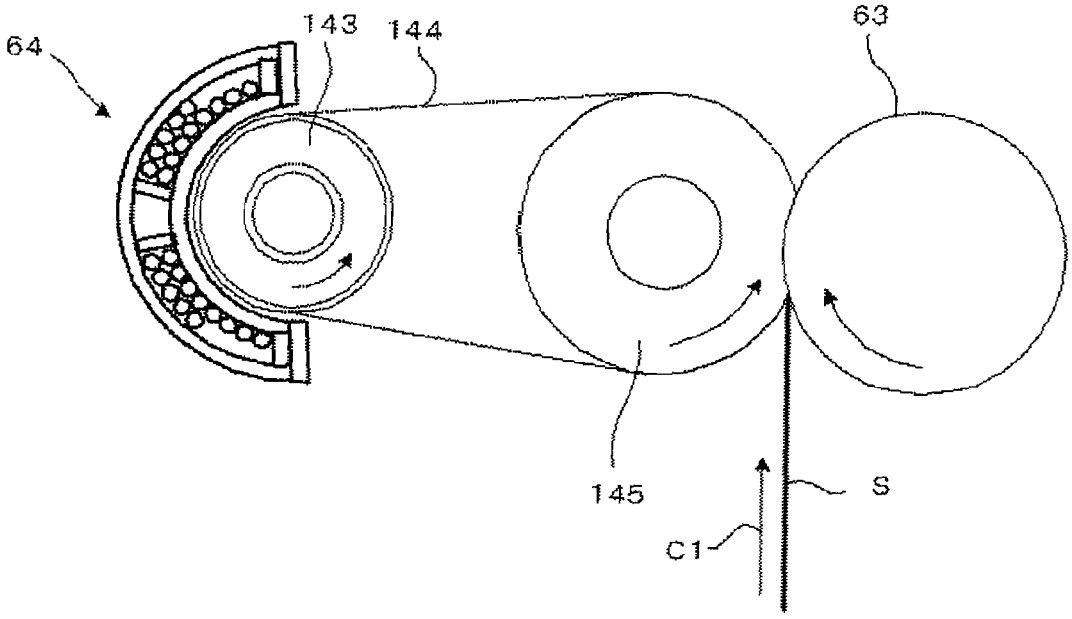
FIG. 7 is a schematic cross-sectional diagram illustrating another fixing device included in the image forming apparatus illustrated in FIG. 2.

As illustrated in FIG. 7, the rotary heat generator may be used in which the fixing belt 144 is stretched between the heating roller 143 and the fixing rotator 145 so as to deliver heat from the heating roller 143 to the transfer paper S via the fixing belt 144.

Figure 8:
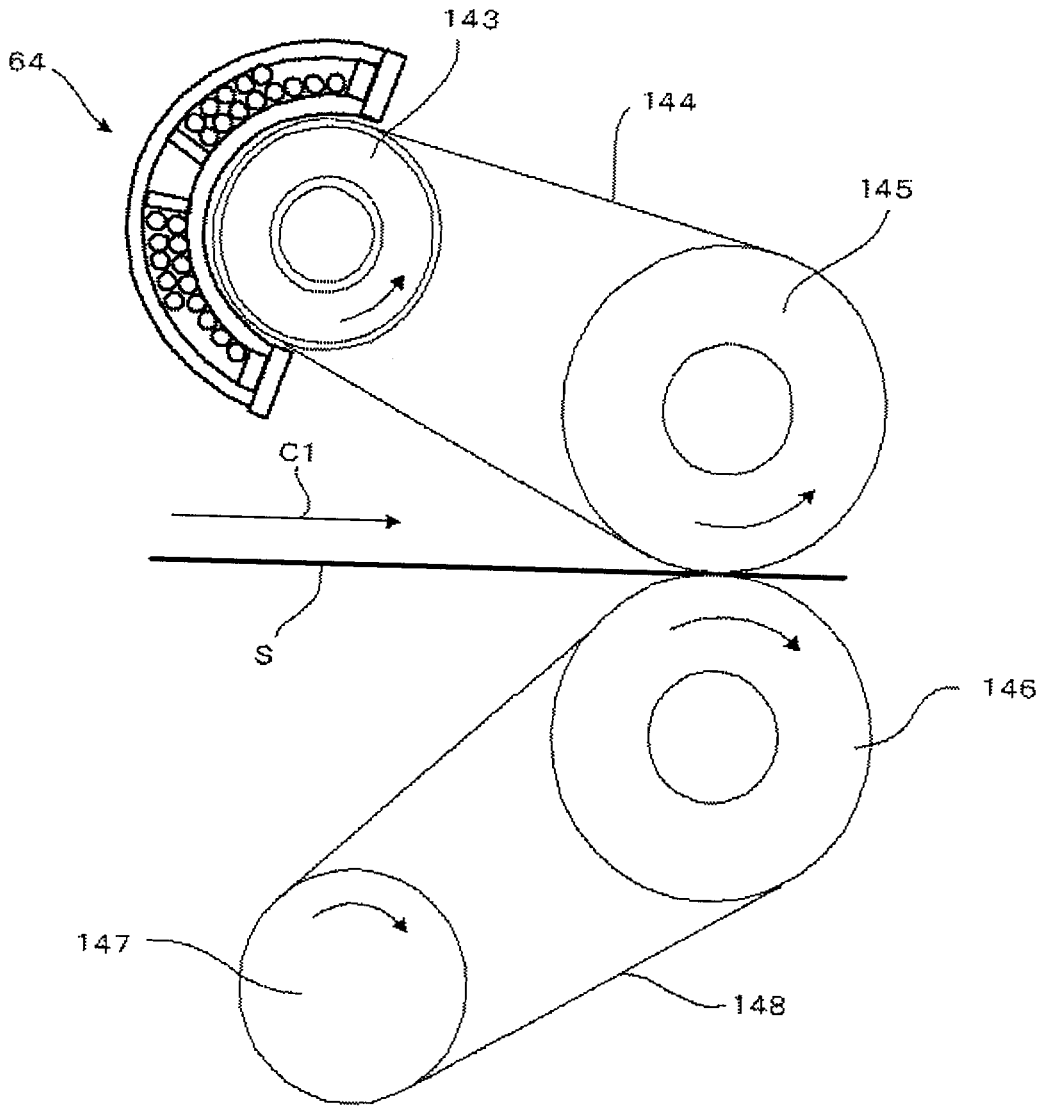
FIG. 8 is a schematic cross-sectional diagram illustrating of another fixing device included in the image forming apparatus illustrated in FIG. 2.

A modification of pressure rotator is illustrated in FIG. 8. The following configuration may be employed in which the pressure roller 63 in the fixing device illustrated in FIG. 7 is modified so that the pressure belt 148 is stretched between the pressure support roller 146 and the support roller 147.

Figure 9:
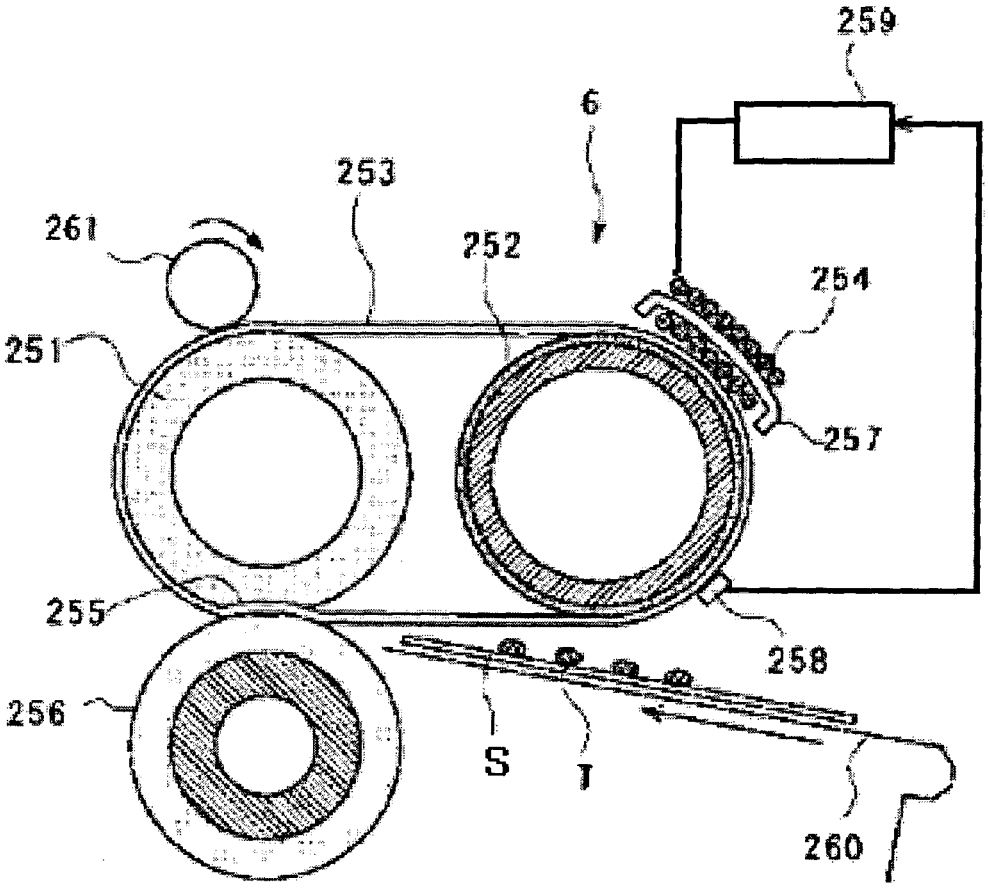
FIG. 9 is a schematic cross-sectional diagram illustrating another fixing device included in the image forming apparatus illustrated in FIG. 2.

Another example of the fixing device 6 is illustrated in FIG. 9. The fixing device 6 illustrated in FIG. 9 includes the fixing roller 251; the opposed roller (heating roller) 252 which is arranged in parallel to the fixing roller 251 and made of a non-magnetic material; the fixing belt (rotary heat generator) 253 serving as an endless travelling member which is stretched between the fixing roller 251 and the opposed roller 252 and which contains a magnetic material therein; the induction coil (exciting coil) 254 serving as an electromagnetic-wave generating unit which is arranged lateral to the opposed-roller 252; and the pressure roller 256 which presses the fixing roller 251 via the fixing belt 253 to thereby form the nip portion 255 on the fixing belt 253.

The induction coil 254 serving as the electromagnetic-wave generating unit, in the present embodiment, (electromagnetic) inductively heats the fixing belt 253 and is used as the (electromagnetic) induction heat generator. The fixing roller 251 has an external diameter of 40 mm, and includes a heat insulating layer such as silicone rubber (including spongy silicone rubber) on the outside of the metal core of, for example, aluminium or iron. The metal core of the opposed roller 252 is made of non-magnetic materials such as aluminium or SUS. The pressure roller 256 has a heat-resistant elastic layer of, for example, silicone rubber formed on the outer peripheral surface of the metal core, and further has a surface release layer of, for example, fluoro resin formed on the outer peripheral surface of the heat-resistant elastic layer. The surface hardness of the pressure roller 256 is higher than that of the fixing roller 251 for improving releasability of the transfer paper S from the fixing roller 253.

The induction coil 254 is wound around the exciting core 257 which is made of ferrite or permalloy and which has a roughly concave cross section. When high-frequency current of several kHz to several hundreds kHz is applied to the induction coil 254, the induction current is generated in the fixing belt 253. The induction current allows the fixing belt 253 to locally generate heat in the proximity to the induction coil 254, leading to temperature increase. Also, the following are also included: the temperature sensor 258 configured to detect the temperature of the electromagnetic-induction heated fixing belt 253, and the control device 259 configured to receive detecting signals from the temperature sensor 258 and control the high-frequency current to be applied to the induction coil 254.

Further, the guide plate 260 which is configured to convey the transfer paper S to the fixing device 6 is provided below the opposed-roller 252.

An unfixed toner T is adhered to the surface of the transfer paper S.

The belt cleaning roller 261 is provided on the outer peripheral surface of the fixing belt 253 so as to contact with each other.

EXAMPLES

Examples of the present invention now will be explained, but the scope of the present invention is not limited thereto. In the following Examples, "part(s)" means "part(s) by mass" and "%" means "% by mass", unless otherwise specified.

(Measurements)

Measurements in Examples are performed as follows. Results are shown in Tables 4-1, 4-2, 9-1, and 9-2.

<Preparation of Tetrahydrofuran (THF) Soluble Content>

A tetrahydrofuran (THF) soluble content of a toner was obtained as follows. The toner (30 mg) was added to 20 mL of tetrahydrofuran (THF) (containing a stabilizer, product of Wako Pure Chemical Industries, Ltd.) and stirred for 1 hour, followed by filtering through a 0.2 μm filter.

<Molecular Weight Distribution>

A molecular weight distribution of the THF soluble content of the toner was measured using a gel permeation chromatography (GPC) measuring apparatus (HLC-8220 GPC, product of Tosoh Corporation). As a column, TSK-GEL SUPER HZM-H 15 cm in triplicate (product of Tosoh Corporation) was used. The tetrahydrofuran soluble content of the toner, which was used as a measurement sample, was prepared as described above, and formed a 0.15% by mass solution thereof. The 0.15% by mass solution was filtered through a 0.2 μm filter and a filtrate thereof was used as a sample. The sample (100 μL) was injected to the measuring apparatus, and measured at a flow rate of 0.35 mL/min under an environment of 40° C.

The molecular weight of the sample was calculated using a calibration curve drawn from monodispersed polystyrene standard samples. As the monodispersed polystyrene standard samples, SHOWDEX STANDARD series (product of Showa Denko K.K.) and toluene were used. Solutions of the following 3 types of monodispersed polystyrene standard samples in THF were prepared and measured under the above conditions, and a calibration curve was drawn with a retention time of peak top as a light scattering molecular weight of the monodispersed polystyrene standard samples. A RI (refractive index) detector was used as a detector.

Solution A: S-7450 2.5 mg, S-678 2.5 mg, S-46.5 2.5 mg, S-2.90 2.5 mg, THF: 50 mL Solution B: S-3730 2.5 mg, S-257 2.5 mg, S-19.8 2.5 mg, S-0.580 2.5 mg, THF: 50 mL Solution C: S-1470 2.5 mg, S-112 2.5 mg, 5-6.93 2.5 mg, toluene 2.5 mg, THF: 50 mL <Content of N Element>

The content of N element was determined as follows.

The above-prepared THF soluble content of the toner was used as a measurement sample.

The content of N element was determined as an average value of 2 measurement values of CHN simultaneous measurement under conditions of a combustion furnace of 950° C., a reduction furnace of 550° C., a helium flow rate of 200 mL/min and an oxygen flow rate of 25 mL/min to 30 mL/min using VARIO MICRO CUBE (product of Elementar Analytical). Notably, when the content of N element obtained by this measurement method was less than 0.5% by mass, a further measurement was conducted using a trace nitrogen analyzer ND-100 (product of Mitsubishi Chemical Corporation). An electric furnace (horizontal reactor) had temperatures in a thermal decomposition part of 800° C. and in a catalytic part of 900° C. The measurement was performed under the following conditions: main $O_2$ flow rate: 300 mL/min, $O_2$ flow rate: 300 mL/min, Ar flow rate: 400 mL/min, and sensitivity: Low. The content of N element was determined using a calibration curve drawn with pyridine standard solutions.

<Amount of Crystalline Structure [C/(A+C)]>

The amount of crystalline structure [C/(A+C)] was measured by an X-ray diffraction measurement as follows.

The X-ray diffraction measurement was performed using an X-ray diffractometer equipped with a 2-dimensional detector (D8 DISCOVER with GADDS, product of Bruker Corporation).

As a capillary for the measurement, a mark tube (Lindemann glass) having a diameter of 0.70 mm was used. This capillary tube for the measurement was filled up with a sample (toner) with being tapped. The number of tapping was 100. Measurement conditions are described in detail below.

Tube current: 40 mA

Tube voltage: 40 kV

Goniometer 2θ axis: 20.0000°

Goniometer Ω axis: 0.0000°:

Goniometer φ axis: 0.0000°:

Detector distance: 15 cm (wide angle measurement)

Measuring range: 3.2≤2θ(°)≤37.2

Measurement time: 600 sec

A collimator having a pinhole with a diameter of 1 mm was used for an incident optical system. Obtained 2-dimensional data was integrated with a supplied software (at 3.2° to 37.2° in the x-axis) and converted to a 1-dimensional data of a diffraction intensity and 2θ.

A method for calculating the ratio [C/(A+C)] based on the obtained X-ray diffraction measurement results will be explained below. An example of a diffraction spectrum obtained by an X-ray diffraction measurement is illustrated in FIG. 1A and FIG. 1B. The horizontal axis represents 2θ, the vertical axis represents the X-ray diffraction intensity, and both of them are linear axes. In the X-ray diffraction spectrum illustrated in FIG. 1A, there are main peaks at 2θ=21.3° (P1) and 24.2° (P2), halos (h) are observed in a wide range including these two peaks. Here, the main peaks are derived from a crystalline structure of a binder resin, and the halos are derived from a non-crystalline structure.

These two main peaks and halos were expressed by a Gaussian functions:

$$f_{p1}(2\theta)=a_{p1}\exp\{-(2\theta-b_{p1})^2/(2c_{p1}^2)\} \quad \text{Equation A (1)}$$

$$f_{p2}(2\theta)=a_{p2}\exp\{-(2\theta-b_{p2})^2/(2c_{p2}^2)\} \quad \text{Equation A (2)}$$

$$f_h(2\theta)=a_h\exp\{-(2\theta-b_h)^2/(2c_h^2)\} \quad \text{Equation A (3)}$$

where $f_{p1}(2\theta)$, $f_{p2}(2\theta)$, and $f_h(2\theta)$ denote functions corresponding to the main peak P1, the main peak P2 and halos, respectively.

A sum of these functions:

$$f(2\theta)=f_p i(2\theta)+f_{p2}(2\theta)+f_h(2\theta) \quad \text{Equation A (4)}$$

was regarded as a fitting function of the overall X-ray diffraction spectrum (illustrated in FIG. 1B), which was fitted with a least square method.

There were 9 fitting variables: $a_{p1}$, $b_{p1}$, $c_{p1}$, $a_{p2}$, $b_{p2}$, $c_{p2}$, $a_h$, $b_h$ and $c_h$. As initial values of these fitting variable, peak positions of the X-ray diffraction were set for $b_{p1}$, $b_{p2}$ and $b_h$ (in the example of FIG. 1A, $b_{p1}$=21.3, $b_{p2}$=24.2, and $b_h$=22.5), and appropriate values were input for the other variables so that the two main peaks and halos coincide as much as possible with the X-ray diffraction spectrum. The fitting was carried out using SOLVER of Excel 2003 (product of Microsoft Corporation).

From the integrated areas ($S_{p1}$, $S_{p2}$, $S_h$) of the Gaussian functions $f_{p1}(2\theta)$, $f_{p2}(2\theta)$ corresponding to the two main peaks (P1, P2) and Gaussian function $f_h(2\theta)$ corresponding to the halos after fitting, the ratio [C/(A+C)] as an index indicating the amount of the crystallization site was calculated, assuming ($S_{p1}$+$S_{p2}$) was (C) and ($S_h$) was (A).

<Mixed Solution-Insoluble Content>

The mixed solution-insoluble content was obtained as follows. A toner (0.4 g) was added to a mixed solution of tetrahydrofuran (THF) and ethyl acetate (mixing ratio: 50:50 on a mass basis) (40 g), and shaken and mixed for 20 min, followed by allowing an insoluble content to be precipitated by a centrifuge, removing a supernatant, and vacuum drying the remaining.

<Ratio [ΔH(H)/ΔH(T)]>

The ratio [ΔH(H)/ΔH(T)] was determined from an endothermic amount [ΔH(T), (J/g)] in the differential scanning calorimetry of the toner and an endothermic amount [ΔH(H), (J/g)] in the differential scanning calorimetry of the mixed solution insoluble content in the toner.

Measurement conditions in the differential scanning calorimetry were as follows.

Measurements were performed with a DSC system (differential scanning calorimeter) (DSC-60, product of Shimadzu Corporation). Using the analysis program "endothermic peak temperature" in the DSC-60 system, a DSC curve in the second heating was selected from DSC curves obtained by measuring under the following measurement conditions, an endothermic amount in the second heating was determined.

[Measurement Conditions]

Sample vessel: aluminum sample pan (with lid)
Sample amount: 5 mg
Reference: aluminum sample pan (10 mg of alumina)
Atmosphere: nitrogen (flow rate: 50 mL/min)
Temperature conditions:
Starting temperature: 20° C.
Heating rate: 10° C./min
End temperature: 150° C.
Retention time: none
Cooling rate: 10° C./min
End temperature: −20° C.
Retention time: none
Heating rate: 10° C./min
End temperature: 150° C.

The softening temperature of a toner was measured by means of an elevated flow tester (CFT-500D, product of Shimadzu Corporation). The toner (1 g), which was used as a sample, was heated at the heating rate of 3° C./min., and at the same time, a load of 2.94 MPa was applied by a plunger to extrude the sample from a nozzle having a diameter of 0.5 mm and length of 1 mm, during which a amount of descent of the plunger of the flow tester was plotted versus the temperature. The temperature at which half of the sample was flown out was determined as a softening temperature of the sample.

<Maximum Peak Temperature and Amount of Heat of Fusion>

The maximum peak temperature and amount of heat of fusion were measured using a differential scanning calorimeter (DSC) (TA-60WS and DSC-60 (product of Shimadzu Corporation)). First, a sample to be measured for the maximum peak temperature of the heat of fusion was heated from 20° C. to 150° C. at a heating rate of 10° C./min, then cooled to 0° C. at a cooling rate of 10° C./min and then heated again at a heating rate of 10° C./min to measure a change in an endothermic or exothermic amount. The "endothermic or exothermic amount" was plotted against the "temperature", and a temperature corresponding to the maximum peak of the endothermic amount was determined as the maximum peak temperature of the heat of fusion in the second heating. Also, an endothermic amount of the endothermic peak having the above maximum peak temperature was determined as an amount of heat of fusion in the second heating.

<T1 and T2>

The maximum endothermic peak temperature in the second heating (T1) and the maximum exothermic peak temperature in the first cooling (T2) in a range of 0° C. to 150° C. in the differential scanning calorimetry were measured as follows.

The measurement was performed using a differential scanning calorimeter (DSC) (TA-60WS and DSC-60 (product of Shimadzu Corporation)). First, a sample to be measured was heated from 20° C. to 150° C. at a heating rate of 10° C./min, then cooled to −20° C. at a cooling rate of 10° C./min and then heated again to 150° C. at a heating rate of 10° C./min to measure a change in an endothermic or exothermic amount in the second heating and in the first cooling. The "endothermic or exothermic amount" was plotted against the "temperature", and a temperature corresponding to the maximum peak of the endothermic amount in the second heating was determined as the maximum endothermic peak temperature in the second heating (T1). Also, a temperature corresponding to the maximum peak of the exothermic amount in the first cooling was determined as the maximum exothermic peak temperature in the first cooling (T2).

Production Examples A1-1 to A1-12

<Production of Crystalline Resins CH-1 to CH-8 and Crystalline Resins CL-1 to CL-4>

A reaction tank equipped with a condenser, a stirrer, and a nitrogen inlet tube was charged with each of the acid ingredients, the alcohol ingredients, and the condensation catalyst shown in Tables 1-1 and 1-2, and the resulting mixture was allowed to react for 8 hours at 180° C. under nitrogen gas stream while produced water was removed by distillation. The mixture was then gradually heated to 200° C., and was allowed to react for 8 hours under nitrogen gas stream while produced water and alcohol were removed by distillation. The resultant was further reacted under a reduced pressure of 5 mmHg to 20 mmHg to thereby obtain a crystalline resin.

Then, 200 parts by mass out of the resulting crystalline resin was transferred to a reaction tank equipped with a condenser, a stirrer, and a nitrogen inlet tube. Ethyl acetate (250 parts by mass) and each of the isocyanate ingredients shown in Tables 1-1 and 1-2 were added thereto, and the resulting mixture was allowed to react (for at most 5 hours) at 80° C. under nitrogen gas stream while a small amount of the resultant was sampled every 30 min until Mw of the resultant reached the target Mw.

Subsequently, the ethyl acetate was removed by distillation under a reduced pressure, to thereby obtain [crystalline resin CH-1] to [crystalline resin CH-8] and [crystalline resin CL-1] to [crystalline resin CL-4].

The resultant resins had weight average molecular weights (Mw) shown in Table 1-2.

TABLE 1-1

| Crystalline resin | Acid ingredient | | | Alcohol ingredient | |
|---|---|---|---|---|---|
| | Sebacic acid | Adipic acid | Dodecanedioic acid | 1,4-Butanediol | 1,6-Hexanediol |
| CH-1 | 240 | 30 | 30 | 170 | — |
| CH-2 | 300 | — | — | — | 200 |
| CH-3 | 50 | 310 | — | 120 | 60 |
| CH-4 | 40 | — | 310 | 200 | — |
| CH-5 | — | 200 | 50 | — | 150 |
| CH-6 | 100 | 100 | 50 | 135 | 60 |
| CH-7 | 250 | — | 40 | 175 | — |
| CH-8 | 250 | 50 | — | — | 200 |
| CL-1 | 200 | — | — | 120 | — |
| CL-2 | 150 | 150 | — | 60 | 60 |
| CL-3 | 150 | — | 50 | — | 100 |
| CL-4 | 150 | — | 150 | 100 | 50 |

TABLE 1-2

| Crystalline resin | Isocyanate ingredients | | | Catalyst | | |
|---|---|---|---|---|---|---|
| | Hexamethylene diisocyanate (HDI) | Tolylene diisocyanate (TDI) | 4,4'-Diphenyl methane diisocyanate (MDI) | Titanium dihydroxybis (triethanol-aminate) | Target Mw | Actual Mw |
| CH-1 | 10.2 | — | — | 1 | 25,000 | 27,800 |
| CH-2 | 9.0 | — | — | 1 | 30,000 | 31,000 |
| CH-3 | — | 10.5 | — | 1 | 28,000 | 30,500 |
| CH-4 | — | — | 8.5 | 0.75 | 20,000 | 19,500 |
| CH-5 | 10.3 | — | — | 0.75 | 19,000 | 23,000 |
| CH-6 | — | 9.5 | — | 0.75 | 35,000 | 32,000 |
| CH-7 | 10.0 | — | — | 1 | 22,000 | 25,500 |
| CH-8 | — | — | 10.5 | 1 | 25,000 | 28,000 |
| CL-1 | 10.5 | — | — | 1 | 8,000 | 7,000 |
| CL-2 | 10.5 | — | — | 1 | 9,000 | 8,000 |
| CL-3 | — | 9.0 | — | 1 | 5,000 | 6,500 |
| CL-4 | 10.0 | — | — | 1 | 7,000 | 8,500 |

In Tables 1-1 and 1-2, amounts are expressed in "part(s) by mass."

Production Example A1-13

<Production of Crystalline Resin CH-9>

[Crystalline resin CH-9] was obtained in the same manner as in [crystalline resin CH-1], except that no isocyanate ingredient was added.

The resultant [crystalline resin CH-9] was found to have Mw of 23,000.

Production Example A2-1

<Production of Crystalline Resin Precursor 1>

A reaction tank equipped with a condenser, a stirrer, and a nitrogen inlet tube was charged with 250 parts by mass of hexamethylene diisocyanate (HDI) and 250 parts by mass of ethyl acetate. To the resulting mixture, a resin solution in which 250 parts by mass of [crystalline resin CL-1] had been dissolved in 250 parts by mass of ethyl acetate was added, and the resulting mixture was allowed to react for 5 hours at 80° C. under nitrogen gas stream, to thereby obtain a 50% by mass ethyl acetate solution of [crystalline resin precursor 1] having a terminal isocyanate group.

Production Example A2-2

<Production of Crystalline Resin Precursor 2>

A 50% by mass ethyl acetate solution of [crystalline resin precursor 2] was obtained in the same manner as in Production Example A2-1, except that [crystalline resin CL-1] was changed to [crystalline resin CL-2].

Production Example A3

<Production of Non-Crystalline Resin 1>

A reaction tank equipped with a condenser, a stirrer, and a nitrogen inlet tube was charged with 230 parts by mass of bisphenol A ethylene oxide 2 mol adduct, 100 parts by mass of bisphenol A propylene oxide 2 mol adduct, 165 parts by mass of isophthalic acid, and 1.0 part by mass of tetrabutoxy titanate, and the resulting mixture was allowed to react for 8 hours at 230° C. and one atmosphere under nitrogen gas stream while water was removed by distillation. Subsequently, the reactant was allowed to react under a reduced pressure of 5 mmHg to 20 mmHg, followed by cooling to 180° C. upon reaching the acid value of 2 mgKOH/g. Trimellitic anhydride (35 parts by mass) was added thereto, and the resulting mixture was allowed to react for 3 hours at one atmosphere to thereby obtain [non-crystalline resin 1]. The resultant [non-crystalline resin 1] was found to have Mw of 7,500 and Tg of 61° C.

Production Example A4

<Production of Non-Crystalline Resin Precursor>

A reaction tank equipped with a condenser, a stirrer, and a nitrogen inlet tube was charged with 800 parts by mass of bisphenol A ethylene oxide 2 mol adduct, 120 parts by mass of bisphenol A propylene oxide 2 mol adduct, 280 parts by mass of terephthalic acid, and 1 part by mass of tetrabutoxy titanate, and the resulting mixture was allowed to react for 8 hours at 230° C. and one atmosphere under nitrogen gas stream while water was removed by distillation. Subsequently, the reactant was allowed to react for 7 hour under a reduced pressure of 10 mmHg to 15 mmHg to thereby obtain [non-crystalline resin precursor intermediate].

Then, a reaction tank equipped with a condenser, a stirrer, and a nitrogen inlet tube was charged with 400 parts by mass of the resultant [non-crystalline resin intermediate], 105 parts by mass of isophorone diisocyanate and 500 parts by mass of ethyl acetate, and the resulting mixture was allowed to react for 8 hours at 80° C. under nitrogen gas stream to thereby obtain a 50% by mass ethyl acetate solution of [crystalline resin precursor 1] having a terminal isocyanate group.

Production Example A5

<Production of Colorant Masterbatchs A1 to A8>

Crystalline resins shown in Table 2 (100 parts by mass) was sufficiently mixed with carbon black (PRINTEX 35, product of Degussa AG) (100 parts by mass) as a pigment, and ion-exchanged water (30 parts by mass), and kneaded by means of an open-roll kneader (KNEADEX, product of Nippon Coke & Engineering Co., Ltd.). As for the kneading temperature, the kneading was initiated at 90° C., followed by gradually cooling to 50° C. In the manner as described, [masterbatch A1] to [masterbatch A8] containing the resin and the pigment in a 1:1 mass ratio was produced.

TABLE 2

| Masterbatch | Crystalline resin |
|---|---|
| Masterbatch A1 | Crystalline resin CH-1 |
| Masterbatch A2 | Crystalline resin CH-2 |
| Masterbatch A3 | Crystalline resin CH-3 |
| Masterbatch A4 | Crystalline resin CH-4 |
| Masterbatch A5 | Crystalline resin CH-5 |
| Masterbatch A6 | Crystalline resin CH-6 |
| Masterbatch A7 | Crystalline resin CH-7 |
| Masterbatch A8 | Crystalline resin CH-8 |

Production Example A6

<Production of Layered Inorganic Mineral Masterbatch 1>

[Crystalline resin CH-1] (100 parts by mass) was sufficiently mixed with a montmorillonite compound modified with a quaternary ammonium salt having a benzyl group at least a part thereof (CLAYTONE APA, product of Southern Clay Products Inc.) (100 parts by mass), and ion-exchanged water (50 parts by mass), and kneaded by means of an open-roll kneader (KNEADEX, product of Nippon Coke & Engineering Co., Ltd.). As for the kneading temperature, the kneading was initiated at 90° C., followed by gradually cooling to 50° C. In the manner as described, [layered inorganic mineral masterbatch 1] containing the resin and the layered inorganic mineral in a 1:1 mass ratio was produced.

Production Example A7

<Production of Releasing Agent Dispersion Liquid>

A reaction vessel equipped with a condenser, a thermometer, and a stirrer was charged with 20 parts by mass of paraffin wax (HNP-9, melting point: 75° C., product of NIPPON SEIRO CO., LTD.), and 80 parts by mass of ethyl acetate, and the resulting mixture was heated to 78° C. to sufficiently dissolve the wax in the ethyl acetate, followed by cooling to 30° C. over the period of 1 hour with stirring. The resultant was then subjected to wet pulverization by means of ULTRA VISCOMILL (product of AIMEX CO., Ltd.) under the following conditions: liquid feed rate of 1.0 Kg/hr, disc circumferential velocity of 10 m/s, 0.5 mm-zirconia beads packed to 80% by volume, and 6 passes, to thereby obtain [releasing agent dispersion liquid A1].

Production Example A8

<Synthesis of Organic Particle Emulsion>

A reaction vessel equipped with a stirrer and a thermometer was charged with 720 parts by mass of water, 16 parts by mass of a sodium salt of sulfuric acid ester of methacrylic acid ethylene oxide adduct (ELEMINOL RS-30, product of Sanyo Chemical Industries Ltd.), 85 parts by mass of styrene, 85 parts by mass of methacrylic acid, 100 parts by mass of butyl acrylate and 2 parts by mass of ammonium persulfate, and stirred at 4,200 rpm for 1 hour to obtain a white emulsion. Then, the resultant emulsion was heated to 75° C. (system temperature) and allowed to react for 4 hours. A 1% aqueous solution of ammonium persulfate (30 parts by mass) was added thereto, and the mixture was aged at 75° C. for 6 hours to thereby prepare [resin dispersion liquid 1].

The resultant [resin dispersion liquid 1] was found to have a volume average particle size of 55 nm as measured by a laser diffraction/scattering particle size distribution measuring device (LA-920, product of Horiba Ltd.).

A part of the [resin dispersion liquid 1] was dried to isolate the resin component, which was found to have a glass transition temperature (Tg) of 55° C. and a weight average molecular weight (Mw) of 130,000.

Production Example A9

<Preparation of Aqueous Phase>

[Aqueous phase A1] was prepared by mixing and stirring ion-exchanged water (800 parts by mass), [resin dispersion liquid 1] (200 parts by mass), and the non-ionic surfactant (DKS-NL-450, product of DAI-ICHI KOGYO SEIYAKU CO., LTD) (70 parts by mass) to thereby uniformly disperse.

Production Example A10

<Production of Carrier>

A carrier used in a developer was produced in the following manner.

As for a core material, 5,000 parts by mass of Mn ferrite particles (weight average particle diameter: 35 μm) were used. As for a coating material, a coating liquid, which had been prepared by dispersing 450 parts by mass of toluene, 450 parts by mass of a silicone resin SR2400 (product of Dow Corning Toray Co., Ltd., nonvolatile content: 50% by mass), 10 parts by mass of aminosilane SH6020 (product of Dow Corning Toray Co., Ltd.) and 10 parts by mass of carbon black (PRINTEX 35, product of Degussa AG) for 10 min with a stirrer, was used. The coating device was charged with the core material and the coating liquid to thereby coat the core material with the coating liquid. The coating device was a device equipped with a rotatable bottom plate disk, and a stirring blade, which performed coating by forming swirling air flow in a flow bed. The resulting coated product was baked in an electric furnace for 2 hours at 250° C., to thereby obtain [carrier A1].

Example 1

<Production of Toner A1>

—Preparation of Oil Phase—

A vessel equipped with a thermometer and a stirrer was charged with [crystalline resin CH-1], [crystalline resin CL-1], and [non-crystalline resin 1] in an amount shown in Table 3-1, and 80 parts by mass of ethyl acetate was added thereto. The resulting mixture was heated to the temperature equal to or higher than the melting point of the resins so that the resins were sufficiently dissolved in the ethyl acetate. To this, 10 parts by mass of [releasing dispersion liquid A1], and [layered inorganic mineral masterbatch 1] and [masterbatch A1] in an amount shown in Tables 3-1 and 3-2, and 2 parts by mass of ethyl acetate were added, and the resulting mixture was stirred by means of TK HOMOMIXER (product of Tokushu Kika Kogyo Co., Ltd.) at 50° C. and at 10,000 rpm to uniformly dissolve and disperse to thereby obtain [oil phase A1], which was used as a material of [toner A1]. Note that, the temperature of the [oil phase A1] was kept at 50° C. in the vessel, and the [oil phase A1] was used within 5 hours after production so as not to be crystallized.

—Preparation of Emulsified Slurry—

Then, another vessel equipped with a stirrer and a thermometer was charged with 100 parts by mass of [aqueous phase A1] which had been heated to 50° C. Meanwhile, 100 parts by mass of the [oil phase A1] which had been kept at 50° C. was added to the [aqueous phase A1] and mixed at 40° C. to 50° C. using TK HOMOMIXER (product of PRIMIX Corporation) at 13,000 rpm for 1 min to thereby obtain [emulsified slurry A1].

A vessel equipped with a stirrer and a thermometer was charged with the [emulsified slurry A1], followed by desolvating for 8 hours at 50° C. and then aging for 5 hours at 45° C., to thereby obtain [dispersed slurry 1].

The resultant [dispersed slurry 1] (100 parts by mass) was filtered under a reduced pressure, followed by subjected to the following washing procedure.

Then, ion-exchanged water (100 parts by mass) was added to the filtration cake, followed by mixing with TK HOMOMIXER (at 6,000 rpm for 5 min) and then filtration.

Then, a 10% by mass aqueous sodium hydroxide solution (100 parts by mass) was added to the resultant filtration cake, followed by mixing with TK HOMOMIXER (at 6,000 rpm for 10 min) and then filtration under reduced pressure.

Then, a 10% by mass hydrochloric acid (100 parts by mass) was added to the resultant filtration cake, followed by mixing with TK HOMOMIXER (at 6,000 rpm for 5 min) and then filtration.

Then, ion-exchanged water (300 parts by mass) was added to the resultant filtration cake, followed by mixing with TK HOMOMIXER (at 6,000 rpm for 5 min) and then filtration. This treatment was performed twice to thereby obtain [filtration cake 1].

The resultant [filtration cake 1] was dried by means of an air-circulating drier for 48 hours at 45° C., followed by passed through a sieve with a mesh size of 75 μm, to thereby produce [toner base particles A1].

Next, the resultant [toner base particles A1] (100 parts by mass) were mixed with hydrophobic silica (HDK-2000, product of Wacker Chemie AG) (1.0 part by mass) by means of HENSCHEL MIXER, to thereby obtain [toner A1].

<Production of Developer A1>

The resultant toner (7 parts by mass) was uniformly mixed with [carrier A1] (100 parts by mass) by means of TURBULA MIXER (product of Willy A. Bachofen (WAB) AG), in which a vessel was driven in rolling motions to perform stirring, for 3 min at 48 rpm to thereby charge the toner. In the present invention, a stainless steel vessel having an internal volume of 500 mL was charged with 200 g of the [carrier A1] and 14 g of the toner and mixed to thereby obtain [developer A1].

Examples 2 to 14 and Comparative Examples 1 to 5

<Production of Toners A2 to A11 and A13 to A19>

[Toner A2] to [toner A11] and [toner A13] to [toner A19] were obtained in the same manner as in Example 1, except that the [emulsified slurry A1] was changed to each of [emulsified slurry A2] to [emulsified slurry A11] and [emulsified slurry A13] to [emulsified slurry A19] which had been prepared according to the following methods.

<Production of Toner A12>

[Filtration Cake 12] was Obtained in the Same Manner as in Example 1, except that the [emulsified slurry A1] was changed to [emulsified slurry A12] which had been prepared according to the following method. The resultant [filtration cake 12] was annealed by means of an air-circulating drier for 24 hours at 50° C., followed by passed through a sieve with a mesh size of 75 to thereby produce [toner base particles A12].

[Toner A12] was obtained in the same manner as in Example 1 after the above steps.

—Production of Oil Phases A2 to A10 and A12 to A19—

[Oil phase A2] to [oil phase A10] and [oil phase A12] to [oil phase A19] were prepared according to compositions shown in Tables 3-1 and 3-2 in the same manner as "Preparation of oil phase" in Example 1

—Preparation of Oil Phase A11—

[Oil phase A11] was prepared according to compositions shown in Tables 3-1 and 3-2 in the same manner as in Example 1, except that 2.2 parts by mass of [nucleating agent] (ADEKASTAB NA-11, product of ADEKA CORPORATION, melting point: 400° C., phosphate ester metal salt compound) was added at the step of "Preparation of oil phase" in Example 1.

—Preparation of Emulsified Slurry A2—

Then, another vessel equipped with a stirrer and a thermometer was charged with 100 parts by mass of [aqueous phase 1] which had been heated to 50° C. Meanwhile, to [aqueous phase A1], was added 100 parts by mass of the [oil phase A2] which had been kept at 50° C., and further added [crystalline resin precursor], [non-crystalline resin precursor] and isocyanate so as to have a mass ratio shown in Table 3-2 and mixed at 40° C. to 50° C. using TK HOMOMIXER (product of PRIMIX Corporation) at 13,000 rpm for 1 min to thereby obtain [emulsified slurry A2].

—Preparation of Emulsified Slurries A3 to A19—

[Emulsified slurry A3] to [emulsified slurry A19] were prepared according to compositions shown in Tables 3-1 and 3-2 in the same manner as in "Preparation of emulsified slurry A2."

<Production of Developers A2 to A19>

[Developer A2] to [developer A19] were obtained in the same manner as in "Production of developer A1", except that the [toner A1] was changed to each of [toner A2] to [toner A19].

TABLE 3-1

| | | Emulsified slurry | | | | | | | |
|---|---|---|---|---|---|---|---|---|---|
| | | | | Oil phase | | | | | |
| | Toner | | | Crystalline resin (high molecular weight) | Parts by mass | Crystalline resin (low molecular weight) | Parts by mass | Non-crystalline resin 1 (parts by mass) | Releasing agent (parts by mass) |
| Ex. 1 | A1 | A1 | A1 | CH-1 | 80 | CL-1 | 40 | 0 | 10 |
| Ex. 2 | A2 | A2 | A2 | CH-2 | 50 | CL-2 | 100 | 0 | 10 |
| Ex. 3 | A3 | A3 | A3 | CH-3 | 60 | CL-3 | 120 | 50 | 10 |
| Ex. 4 | A4 | A4 | A4 | CH-4 | 150 | CL-4 | 100 | 0 | 10 |

TABLE 3-1-continued

| | Toner | | Emulsified slurry | | | | | | |
|---|---|---|---|---|---|---|---|---|---|
| | | | | Oil phase | | | | | |
| | | | | Crystalline resin (high molecular weight) | Parts by mass | Crystalline resin (low molecular weight) | Parts by mass | Non-crystalline resin 1 (parts by mass) | Releasing agent (parts by mass) |
| Ex. 5 | A5 | A5 | A5 | CH-5 | 120 | — | 0 | 0 | 10 |
| Ex. 6 | A6 | A6 | A6 | CH-6 | 80 | — | 0 | 100 | 10 |
| Ex. 7 | A7 | A7 | A7 | CH-7 | 60 | CL-1 | 30 | 100 | 10 |
| Ex. 8 | A8 | A8 | A8 | CH-8 | 80 | CL-2 | 30 | 200 | 10 |
| Ex. 9 | A9 | A9 | A9 | — | 0 | CL-1 | 100 | 0 | 10 |
| Ex. 10 | A10 | A10 | A10 | — | 0 | CL-2 | 100 | 100 | 10 |
| Ex. 11 | A11 | A11 | A11 | CH-1 | 150 | CL-1 | 40 | 20 | 10 |
| Ex. 12 | A12 | A12 | A12 | CH-1 | 50 | CL-1 | 40 | 50 | 10 |
| Ex. 13 | A13 | A13 | A13 | — | 0 | CL-1 | 40 | 100 | 10 |
| Ex. 14 | A14 | A14 | A14 | CH-1 | 200 | — | 0 | 0 | 10 |
| Comp. Ex. 1 | A15 | A15 | A15 | CH-1 | 150 | CL-1 | 40 | 20 | 10 |
| Comp. Ex. 2 | A16 | A16 | A16 | CH-1 | 50 | CL-1 | 40 | 50 | 10 |
| Comp. Ex. 3 | A17 | A17 | A17 | CH-9 | 200 | — | 0 | 0 | 10 |
| Comp. Ex. 4 | A18 | A18 | A18 | CH-1 | 80 | CL-1 | 40 | 0 | 10 |
| Comp. Ex. 5 | A19 | A19 | A19 | — | 0 | CL-1 | 100 | 30 | 10 |

TABLE 3-2

| | Emulsified slurry | | | | | | | |
|---|---|---|---|---|---|---|---|---|
| | Oil phase | | | | | Non-crystalline | | |
| | Layered inorganic mineral (parts by mass) | Colorant masterbatch | Parts by mass | Crystalline resin precursor | Parts by mass | resin precursor 1 (parts by mass) | Isocyanate | Parts by mass |
| Ex. 1 | 5 | Masterbatch A1 | 10 | — | 0 | 0 | — | 0 |
| Ex. 2 | 5 | Masterbatch A2 | 15 | — | 0 | 0 | — | 0 |
| Ex. 3 | 5 | Masterbatch A3 | 10 | — | 0 | 0 | — | 0 |
| Ex. 4 | 5 | Masterbatch A4 | 10 | — | 0 | 50 | HDI | 5 |
| Ex. 5 | 5 | Masterbatch A5 | 15 | — | 0 | 0 | — | 0 |
| Ex. 6 | 0 | Masterbatch A6 | 15 | — | 0 | 0 | — | 0 |
| Ex. 7 | 0 | Masterbatch A7 | 15 | — | 0 | 0 | — | 0 |
| Ex. 8 | 0 | Masterbatch A8 | 15 | — | 0 | 0 | — | 0 |
| Ex. 9 | 0 | Masterbatch A1 | 15 | Precursor 1 | 50 | 0 | TDI | 5 |
| Ex. 10 | 0 | Masterbatch A2 | 15 | Precursor 2 | 50 | 0 | HDI | 5 |
| Ex. 11 | 0 | Masterbatch A1 | 10 | — | 0 | 0 | — | 0 |
| Ex. 12 | 0 | Masterbatch A1 | 10 | — | 0 | 0 | — | 0 |
| Ex. 13 | 0 | Masterbatch A1 | 10 | — | 0 | 0 | — | 0 |
| Ex. 14 | 0 | Masterbatch A1 | 10 | — | 0 | 0 | — | 0 |
| Comp. Ex. 1 | 0 | Masterbatch A1 | 10 | — | 0 | 0 | — | 0 |
| Comp. Ex. 2 | 0 | Masterbatch A1 | 10 | — | 0 | 0 | — | 0 |
| Comp. Ex. 3 | 0 | Masterbatch A1 | 10 | — | 0 | 0 | — | 0 |
| Comp. Ex. 4 | 0 | Masterbatch A1 | 10 | — | 0 | 0 | — | 0 |
| Comp. Ex. 5 | 0 | Masterbatch A1 | 10 | — | 0 | 0 | — | 0 |

In Table 3-2, "HDI" denotes hexamethylene diisocyanate, and "TDI" denotes tolylenediisocyanate.

(Measurement of Toner)

[Toner A1] to [toner A19] were measured for their physical properties. Results are shown in Tables 4-1 and 4-2.

TABLE 4-1

| | | Average crystallite diameter (nm) | Amount of crystalline structure C/(A + C) | Softening temp. (° C.) | Max. peak temp. (° C.) | Softening temp./Max. peak temp. | Amount of heat of fusion (J/g) | Molecular weight 100,000 or more (%) | Molecular weight 250,000 or more (%) |
|---|---|---|---|---|---|---|---|---|---|
| Ex. 1 | Toner A1 | 40 | 0.35 | 72 | 60 | 1.2 | 50 | 4.1 | 0 |
| Ex. 2 | Toner A2 | 30 | 0.20 | 93 | 62 | 1.5 | 35 | 2.5 | 0 |
| Ex. 3 | Toner A3 | 35 | 0.55 | 70 | 70 | 1.0 | 55 | 3.8 | 0 |
| Ex. 4 | Toner A4 | 35 | 0.35 | 69 | 53 | 1.3 | 80 | 14 | 1.3 |
| Ex. 5 | Toner A5 | 70 | 0.45 | 95 | 68 | 1.4 | 70 | 5.1 | 0 |
| Ex. 6 | Toner A6 | 30 | 0.50 | 58 | 48 | 1.2 | 45 | 3.8 | 0 |

TABLE 4-1-continued

| | | Average crystallite diameter (nm) | Amount of crystalline structure C/(A + C) | Softening temp. (° C.) | Max. peak temp. (° C.) | Softening temp./Max. peak temp. | Amount of heat of fusion (J/g) | Molecular weight 100,000 or more (%) | Molecular weight 250,000 or more (%) |
|---|---|---|---|---|---|---|---|---|---|
| Ex. 7 | Toner A7 | 65 | 0.25 | 47 | 52 | 0.9 | 60 | 2.1 | 0 |
| Ex. 8 | Toner A8 | 20 | 0.10 | 54 | 45 | 1.2 | 55 | 2.9 | 0 |
| Ex. 9 | Toner A9 | 60 | 0.25 | 75 | 68 | 1.1 | 25 | 15 | 1.7 |
| Ex. 10 | Toner A10 | 57 | 0.50 | 49 | 70 | 0.7 | 30 | 17 | 1.9 |
| Ex. 11 | Toner A11 | 40 | 0.20 | 83 | 64 | 1.3 | 42 | 2.2 | 0 |
| Ex. 12 | Toner A12 | 56 | 0.31 | 68 | 62 | 1.1 | 47 | 2.8 | 0 |
| Ex. 13 | Toner A13 | 30 | 0.17 | 107 | 63 | 1.7 | 17 | 1.8 | 0 |
| Ex. 14 | Toner A14 | 44 | 0.52 | 59 | 59 | 1.0 | 78 | 4.5 | 0 |
| Comp. Ex. 1 | Toner A15 | 75 | 0.52 | 98 | 70 | 1.4 | 80 | 4.5 | 0 |
| Comp. Ex. 2 | Toner A16 | 11 | 0.13 | 78 | 60 | 1.3 | 65 | 1.3 | 0 |
| Comp. Ex. 3 | Toner A17 | 50 | 0.76 | 59 | 65 | 0.9 | 50 | 5.0 | 0 |
| Comp. Ex. 4 | Toner A18 | 15 | 0.12 | 64 | 58 | 1.1 | 79 | 2.9 | 0 |
| Comp. Ex. 5 | Toner A19 | 80 | 0.51 | 47 | 59 | 0.8 | 66 | 1.1 | 0 |

TABLE 4-2

| | | Content of N element (% by mass) | Endothermic amount ΔH(T) | Endothermic amount ΔH(H) | Endothermic amount ΔH(H)/ΔH(T) | Max. endothermic peak temp. T1 (° C.) | Max. exothermic peak temp. T2 (° C.) | T1 − T2 |
|---|---|---|---|---|---|---|---|---|
| Ex. 1 | Toner A1 | 0.8 | 60 | 49 | 0.81 | 59 | 27 | 32 |
| Ex. 2 | Toner A2 | 0.8 | 42 | 34 | 0.82 | 61 | 30 | 31 |
| Ex. 3 | Toner A3 | 0.8 | 71 | 56 | 0.79 | 69 | 35 | 34 |
| Ex. 4 | Toner A4 | 0.7 | 60 | 52 | 0.87 | 52 | 25 | 27 |
| Ex. 5 | Toner A5 | 0.8 | 65 | 53 | 0.81 | 67 | 34 | 33 |
| Ex. 6 | Toner A6 | 0.8 | 86 | 66 | 0.77 | 47 | 22 | 25 |
| Ex. 7 | Toner A7 | 0.8 | 47 | 37 | 0.78 | 51 | 23 | 28 |
| Ex. 8 | Toner A8 | 0.8 | 30 | 23 | 0.77 | 44 | 20 | 24 |
| Ex. 9 | Toner A9 | 0.8 | 39 | 48 | 1.24 | 67 | 27 | 40 |
| Ex. 10 | Toner A10 | 0.8 | 68 | 78 | 1.15 | 69 | 30 | 39 |
| Ex. 11 | Toner A11 | 0.8 | 71.2 | 56 | 0.78 | 62 | 39 | 23 |
| Ex. 12 | Toner A12 | 0.9 | 65.3 | 58 | 0.89 | 63 | 35 | 28 |
| Ex. 13 | Toner A13 | 0.8 | 31.2 | 26 | 0.82 | 60 | 35 | 25 |
| Ex. 14 | Toner A14 | 0.8 | 49.6 | 51 | 1.03 | 65 | 30 | 35 |
| Comp. Ex. 1 | Toner A15 | 0.8 | 62 | 50 | 0.81 | 69 | 40 | 29 |
| Comp. Ex. 2 | Toner A16 | 0.9 | 29 | 16 | 0.55 | 59 | 44 | 15 |
| Comp. Ex. 3 | Toner A17 | 0.8 | 80 | 71 | 0.89 | 64 | 32 | 32 |
| Comp. Ex. 4 | Toner A18 | 0.8 | 55 | 50 | 0.91 | 58 | 28 | 30 |
| Comp. Ex. 5 | Toner A19 | 0.8 | 21 | 22 | 1.04 | 61 | 39 | 22 |

(Evaluation)

Images were formed using the above produced developers A1 to A19, and evaluated for end-offset, gloss unevenness, winding of recording media, and blocking resistance. The evaluations were performed as follows. Results are shown in Table 5.

<Image Forming Apparatus>

The image forming apparatus illustrated in FIG. 2, which includes the of an induction heating type fixing device illustrated in FIG. 4, was used for forming images.

<Evaluation of End-Offset>

The following fixing conditions were used: fixing pressure: 2.5 kgf/cm$^2$ and fixing nip time: 80 msec. At first, 100 sheets of A4-sized blank paper having no unfixed image thereon were continuously fed in a longitudinal direction thereof. Immediately after that, a sheet of A3 size paper on which an unfixed whole solid image had been formed was fed to a fixing device in a longitudinal direction thereof to thereby form a fixed image. A temperature of the fixing device (fixing unit) was controlled so as to be a constant temperature which was changed every 5° C. from the temperature at the start of feeding the A4 size paper. Upon forming the fixed image, the fixing lower limit temperature and the fixing upper limit temperature were determined based on a state of the solid image around the center of the A3 size paper as follows. As for the fixing lower limit temperature, the surface of a central portion of the obtained fixed image was drawn with a ruby needle (tip radius: 260 μmR to 320 μmR, point angle: 60 degrees) by means of a drawing tester AD-401 (product of Ueshima Seisakusho Co., Ltd.) with a load of 50 g. The drawn surface was rubbed strongly 5 times with fibers (HANICOT #440, product of Haniron K.K.). The temperature of the fixing belt at which there was little image exfoliation was determined as the fixing lower limit temperature. As for the fixing upper limit temperature, the maximum temperature at which a hot-offset was not occurred at the central portion of the image was determined as the fixing upper limit temperature. A median temperature was calculated from the fixing lower limit temperature and the fixing upper limit temperature determined as described above. The presence or absence of hot-offset was evaluated at the median temperature. The median temperature was defined as an average temperature of the fixing lower limit temperature and the fixing upper limit temperature, or a lower temperature which is the closest to the average temperature (e.g., the median temperature was 155° C. when the fixing lower limit temperature was 120° C. and the fixing upper limit temperature was 190° C., and the median temperature was 150° C. when the fixing lower limit temperature was 120° C. and the fixing upper limit temperature was 185° C.). At the median temperature, the presence or absence of the offset at both ends (i.e., non-A4 paper feeding portion) was evaluated, which was determined as the end-offset.

The end-offset evaluation was as follows. In the case where the offset was occurred when the unfixed whole solid image was fed, the solid image was exfoliated to thereby expose a surface of the blank paper. The percentage of the area of the exposed blank paper relative to the area of the non-A4 paper feeding portion was calculated and evaluated according to the following criteria. Regarding the evaluation results, A and B is preferred and A is more preferred. D represents an unsatisfactory result.

Notably, the percentage of the area of the exposed blank paper relative to the area of the non-A4 paper feeding portion was calculated by scanning the paper to be evaluated, capturing the image on the paper, changing the image to a gray scale image, and subjecting to a binarization processing which uses as a boundary value a median between the deepest color portion and the lightest color portion.

[Evaluation Criteria]

A: The area of the exposed blank paper was less than 1% (the end-offset was not occurred).

B: The area of the exposed blank paper was 1% or more but less than 3% (the end-offset was slightly occurred).

C: The area of the exposed blank paper was 3% or more but less than 10% (the end-offset was clearly occurred).

D: The area of the exposed blank paper was 10% or more (the end-offset was very clearly occurred).

<Gloss Unevenness>

For the fixed image at the median temperature used in the above end-offset evaluation, glossiness around the center of the image and glossiness around both ends of the image were evaluated by means of GLOSS METER VG7000 (product of NIPPON DENSHOKU INDUSTRIES CO., LTD.). The ratio X/Y (where X denotes glossiness around the center of the image and Y denotes glossiness around both ends of the image) was determined as gloss unevenness and evaluated according to the following criteria. Regarding the evaluation results, A and B is preferred and A is more preferred. D represents an unsatisfactory result.

[Evaluation Criteria]

A: $0.9 \leq X/Y \leq 1.0$ (no gloss unevenness)

B: $0.8 \leq X/Y < 0.9$ or $1.0 < X/Y \leq 1.1$ (slight gloss unevenness)

C: $0.6 \leq X/Y < 0.8$ or $1.1 < X/Y \leq 1.3$ (clear gloss unevenness)

D: $X/Y < 0.6$ or $1.3 < X/Y$ (very clear gloss unevenness)

<Paper Winding>

The fixing temperature was set to 200° C. using the same device and conditions as the above end-offset evaluation. Similar to the end-offset evaluation, 100 sheets of A4-sized blank paper were continuously fed, and then a sheet of A3 size paper on which an unfixed whole solid image had been formed was fed to thereby visually evaluate the presence or absence of paper winding around a fixing roller. Regarding the evaluation results, A and B is preferred and A is more preferred. D represents an unsatisfactory result.

[Evaluation Criteria]

A: The paper was not wound around the fixing roller.

B: The paper was slightly wound around the fixing roller (paper was wound around the fixing roller, but the paper could be separated from the fixing roller due to its own weight).

C: The paper was wound around the fixing roller (the paper which had been wound around the fixing roller could not be separated from the fixing roller due to its own weight, but could be separated by means of a physical separation member such as a separation pawl).

D: The paper was greatly wound around the fixing roller (paper which had been wound around the fixing roller could not be separated from the fixing roller even though a physical separation member such as a separation pawl was used).

<Blocking Resistance of Image>

A printing test was performed on Type 6200 Paper (product of Ricoh Company Limited) by means of a copier MF 2200 (product of Ricoh Company Limited) in which a fixing portion had been modified by using a Teflon (registered trade mark) roller as a fixing roller. Specifically, the fixing temperature was set to the temperature which is 20° C. higher than the fixing lower limit temperature calculated in the low-temperature fixability evaluation. The following conditions were used: a paper feeding linear velocity of 120 mm/sec to 150 mm/sec, contact pressure of 1.2 kgf/cm$^2$, and nip width of 3 mm. The resultant fixed image was superposed on a sheet of blank paper, followed by being sandwiched by metal plates, to which a load was applied so that an applied pressure was 10 kPa. The resultant was then stored for 24 hours at 50° C. Then, the image was peeled from the blank paper to thereby being evaluated for blocking resistance.

Notably, the blocking resistance was evaluated according to the following criteria.

[Evaluation Criteria]

A: The Image was not exfoliated from the blank paper at all, and sound was not made upon peeling.

B: The Image was not exfoliated from the blank paper, but sound was made upon peeling.

C: The Image was adhered to the blank paper, and a small part of the image was broken upon peeling.

D: The Image was adhered to the blank paper, and a large part of the image was broken upon peeling.

TABLE 5

| | | | Fixing lower limit temp. (° C.) | Fixing upper limit temp. (° C.) | End offset | Gloss unevenness | Winding | Blocking |
|---|---|---|---|---|---|---|---|---|
| Ex. 1 | Developer A1 | Toner A1 | 105 | 185 | B | A | B | B |
| Ex. 2 | Developer A2 | Toner A2 | 110 | 185 | A | B | B | B |
| Ex. 3 | Developer A3 | Toner A3 | 115 | 180 | B | A | B | B |
| Ex. 4 | Developer A4 | Toner A4 | 105 | >200 | B | B | A | A |
| Ex. 5 | Developer A5 | Toner A5 | 110 | 185 | A | A | A | B |
| Ex. 6 | Developer A6 | Toner A6 | 105 | 180 | A | B | B | A |
| Ex. 7 | Developer A7 | Toner A7 | 100 | 170 | B | A | B | A |
| Ex. 8 | Developer A8 | Toner A8 | 145 | 195 | A | A | B | A |
| Ex. 9 | Developer A9 | Toner A9 | 105 | >200 | A | B | A | B |
| Ex. 10 | Developer A10 | Toner A10 | 105 | >200 | B | B | B | A |
| Ex. 11 | Developer A11 | Toner A11 | 115 | 180 | A | A | B | A |
| Ex. 12 | Developer A12 | Toner A12 | 110 | 185 | A | A | A | B |
| Ex. 13 | Developer A13 | Toner A13 | 115 | 175 | B | B | B | A |

TABLE 5-continued

| | | | Fixing lower limit temp. (° C.) | Fixing upper limit temp. (° C.) | End offset | Gloss unevenness | Winding | Blocking |
|---|---|---|---|---|---|---|---|---|
| Ex. 14 | Developer A14 | Toner A14 | 100 | 180 | B | B | B | B |
| Comp. Ex. 1 | Developer A15 | Toner A15 | 110 | 170 | C | D | C | D |
| Comp. Ex. 2 | Developer A16 | Toner A16 | 140 | 190 | D | C | C | B |
| Comp. Ex. 3 | Developer A17 | Toner A17 | 100 | 135 | D | D | D | D |
| Comp. Ex. 4 | Developer A18 | Toner A18 | 105 | 170 | C | D | D | C |
| Comp. Ex. 5 | Developer A19 | Toner A19 | 100 | 160 | D | C | C | B |

Production Example B1-1

<Production of Urethane-modified Crystalline Polyester Resin A-1 (Crystalline Resin A-1)>

A reaction tank equipped with a condenser, a stirrer, and a nitrogen inlet tube was charged with 202 parts by mass (1.00 mol) of sebacic acid, 15 parts by mass (0.10 mol) of adipic acid, 177 parts by mass (1.50 mol) of 1,6-hexanediol, and as a condensation catalyst, 0.5 parts by mass of tetrabutoxy titanate, and the resulting mixture was allowed to react for 8 hours at 180° C. under nitrogen gas stream while produced water was removed by distillation. The mixture was then gradually heated to 220° C., and was allowed to react for 4 hours under nitrogen gas stream while produced water and 1,6-hexanediol were removed by distillation. The resultant was further reacted under a reduced pressure of 5 mmHg to 20 mmHg until Mw of the resultant reached about 12,000 to thereby obtain [crystalline polyester resin A'-1]. The resultant [crystalline polyester resin A'-1] was found to have Mw of 12,000.

The resultant [crystalline polyester resin A'-1] was transferred to a reaction tank equipped with a condenser, a stirrer, and a nitrogen inlet tube. To this, 350 parts by mass of ethyl acetate, and 30 parts by mass (0.12 mol) of 4,4'-diphenyl methane diisocyanate (MDI) were added, and the resulting mixture was allowed to react for 5 hours at 80° C. under nitrogen gas stream. Subsequently, the ethyl acetate was removed by distillation under a reduced pressure, to thereby obtain [urethane-modified crystalline polyester resin A-1]. The resultant [urethane-modified crystalline polyester resin A-1] was found to have Mw of 22,000, and a melting point of 62° C.

Production Example B1-2

<Production of Urethane-modified Crystalline Polyester Resin A-2 (Crystalline Resin A-2)>

A reaction tank equipped with a condenser, a stirrer, and a nitrogen inlet tube was charged with 202 parts by mass (1.00 mol) of sebacic acid, 189 parts by mass (1.60 mol) of 1,6-hexanediol, and as a condensation catalyst, 0.5 parts by mass of dibutyl tin oxide, and the resulting mixture was allowed to react for 8 hours at 180° C. under nitrogen gas stream while produced water was removed by distillation. The mixture was then gradually heated to 220° C., and was allowed to react for 4 hours under nitrogen gas stream while produced water and 1,6-hexanediol were removed by distillation. The resultant was further reacted under a reduced pressure of 5 mmHg to 20 mmHg until Mw of the resultant reached about 6,000 to thereby obtain [crystalline polyester resin A'-2]. The resultant [crystalline polyester resin A'-2] was found to have Mw of 6,000.

The resultant [crystalline polyester resin A'-2] was transferred to a reaction tank equipped with a condenser, a stirrer, and a nitrogen inlet tube. To this, 300 parts by mass of ethyl acetate, and 38 parts by mass (0.15 mol) of 4,4'-diphenyl methane diisocyanate (MDI) were added, and the resulting mixture was allowed to react for 5 hours at 80° C. under nitrogen gas stream. Subsequently, the ethyl acetate was removed by distillation under a reduced pressure, to thereby obtain [urethane-modified crystalline polyester resin A-2]. The resultant [urethane-modified crystalline polyester resin A-2] was found to have Mw of 10,000, and a melting point of 64° C.

Production Example B1-3

<Production of Urethane-Modified Crystalline Polyester Resin A-3 (Crystalline Resin A-3)>

A reaction tank equipped with a condenser, a stirrer, and a nitrogen inlet tube was charged with 185 parts by mass (0.91 mol) of sebacic acid, 13 parts by mass (0.09 mol) of adipic acid, 106 parts by mass (1.18 mol) of 1,4-butanediol, and as a condensation catalyst, 0.5 parts by mass of titanium dihydroxybis(triethanolaminate), and the resulting mixture was allowed to react for 8 hours at 180° C. under nitrogen gas stream while produced water was removed by distillation. The mixture was then gradually heated to 220° C., and was allowed to react for 4 hours under nitrogen gas stream while produced water and 1,4-butanediol were removed by distillation. The resultant was further reacted under a reduced pressure of 5 mmHg to 20 mmHg until Mw of the resultant reached about 14,000 to thereby obtain [crystalline polyester resin A'-3]. The resultant [crystalline polyester resin A'-3] was found to have Mw of 14,000.

The resultant [crystalline polyester resin A'-3] was transferred to a reaction tank equipped with a condenser, a stirrer, and a nitrogen inlet tube. To this, 250 parts by mass of ethyl acetate, and 12 parts by mass (0.07 mol) of hexamethylene diisocyanate (HDI) were added, and the resulting mixture was allowed to react for 5 hours at 80° C. under nitrogen gas stream. Subsequently, the ethyl acetate was removed by distillation under a reduced pressure, to thereby obtain [urethane-modified crystalline polyester resin A-3]. The resultant [urethane-modified crystalline polyester resin A-3] was found to have Mw of 39,000, and a melting point of 63° C.

Production Example B1-4

<Production of Crystalline Polyester Resin A-4 (Crystalline Resin A-4)>

A reaction tank equipped with a condenser, a stirrer, and a nitrogen inlet tube was charged with 185 parts by mass (0.91 mol) of sebacic acid, 13 parts by mass (0.09 mol) of adipic acid, 125 parts by mass (1.39 mol) of 1,4-butanediol, and as a condensation catalyst, 0.5 parts by mass of titanium dihydroxybis(triethanolaminate), and the resulting mixture was allowed to react for 8 hours at 180° C. under nitrogen gas stream while produced water was removed by distillation.

The mixture was then gradually heated to 220° C., and was allowed to react for 4 hours under nitrogen gas stream while produced water and 1,4-butanediol were removed by distillation. The resultant was further reacted under a reduced pressure of 5 mmHg to 20 mmHg until Mw of the resultant reached about 10,000 to thereby obtain [crystalline polyester resin A-4]. The resultant [crystalline polyester resin A-4] was found to have Mw of 9,500, and a melting point of 57° C.

Production Example B2-1

<Production of Crystalline Resin Precursor B-1 (Crystalline Resin B-1)>

A reaction tank equipped with a condenser, a stirrer, and a nitrogen inlet tube was charged with 202 parts by mass (1.00 mol) of sebacic acid, 122 parts by mass (1.03 mol) of 1,6-hexanediol, and as a condensation catalyst, 0.5 parts by mass of titanium dihydroxybis(triethanolaminate), and the resulting mixture was allowed to react for 8 hours at 180° C. under nitrogen gas stream while produced water was removed by distillation. The mixture was then gradually heated to 220° C., and was allowed to react for 4 hours under nitrogen gas stream while produced water and 1,6-hexanediol were removed by distillation. The resultant was further reacted under a reduced pressure of 5 mmHg to 20 mmHg until Mw of the resultant reached about 25,000 to thereby obtain [crystalline resin B'-1].

The resultant [crystalline resin B'-1] was transferred to a reaction tank equipped with a condenser, a stirrer, and a nitrogen inlet tube. To this, 300 parts by mass of ethyl acetate, and 27 parts by mass (0.16 mol) of hexamethylene diisocyanate (HDI) were added, and the resulting mixture was allowed to react for 5 hours at 80° C. under nitrogen gas stream to thereby obtain a 50% by mass ethyl acetate solution of [crystalline resin precursor B-1] having a terminal isocyanate group.

The resultant ethyl acetate solution of [crystalline resin precursor B-1] (10 parts by mass) was mixed with tetrahydrofuran (THF) (10 parts by mass). To this, was added dibutyl amine (1 part by mass), followed by stirring for 2 hours to thereby a sample solution. The resultant sample solution was subjected to GPC measurement and the [crystalline resin precursor B-1] was found to have Mw of 54,000. The solution was desolvated and subjected to DSC measurement, and the [crystalline resin precursor B-1] was found to have a melting point of 57° C.

Production Example B2-2

<Production of Urethane-Modified Crystalline Polyester Resin B-2 (Crystalline Resin B-2)>

A reaction tank equipped with a condenser, a stirrer, and a nitrogen inlet tube was charged with 113 parts by mass (0.56 mol) of sebacic acid, 109 parts by mass (0.56 mol) of dimethyl terephthalate, 132 parts by mass (1.12 mol) of 1,6-hexanediol, and as a condensation catalyst, 0.5 parts by mass of titanium dihydroxybis(triethanolaminate), and the resulting mixture was allowed to react for 8 hours at 180° C. under nitrogen gas stream while produced water and methanol was removed by distillation. The mixture was then gradually heated to 220° C., and was allowed to react for 4 hours under nitrogen gas stream while produced water and 1,6-hexanediol were removed by distillation. The resultant was further reacted under a reduced pressure of 5 mmHg to 20 mmHg until Mw of the resultant reached about 35,000 to thereby obtain [crystalline polyester resin B'-2]. The resultant [crystalline polyester resin B'-2] was found to have Mw of 34,000.

The resultant [crystalline polyester resin B'-2] was transferred to a reaction tank equipped with a condenser, a stirrer, and a nitrogen inlet tube. To this, 200 parts by mass of ethyl acetate, and 10 parts by mass (0.06 mol) of hexamethylene diisocyanate (HDI) were added, and the resulting mixture was allowed to react for 5 hours at 80° C. under nitrogen gas stream. Subsequently, the ethyl acetate was removed by distillation under a reduced pressure, to thereby obtain [urethane-modified crystalline polyester resin B-2]. The resultant [urethane-modified crystalline polyester resin B-2] was found to have Mw of 63,000, and a melting point of 65° C.

Production Example B3-1

<Production of Non-Crystalline Resin C-1>

A reaction tank equipped with a condenser, a stirrer, and a nitrogen inlet tube was charged with 222 parts by mass of bisphenol A EO 2 mol adduct, 129 parts by mass of bisphenol A PO 2 mol adduct, 166 parts by mass of isophthalic acid, and 0.5 parts by mass of tetrabutoxy titanate, and the resulting mixture was allowed to react for 8 hours at 230° C. and at normal pressure under nitrogen gas stream while produced water was removed by distillation. Subsequently, the reactant was allowed to react under a reduced pressure of 5 mmHg to 20 mmHg, followed by cooling to 180° C. upon reaching the acid value of 2 mgKOH/g. To this, 35 parts by mass of trimellitic anhydride was added, and the resulting mixture was allowed to react for 3 hours at normal pressure to thereby obtain [non-crystalline resin C-1]. The resultant [non-crystalline resin C-1] had found to have Mw of 8,000 and Tg of 62° C.

Production Example B3-2)

<Production of Non-Crystalline Resin Precursor C-2 (Non-Crystalline Resin C-2)>

A reaction tank equipped with a condenser, a stirrer, and a nitrogen inlet tube was charged with 720 parts by mass of bisphenol A EO 2 mol adduct, 90 parts by mass of bisphenol A PO 2 mol adduct, 290 parts by mass of terephthalic acid, and 1 part by mass of tetrabutoxy titanate, and the resulting mixture was allowed to react for 8 hours at 230° C. and at normal pressure under nitrogen gas stream while produced water was removed by distillation. Subsequently, the reactant was allowed to react for 7 hours under a reduced pressure of 10 mmHg to 15 mmHg to thereby obtain [non-crystalline resin C'-2].

A reaction tank equipped with a condenser, a stirrer, and a nitrogen inlet tube was charged with 400 parts by mass of the resultant [non-crystalline resin C'-2], 95 parts by mass of isophorone diisocyanate, and 500 parts by mass of ethyl acetate, and the resulting mixture was allowed to react for 8 hours at 80° C. under nitrogen gas stream to thereby obtain a 50% by mass ethyl acetate solution of [non-crystalline resin precursor C-2] having a terminal isocyanate group.

Examples 15 to 20 and Comparative Example 6

<Production of Toner>

—Production of Graft Polymer—

A reaction vessel to which a stirring rod and a thermometer had been set was charged with 480 parts by mass of xylene and 100 parts by mass of a low-molecular-weight polyethylene (SANWAX LEL-400, product of Sanyo Chemical Industries, Ltd., softening point: 128° C.) and was thoroughly dissolved. After the reaction vessel had been purged with nitrogen, a mixed solution of styrene (740 parts by mass), acrylonitrile (100 parts by mass), butyl acrylate (60 parts by mass), di-t-butylperoxyhexahydro terephthalate (36 parts by mass) and xylene (100 parts by mass) was added dropwise thereto at 170° C. for 3 hours to perform polymerization. The reaction polymer was kept at the same temperature for further 30 min. Next, the resultant polymer was desolvated to synthesize [graft polymer]. The resultant [graft polymer] was found to have Mw of 24,000 and Tg of 67° C.

—Preparation of Releasing Agent Dispersion Liquid—

A vessel to which a stirring rod and a thermometer had been set was charged with 50 parts by mass of paraffin wax (HNP-9, product of NIPPON SEIRO CO. LTD., hydrocarbon wax, melting point: 75° C., SP value: 8.8), 30 parts by mass of the [graft polymer] and 420 parts by mass of ethyl acetate, and the resultant mixture was increased in temperature to 80° C. under stirring, kept at 80° C. for 5 hours and cooled to 30° C. for 1 hour. The resultant mixture was dispersed using a beads mill (ULTRAVISCOMILL, product of Aimex CO. LTD.) under the following conditions: liquid feed rate of 1 kg/hr, disc circumferential velocity of 6 m/s, 0.5 mm-zirconia beads packed to 80% by volume, and 3 passes, to thereby obtain [releasing agent dispersion liquid B1].

—Preparation of Masterbatch—

| | |
|---|---|
| Crystalline resin A-1 | 100 parts by mass |
| Carbon black (PRINTEX 35, product of Degussa AG) (DBP absorption amount: 42 mL/100 g, pH: 9.5) | 100 parts by mass |
| Ion exchanged water | 50 parts by mass |

The above-listed materials were mixed together using HENSCHEL MIXER (product of NIPPON COKE & ENGINEERING CO. LTD.). The resultant mixture was kneaded using a two-roll. The kneading was initiated at a temperature of 90° C. and then the kneading temperature was gradually decreased to 50° C. The obtained kneaded product was pulverized with a pulverizer (product of Hosokawa Micron CO. LTD.) to prepare [masterbatch B1].

[Masterbatch B2] to [masterbatch B4] were produced in the same manner as in the [masterbatch B1] according to Table 6.

TABLE 6

| | Resin |
|---|---|
| Masterbatch B1 | Crystalline resin A-1 |
| Masterbatch B2 | Crystalline resin A-2 |
| Masterbatch B3 | Crystalline resin A-3 |
| Masterbatch B4 | Crystalline resin A-4 |

—Preparation of Oil Phases B1 to B3 and B7—

A vessel equipped with a thermometer and a stirrer was charged with 54 parts by mass of the [urethane-modified crystalline polyester resin A-1] and ethyl acetate in such an amount that the solid content concentration would be 50% by mass, and the resultant mixture was heated to a temperature equal to or higher than the melting point of the resin so as to be thoroughly dissolved. To the resultant solution were added 20 parts of the 50% by mass ethyl acetate solution of the [non-crystalline resin C-1], 60 parts by mass of the [releasing agent dispersion liquid B1] and 12 parts by mass of the [masterbatch B1], and the resultant mixture was stirred at 50° C. using a TK HOMOMIXER (product of Tokushu Kika Kogyo Co., Ltd.) at 5,000 rpm, so that the components were homogeneously dissolved or dispersed to thereby obtain [oil phase B1]. Notably, the [oil phase B1] was kept at 50° C. in the vessel, and used within 5 hours after production so as not to be crystallized.

Each of oil phases B2, B3, and B7 was prepared in the same manner as in the preparation of the [oil phase B1] except that the type and amount of the crystalline resin A, the amount of the crystalline resin B, the amount of the non-crystalline resin C, and the type of the masterbatch were changed according to Table 7. Notably, the crystalline resin B and the [non-crystalline resin precursor C-2] in Table 7 were not added at a step of producing an oil phase, but added to each oil phase at a step of producing toner base particles as described below to thereby be dissolved and dispersed.

TABLE 7

| | Binder resin | | | | | | | | |
|---|---|---|---|---|---|---|---|---|---|
| | Crystalline resin (A) | | Crystalline resin (B) | | Non-crystalline resin (C) | | | | |
| | Type | Parts by mass | Type | Parts by mass | Type | Parts by mass | Type | Parts by mass | Master-batch |
| Oil phase B1 | A-1 | 54 | B-1 | 20 | C-1 | 20 | — | — | B1 |
| Oil phase B2 | A-2 | 54 | B-1 | 20 | C-1 | 20 | — | — | B2 |
| Oil phase B3 | A-3 | 54 | B-1 | 20 | C-1 | 20 | — | — | B3 |
| Oil phase B7 | A-4 | 15 | — | — | C-1 | 62 | C-2 | 17 | B4 |

—Preparation of Oil Phases B4 to B6—

A vessel equipped with a thermometer and a stirrer was charged with 54 parts by mass of the [urethane-modified crystalline polyester resin A-1], 20 parts by mass of the [urethane-modified crystalline polyester resin B-2] and ethyl acetate in such an amount that the solid content concentration would be 50% by mass, and the resultant mixture was heated to a temperature equal to or higher than the melting point of the resin so as to be thoroughly dissolved. To the resultant solution were added 20 parts by mass of the 50% by mass ethyl acetate solution of the [non-crystalline resin C-1], 60 parts by mass of the [releasing agent dispersion liquid B1] and 12 parts by mass by mass of the [masterbatch B1], and the resultant mixture was stirred at 50° C. using a TK HOMOMIXER (product of Tokushu Kika Kogyo Co., Ltd.) at 5,000 rpm, so that the components were homogeneously dissolved or dispersed to thereby obtain [oil phase B4]. Notably, the [oil phase B4] was kept at 50° C. in the vessel, and was used within 5 hours after production so as not to be crystallized.

Each of oil phases B5 and B6 was prepared in the same manner as in the preparation of the [oil phase B1] except that the type and amount of the crystalline resin A, the type and amount of the crystalline resin B, the amount of the non-crystalline resin C, and the type of the masterbatch were changed according to Table 8.

TABLE 8

| | Binder resin | | | | | | |
|---|---|---|---|---|---|---|---|
| | Crystalline resin (A) | | Crystalline resin (B) | | Non-crystalline resin (C) | | |
| | Type | Parts by mass | Type | Parts by mass | Type | Parts by mass | Master-batch |
| Oil phase B4 | A-1 | 54 | B-1 | 20 | C-1 | 20 | B1 |
| Oil phase B5 | A-2 | 54 | B-1 | 20 | C-1 | 20 | B2 |
| Oil phase B6 | A-3 | 54 | B-1 | 20 | C-1 | 20 | B3 |

—Production of Aqueous Dispersion Liquid of Resin Particles—

A reaction vessel to which a stirring rod and a thermometer had been set was charged with 600 parts by mass of water, 120 parts by mass of styrene, 100 parts by mass of methacrylic acid, 45 parts by mass of butyl acrylate, 10 parts by mass of sodium alkylally sulfosuccinate (ELEMINOL JS-2, product of Sanyo Chemical Industries Ltd.) and 1 part of ammonium persulfate, and the resultant mixture was stirred at 400 rpm for 20 min to obtain a white emulsion. The resultant white emulsion was heated to 75° C. (system temperature) and allowed to react for 6 hours. In addition, 30 parts by mass of a 1% by mass aqueous ammonium persulfate solution was added to the reaction mixture, which was then aged at 75° C. for 6 hours, to thereby obtain [aqueous dispersion liquid of resin particles]. The particles contained in the [aqueous dispersion liquid of resin particles] were found to have a volume average particle diameter of 80 nm, and the resin ingredient thereof was found to have a weight average molecular weight of 160,000 and Tg of 74° C.

—Preparation of Aqueous Phase—

Water (990 parts by mass), the [aqueous dispersion liquid of resin particles] (83 parts by mass), a 48.5% by mass aqueous solution of sodium dodecyl diphenyl ether disulfonate (ELEMINOL MON-7, product of Sanyo Chemical Industries Ltd.) (37 parts by mass) and ethyl acetate (90 parts by mass) were mixed together to obtain [aqueous phase B1].

—Production of Toner Base Particles B1 to B3 and B7—

The [aqueous phase B1] (520 parts by mass) was added to another vessel to which a stirrer and a thermometer had been set, and then heated to 40° C. To 235 parts by mass of [oil phase B1] which had been kept at 50° C., was added a 25 parts by mass ethyl acetate solution of [crystalline resin precursor B-1], and the resulting mixture was mixed by means of TK HOMOMIXER (product of PRIMIX CO. LTD.) at 5,000 rpm, followed by uniformly dissolving and dispersing to thereby obtain [oil phase Br]. While the [aqueous phase] which had been kept at 40° C. to 50° C. was being stirred at 13,000 rpm using TK HOMOMIXER (product of PRIMIX CO. LTD.), the [oil phase Br] was added to the [aqueous phase], followed by emulsification for 1 min, to thereby obtain [emulsified slurry B1].

Next, the obtained [emulsified slurry B1] was added to a vessel to which a stirrer and a thermometer had been set, and then was desolvated at 60° C. for 6 hours to thereby obtain [slurry 1]. The obtained [slurry 1] was filtrated under reduced pressure and subjected to the following washing treatments.

(1) Ion exchanged water (100 parts by mass) was added to the filtration cake, followed by mixing with TK HOMOMIXER (at 6,000 rpm for 5 min) and filtrating.

(2) A 10% by mass aqueous sodium hydroxide solution (100 parts by mass) was added to the filtration cake obtained in (1), followed by mixing with TK HOMOMIXER (at 6,000 rpm for 10 min) and filtrating under reduced pressure.

(3) 10% by mass hydrochloric acid (100 parts by mass) was added to the filtration cake obtained in (2), followed by mixing with TK HOMOMIXER (at 6,000 rpm for 5 min) and filtrating.

(4) Ion-exchanged water (300 parts by mass) was added to the filtration cake obtained in (3), followed by mixing with TK HOMOMIXER (at 6,000 rpm for 5 min) and filtrating. This treatment was performed twice to thereby obtain filtration cake (1).

The obtained filtration cake (1) was dried with an air-circulation dryer at 45° C. for 48 hours, and then sieved with a mesh having an opening size of 75 μm to obtain toner base particles B1.

In the same manner, toner base particles B2, B3, and B7 were produced using the oil phases B2, B3, and B7, respectively.

—Production of Toner Base Particles B4 to B6—

The [aqueous phase B1] (520 parts by mass) was added to another vessel to which a stirrer and a thermometer had been set, and then heated to 40° C. While the [aqueous phase] which had been kept at 40° C. to 50° C. was being stirred at 13,000 rpm using TK HOMOMIXER (product of PRIMIX CO. LTD.), the [oil phase B4] was added to the [aqueous phase], followed by emulsification for 1 min, to thereby obtain [emulsified slurry B4].

Next, the obtained [emulsified slurry B4] was added to a vessel to which a stirrer and a thermometer had been set, and then was desolvated at 60° C. for 6 hours to thereby obtain [slurry 4]. The obtained [slurry 4] was filtrated under reduced pressure and subjected to the following washing treatments.

(1) Ion exchanged water (100 parts by mass) was added to the filtration cake, followed by mixing with TK HOMOMIXER (at 6,000 rpm for 5 min) and filtrating.

(2) A 10% by mass aqueous sodium hydroxide solution (100 parts by mass) was added to the filtration cake obtained in (1), followed by mixing with TK HOMOMIXER (at 6,000 rpm for 10 min) and filtrating under reduced pressure.

(3) 10% by mass hydrochloric acid (100 parts by mass) was added to the filtration cake obtained in (2), followed by mixing with TK HOMOMIXER (at 6,000 rpm for 5 min) and filtrating.

(4) Ion-exchanged water (300 parts by mass) was added to the filtration cake obtained in (3), followed by mixing with TK HOMOMIXER (at 6,000 rpm for 5 min) and filtrating. This treatment was performed twice to thereby obtain filtration cake (4).

The obtained filtration cake (4) was dried with an air-circulation dryer at 45° C. for 48 hours, and then sieved with a mesh having an opening size of 75 μm to obtain toner base particles B4.

In the same manner, toner base particles B5 and B6 were produced using the oil phases B5 and B6, respectively.

—Production of Toners B1 to B7—

Using HENSCHEL MIXER (product of NIPPON COKE & ENGINEERING CO. LTD.), each of the obtained toner base particles B1 to B7 (100 parts by mass) was mixed with 1.0 part by mass of hydrophobic silica (HDK-2000, product of Wacker Chemie AG) serving as an external additive at a circumferential speed of 30 m/sec with five cycles each consisting of mixing for 30 sec and suspending for 1 min. The resultant mixture was sieved with a mesh having an opening size of 35 μm to produce toners B1 to B7.

<Production of Carrier>

| | |
|---|---|
| Silicone resin SR2400 (product of Dow Corning Toray Co., Ltd., nonvolatile content: 50% by mass) | 100 parts by mass |
| γ-(2-Aminoethyl)aminopropyltrimethoxysilane | 5 parts by mass |
| Carbon black (PRINTEX 35, product of Degussa AG) | 100 parts by mass |

The above materials were dispersed using a homomixer for 20 min to prepare a resin layer-coating liquid. Thereafter, surfaces of spherical ferrite particles (1,000 parts by mass) having a volume average particle diameter of 35 μm were coated with the resin layer-coating liquid using a fluidized-bed coating apparatus, to thereby produce a carrier.

<Production of Developer>

Each of the toners B-1 to B-7 (5 parts by mass) was mixed with the carrier (95 parts by mass) to thereby produce each of developers B-1 to B-7.

(Measurement of Toner)

The toners B-1 to B-7 were measured for their physical properties. Results are Tables 9-1 and 9-2.

Evaluation

Examples 15 to 22 and Comparative Example 6

Images were formed using the above produced developers B1 to B7, and evaluated for end-offset, gloss unevenness, winding of recording media, and blocking resistance. The evaluations were performed in the same manner as in Example 1, except that the following image forming apparatus was used. Results are shown in Table 10.

<Image Forming Apparatus>

The image formation in Examples 15 to 20 and Comparative Example 6 were performed using the image forming apparatus illustrated in FIG. 2 which includes the of an induction heating type fixing device illustrated in FIG. 9.

Figure 5:
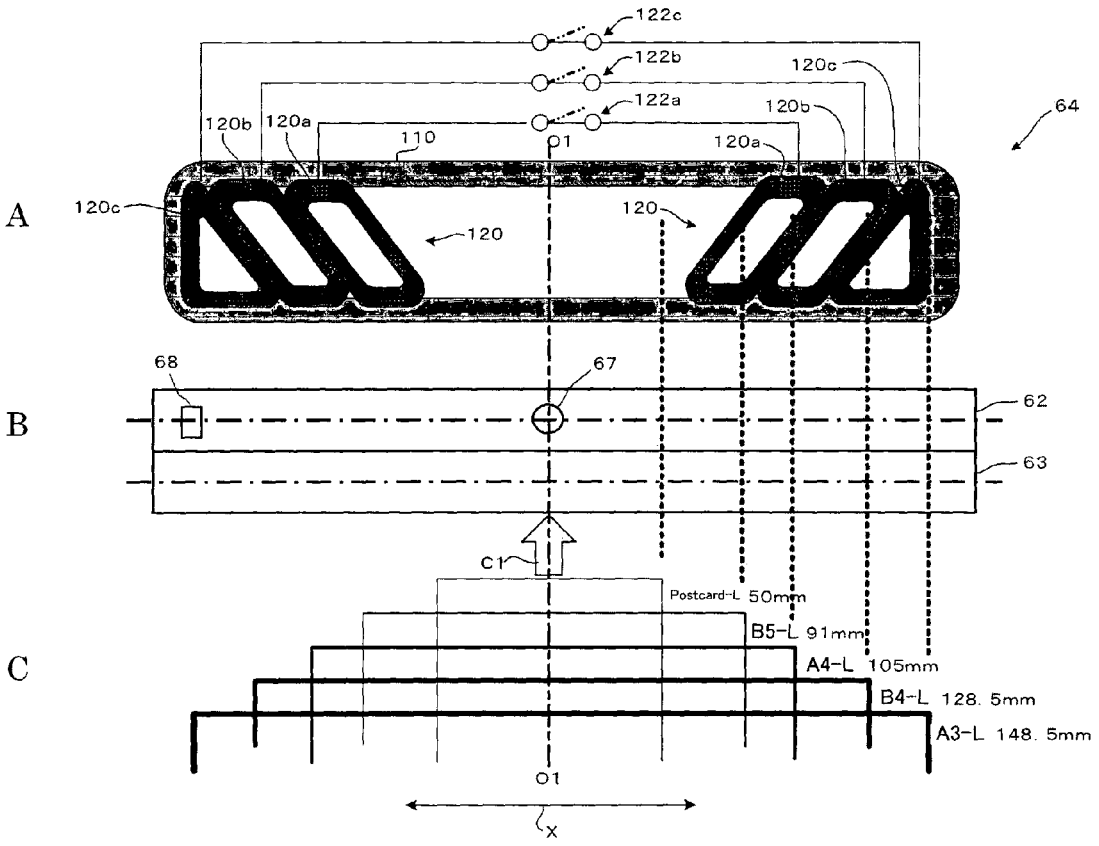
FIG. 5 is a conceptual diagram illustrating an arrangement of an exciting coil, a degaussing coil, and a temperature detecting unit in the fixing device illustrated in FIG. 4 as well as a paper feeding mode.

The image formation in Example 21 was performed using the same image forming apparatus as in Example 15 except that the degaussing coil 120 illustrated in FIG. 5 was excluded.

The image formation in Example 22 was performed using the same image forming apparatus as in Example 15 except that a belt fixing device was used which was performed heating with a halogen heater installed inside a cylindrical portion of an opposed-roller 252 instead of heating with the induction coil 254.

TABLE 9-1

| | | Average crystallite diameter (nm) | Amount of crystalline structure C/(A + C) | Softening temp. (° C.) | Max. peak temp. (° C.) | Softening temp./Max. peak temp. | Amount of heat of fusion (J/g) | Molecular weight 100,000 or more (%) | Molecular weight 250,000 or more (%) |
|---|---|---|---|---|---|---|---|---|---|
| Ex. 15 | B1 | 40 | 0.35 | 70 | 60 | 1.2 | 50 | 15 | 1.7 |
| Ex. 16 | B2 | 45 | 0.40 | 66 | 65 | 1.0 | 60 | 14 | 1.2 |
| Ex. 17 | B3 | 50 | 0.45 | 66 | 74 | 0.9 | 55 | 17 | 1.9 |
| Ex. 18 | B4 | 35 | 0.35 | 68 | 78 | 0.9 | 70 | 2.1 | 0 |
| Ex. 19 | B5 | 65 | 0.50 | 72 | 70 | 1.0 | 80 | 1.5 | 0 |
| Ex. 20 | B6 | 60 | 0.40 | 58 | 52 | 1.1 | 65 | 3.2 | 0 |
| Comp. Ex. 6 | B7 | 17 | 0.10 | 98 | 70 | 1.4 | 35 | 14 | 1.1 |

TABLE 9-2

| | | Content of N element (% by mass) | Endothermic amount ΔH(T) | Endothermic amount ΔH(H) | Endothermic amount ΔH(H)/ΔH(T) | Max. endothermic peak temp. T1 (° C.) | Max. exothermic peak temp. T2 (° C.) | T1 − T2 (° C.) |
|---|---|---|---|---|---|---|---|---|
| Ex. 15 | B1 | 1.2 | 60 | 72 | 1.20 | 59 | 29 | 30 |
| Ex. 16 | B2 | 0.9 | 70 | 91 | 1.30 | 63 | 33 | 30 |
| Ex. 17 | B3 | 1.5 | 65 | 98 | 1.50 | 73 | 40 | 33 |
| Ex. 18 | B4 | 1.6 | 40 | 28 | 0.71 | 75 | 38 | 37 |
| Ex. 19 | B5 | 0.8 | 55 | 36 | 0.65 | 69 | 39 | 30 |
| Ex. 20 | B6 | 1.3 | 50 | 31 | 0.62 | 51 | 17 | 34 |
| Comp. Ex. 6 | B7 | 0.5 | 21 | 11 | 0.50 | 69 | 49 | 20 |

TABLE 10

| | | | Fixing lower limit temp. (° C.) | Fixing upper limit temp. (° C.) | End offset | Gloss unevenness | Winding | Blocking |
|---|---|---|---|---|---|---|---|---|
| Ex. 15 | Developer B1 | Toner B1 | 100 | >200 | A | B | A | B |
| Ex. 16 | Developer B2 | Toner B2 | 105 | >200 | B | A | B | A |
| Ex. 17 | Developer B3 | Toner B3 | 110 | >200 | A | A | A | B |
| Ex. 18 | Developer B4 | Toner B4 | 100 | 170 | A | B | B | B |
| Ex. 19 | Developer B5 | Toner B5 | 105 | 180 | B | B | A | B |
| Ex. 20 | Developer B6 | Toner B6 | 105 | 180 | B | A | B | A |
| Ex. 21 | Developer B1 | Toner B1 | 100 | >200 | B | B | B | B |
| Ex. 22 | Developer B1 | Toner B1 | 100 | >200 | B | B | B | B |
| Comp. Ex. 6 | Developer B7 | Toner B7 | 140 | 200 | D | D | C | B |

Embodiments of the present invention are as follows:

<1> A toner including:

a crystalline resin;

wherein the crystalline resin contains a crystalline resin having a urethane bond, a urea bond or both thereof, and wherein the crystalline resin has an average crystallite diameter of 20 nm to 70 nm.

<2> The toner according to <1>, wherein a ratio [C/(A+C)] of (C) integrated intensity of a spectrum derived from a crystalline structure to a sum of the (C) and (A) integrated intensity of a spectrum derived from a non-crystalline structure in a diffraction spectrum of the toner obtained by X-ray diffraction measurement is 0.15 or more.

<3> The toner according to <1> or <2>, wherein a maximum peak temperature of heat of fusion in a second heating in differential scanning calorimetry of the toner is 50° C. to 70° C., and wherein an amount of heat of fusion in the second heating in the differential scanning calorimetry of the toner is 30 J/g to 75 J/g.

<4> The toner according to any one of <1> to <3>, wherein a tetrahydrofuran soluble content of the toner includes, on a peak area basis, 5.0% or more of a component having a molecular weight of 100,000 or greater in a molecular weight distribution measured by gel permeation chromatography.

<5> The toner according to any one of <1> to <4>, wherein a tetrahydrofuran soluble content of the toner includes, on a peak area basis, 1.0% or more of a component having a molecular weight of 250,000 or greater in a molecular weight distribution measured by gel permeation chromatography.

<6> The toner according to any one of <1> to <5>, wherein a content of

N element in a CHN analysis of the tetrahydrofuran soluble content of the toner is 0.3% by mass to 2.0% by mass.

<7> The toner according to any one of <1> to <6>, wherein a ratio [ΔH(H)/ΔH(T)] of an endothermic amount [ΔH(H), (J/g)] in the differential scanning calorimetry of the insoluble content of the toner to a mixed solution of tetrahydrofuran and ethyl acetate [tetrahydrofuran/ethyl acetate=50/50 (mass ratio)] to an endothermic amount [ΔH(T), (J/g)] in the differential scanning calorimetry of the toner is 0.15 or more.

<8> The toner according to any one of <1> to <7>, wherein a maximum endothermic peak temperature in a second heating (T1) and a maximum exothermic peak temperature in a first cooling (T2) in a range of 0° C. to 150° C. in the differential scanning calorimetry of the toner meet the following expressions:

$$T1-T2\leq 30^\circ\ \text{C.} \qquad \text{Expression (1)}$$

$$T2\geq 30^\circ\ \text{C.} \qquad \text{Expression (2).}$$

<9> The toner according to any one of <1> to <8>, wherein the crystalline resin having a urethane bond, a urea bond or both thereof contains a first crystalline resin and a second crystalline resin having a weight average molecular weight higher than that of the first crystalline resin.

<10> The toner according to any one of <1> to <9>, wherein the crystalline resin having a urethane bond, a urea bond or both thereof contains a crystalline resin having a crystalline polyester unit, and a urethane bond, a urea bond or both thereof.

<11> A developer including:

the toner according to any one of <1> to <10>.

<12> An image forming apparatus including:

an electrostatic latent image bearing member;

an electrostatic latent image forming unit configured to form an electrostatic latent image on the electrostatic latent image bearing member;

a developing unit containing a toner and configured to develop the electrostatic latent image which has been formed on the electrostatic latent image bearing member to thereby form a visible image;

a transfer unit configured to transfer the visible image onto a recording medium to thereby form a transferred image; and a fixing unit configured to fix the transferred image which has been transferred onto the recording medium, wherein the toner is the toner according to any one of <1> to <10>.

<13> The image forming apparatus according to <12>, wherein the fixing unit contains a fixing member, and is configured to allow the fixing member to generate heat and contact the fixing member with the transferred image to fix the transferred image.

<14> The image forming apparatus according to <13>, wherein the fixing unit contains an induction heating member configured to allow the fixing member to generate heat through induction heating.

REFERENCE SIGNS LIST

6 Fixing device
20BK, 20Y, 20M, 20C Photoconductor drum
50BK, 50Y, 50M, 50C Developing device
62 Fixing roller
100 Image forming apparatus

The invention claimed is:

1. A toner comprising:

a crystalline resin;

wherein the crystalline resin contains a crystalline resin having a urethane bond, a urea bond or both thereof, and wherein the crystalline resin has an average crystallite diameter of 20 nm to 70 nm.

2. The toner according to claim 1, wherein a ratio [C/(A+C)] of (C) an integrated intensity of a spectrum derived from a crystalline structure to a sum of the (C) and (A) an integrated intensity of a spectrum derived from a non-crystalline structure in a diffraction spectrum of the toner obtained by X-ray diffraction measurement is 0.15 or more.

3. The toner according to claim 1, wherein a maximum peak temperature of heat of fusion in a second heating in differential scanning calorimetry of the toner is 50° C. to 70° C., and wherein an amount of heat of fusion in the second heating in the differential scanning calorimetry of the toner is 30 J/g to 75 J/g.

4. The toner according to claim 1, wherein a tetrahydrofuran soluble content of the toner comprises, on a peak area basis, 5.0% or more of a component having a molecular weight of 100,000 or greater in a molecular weight distribution measured by gel permeation chromatography.

5. The toner according to claim 1, wherein a tetrahydrofuran soluble content of the toner comprises, on a peak area basis, 1.0% or more of a component having a molecular weight of 250,000 or greater in a molecular weight distribution measured by gel permeation chromatography.

6. The toner according to claim 1, wherein a content of N element in a CHN analysis of the tetrahydrofuran soluble content of the toner is 0.3% by mass to 2.0% by mass.

7. The toner according to claim 1, wherein a ratio [ΔH(H)/ΔH(T)] of an endothermic amount [ΔH(H), (J/g)] in the differential scanning calorimetry of the insoluble content of the toner to a mixed solution of tetrahydrofuran and ethyl acetate [tetrahydrofuran/ethyl acetate=50/50 (mass ratio)] to an endothermic amount [ΔH(T), (J/g)] in the differential scanning calorimetry of the toner is 0.15 or more.

8. The toner according to claim 1, wherein a maximum endothermic peak temperature in a second heating (T1) and a maximum exothermic peak temperature in a first cooling (T2) in a range of 0° C. to 150° C. in the differential scanning calorimetry of the toner meet the following expressions:

$$T1-T2 \leq 30° \text{ C.} \quad \text{Expression (1)}$$

$$T2 \geq 30° \text{ C.} \quad \text{Expression (2).}$$

9. The toner according to claim 1, wherein the crystalline resin having a urethane bond, a urea bond or both thereof comprises a first crystalline resin and a second crystalline resin having a weight average molecular weight higher than that of the first crystalline resin.

10. The toner according to claim 1, wherein the crystalline resin having a urethane bond, a urea bond or both thereof comprises a crystalline resin having a crystalline polyester unit, and a urethane bond, a urea bond or both thereof.

11. A developer comprising:

the toner according to claim 1.

12. An image forming apparatus comprising:

an electrostatic latent image bearing member;

an electrostatic latent image forming unit configured to form an electrostatic latent image on the electrostatic latent image bearing member;

a developing unit containing a toner and configured to develop the electrostatic latent image which has been formed on the electrostatic latent image bearing member to thereby form a visible image;

a transfer unit configured to transfer the visible image onto a recording medium to thereby form a transferred image; and a fixing unit configured to fix the transferred image which has been transferred onto the recording medium, wherein the toner is the toner according to claim 1.

13. The image forming apparatus according to claim 12, wherein the fixing unit contains a fixing member, and is configured to allow the fixing member to generate heat and contact the fixing member with the transferred image to fix the transferred image.

14. The image forming apparatus according to claim 13, wherein the fixing unit contains an induction heating member configured to allow the fixing member to generate heat through induction heating.

* * * * *